US007387560B2

(12) United States Patent
Brumagin et al.

(10) Patent No.: US 7,387,560 B2
(45) Date of Patent: Jun. 17, 2008

(54) ELECTRONIC TOY

(75) Inventors: James G. Brumagin, Angola, NY (US); Patrick J. Murphy, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 710 days.

(21) Appl. No.: 10/910,804

(22) Filed: Aug. 4, 2004

(65) Prior Publication Data

US 2006/0030235 A1 Feb. 9, 2006

(51) Int. Cl.
*A63H 3/52* (2006.01)

(52) U.S. Cl. ..... 446/481; 446/175

(58) Field of Classification Search ..... 446/479, 446/481; 434/127, 308, 340, 343, 345
See application file for complete search history.

(56) References Cited

U.S. PATENT DOCUMENTS

| | | | |
|---|---|---|---|
| 2,586,564 | A | 2/1952 | Rinde |
| 3,593,431 | A | 7/1971 | Candido et al. |
| 4,150,831 | A | 4/1979 | Watanabe |
| D258,162 | S | 2/1981 | Orenstein et al. |
| D261,159 | S | 10/1981 | Rapaport |
| D261,404 | S | 10/1981 | Appel et al. |
| 4,307,534 | A | 12/1981 | Tomita |
| 4,333,258 | A | 6/1982 | McCaslin |
| D277,020 | S | 1/1985 | Mariol |
| 4,515,359 | A | 5/1985 | Mariol |
| 4,648,086 | A | 3/1987 | Koike |
| D294,608 | S | 3/1988 | Benedetto et al. |
| 4,820,233 | A | 4/1989 | Weiner |
| 4,823,332 | A | 4/1989 | Koike |
| 4,980,919 | A | 12/1990 | Tsai |
| 5,184,971 | A | 2/1993 | Williams |
| D342,295 | S | 12/1993 | Houry et al. |
| 5,285,437 | A | 2/1994 | Yokota et al. |
| D345,592 | S | 3/1994 | Houry et al. |
| 5,334,022 | A | 8/1994 | Kitigawa et al. |
| 5,382,188 | A | 1/1995 | Tomellini |
| D366,292 | S | 1/1996 | Monneret |
| D370,947 | S | 6/1996 | Pipik |
| D382,921 | S | 8/1997 | Pipik |

(Continued)

FOREIGN PATENT DOCUMENTS

GB 2215110 A 9/1989

OTHER PUBLICATIONS http://www.toptoysonline.com/Viewitem.asp?idproduct=867, Kid Design, Inc. Barbie Cook with Me Kitchen Product, Aug. 2, 2004.

(Continued)

*Primary Examiner*—Robert E Pezzuto
*Assistant Examiner*—Alex F. R. P. Rada, II
(74) *Attorney, Agent, or Firm*—Edell, Shapiro & Finnan, LLC

(57) ABSTRACT

The electronic toy of the present invention utilizes numerous switches to detect (1) the actuation of the toy, (2) the identity of a theme card (containing distinct indicia) inserted into the toy, and (3) the position of an indicia selector in relation to the indicia on the theme card inserted in the toy to produce, card specific, and more specifically, card and indicia specific sensory output.

22 Claims, 62 Drawing Sheets

U.S. PATENT DOCUMENTS

| | | | | |
|---|---|---|---|---|
| 5,679,049 | A | 10/1997 | Arad et al. | |
| 5,695,345 | A | 12/1997 | Weiner et al. | |
| 5,768,223 | A | 6/1998 | Li et al. | |
| 5,959,281 | A | 9/1999 | Domiteaux | |
| 6,287,560 | B1 * | 9/2001 | Fujii | 434/127 |
| 6,439,957 | B1 | 8/2002 | MacCarthy | |

OTHER PUBLICATIONS www.fisherprice.com, Fisher-Price Learning Sensations No. Cards, Fisher-Price Product No. 77824, Sep. 17, 2003.

http://www.fisher-price.com/us/smartshopper/, Fisher-Price Smart Shopper Product, Fisher-Price Product No. B-1504, Aug. 2, 2004.

http://www.fisher-price.com/us/products/product.asp?id=11388; Fisher-Price Sweet Magic Kitchen Model No. 75423, Aug. 2, 2004.

http://www.littletikes.com/toyfinder/productsfull.asp?sku=4225&product=Cookin'+Fun+Interactive+Kitchen; Little Tikes Cookin' Fun Interactive Kitchen, Aug. 2, 2004.

http://www.littletikes.com/toyfinder/productsfull.asp?sku=4111&product=Cookin'+Sounds+Gourmet+Kitchen;Little Tikes Cookin' Sounds Gourmet Kitchen, Aug. 2, 2004.

http://www.littletikes.com/toyfinder/productsfull.asp?sku=4315&product=Tender+Heart+Tea+Party+Kitchen; Little Tikes Tender Heart Tea Party Kitchen, Aug. 2, 2004.

www.littletikes.com/toyfinder/ProductsFull.asp?sku=4917&category=24, Little Tikes SuperGlow Electronic Kitchen, Sep. 17, 2003.

* cited by examiner

CLOCK HAND POSITION LOOK-UP TABLE

| TIME ON CLOCK | SW3 | SW4 | SW5 |
|---|---|---|---|
| 1 | 0 | 1 | 1 |
| 3 | 1 | 0 | 0 |
| 5 | 1 | 1 | 0 |
| 7 | 0 | 0 | 1 |
| 9 | 1 | 0 | 1 |
| 11 | 0 | 1 | 0 |

FIG.31

CARD IDENTIFYING LOOK-UP TABLE

| CARD | SW6 | SW7 | SW8 |
|---|---|---|---|
| NO CARD (EVERYDAY) | 0 | 0 | 0 |
| CARD A SIDE 1 (BIRTHDAY) | 1 | 0 | 0 |
| CARD A SIDE 2 (PICNIC) | 1 | 1 | 0 |
| CARD B SIDE 1 (TEA PARTY) | 1 | 0 | 1 |
| CARD B SIDE 2 (SLEEP OVER) | 1 | 1 | 1 |

FIG.32

ELECTRONIC TOY

FIELD OF THE INVENTION

This invention relates to an electronic toy for imaginative play, and more particularly, to an interactive, child's play kitchen.

BACKGROUND

Children enjoy imaginative play, particularly, role play. Such role play toys can provide hours of creative, engaging play for children. Interactivity between the toy and the child using the toy is an important feature. Such role plays also serve other purposes, such as an educational purpose, for instance, reinforcing time-telling, direction following, communication, and other pragmatic social skills. Thus, an interactive, role play toy that provides a wide variety of play patterns that include audio output and visual interaction is highly desirable.

SUMMARY OF THE INVENTION

A role play toy kitchen according to the present invention can provide interactive entertainment for a child. The electronics portion of the toy kitchen can include a kitchen clock with a background divided up into six different segments, where, for example, each particular segment is made up of a separate picture (visual indicia). When the child turns the clock hand to a particular segment and presses a button, a character, for example, Barbie, will verbalize phrases that pertain to the picture within the selected clock segment. The role play toy kitchen also includes two 2-sided theme cards that can be installed behind the clock face to show various themes, i.e., birthdays, picnics, sleepovers, and tea parties. Each theme card also includes a background divided up into six different segments, wherein each particular segment is made up of a separate picture or other visual indicia. When no card is installed behind the clock face, a base theme is displayed on the rear wall of the clock. The electronics portion of the toy includes a mechanism to detect where the clock hand is pointing (and thus, which segment is being identified by the hand). The electronics portion of the toy also includes a mechanism to detect which theme card, and more specifically, which particular side of that card, if any, is installed behind the clock face. Thus, the electronics portion of the toy includes mechanisms to detect (1) which theme card is inserted in the clock portion, and (2) where the clock hand is pointing on a particular theme card.

The role play toy kitchen according to the present invention may also include a toy telephone. When the toy telephone is placed in its holder, a switch is activated. The toy may simulate phone calls from a character, i.e., Barbie. The role play toy kitchen may include a speaker with volume control for audio output.

In a general aspect, an electronic toy according to the present invention may include a plurality of theme cards. Each theme card may include at least one visual indicia. The housing of the electronic toy may include a card receiving portion for receiving any of the plurality of theme cards. The electronics unit of the electronic toy may be connected to the housing. The electronics unit may generate sensory output. The sensory output generated by the electronics unit may be specific with respect to each of the plurality of theme cards and more specifically, may be associated with a specific one of the at least one indicia in response to any one of the plurality of theme cards being received in a card receiving portion of the electronic toy.

Each of the plurality of theme cards may include a card identifying portion adapted to uniquely identify a particular theme card. The card identifying portion of each of the plurality of theme cards may activate at least one switch in the card receiving portion to uniquely identify a particular theme card. The at least one switch in the card receiving portion of the electronic toy may be a series of mechanical switches. The theme card receiving portion of the electronic toy may be a slot in the housing of the electronic toy into which any one of the plurality of theme cards may be inserted.

The card receiving portion of the electronic toy according to the present invention may include a selector for selectively identifying one of the indicia on each of the plurality of theme cards. The electronics unit may generate a specific sensory output as a function of both the identity of the theme card that is received in the card receiving portion and the one of the indicia on the card received in the card receiving portion identified by the selector.

In one embodiment, the electronic toy of the present invention may be an electronic toy kitchen. A method of operating an electronic toy according to the present invention is also disclosed.

BRIEF DESCRIPTION OF THE FIGURES

The details of one or more embodiments are set forth in the accompanying drawings and the description below. Other features will be apparent from the description and drawings and from the claims.

FIG. 31 is a table illustrating exemplary selector switch positions for the different positions of the clock hand (selector) on the clock portion of the electronics assembly of the electronic role play toy kitchen of FIG. 1.

FIG. 32 is a table illustrating exemplary card identifying switch configurations for the card receiving portion according to the present invention for various theme card scenarios for the electronic role play toy kitchen of FIG. 1.

Like reference numerals have been used to identify like elements throughout this disclosure.

DETAILED DESCRIPTION

Figure 1:
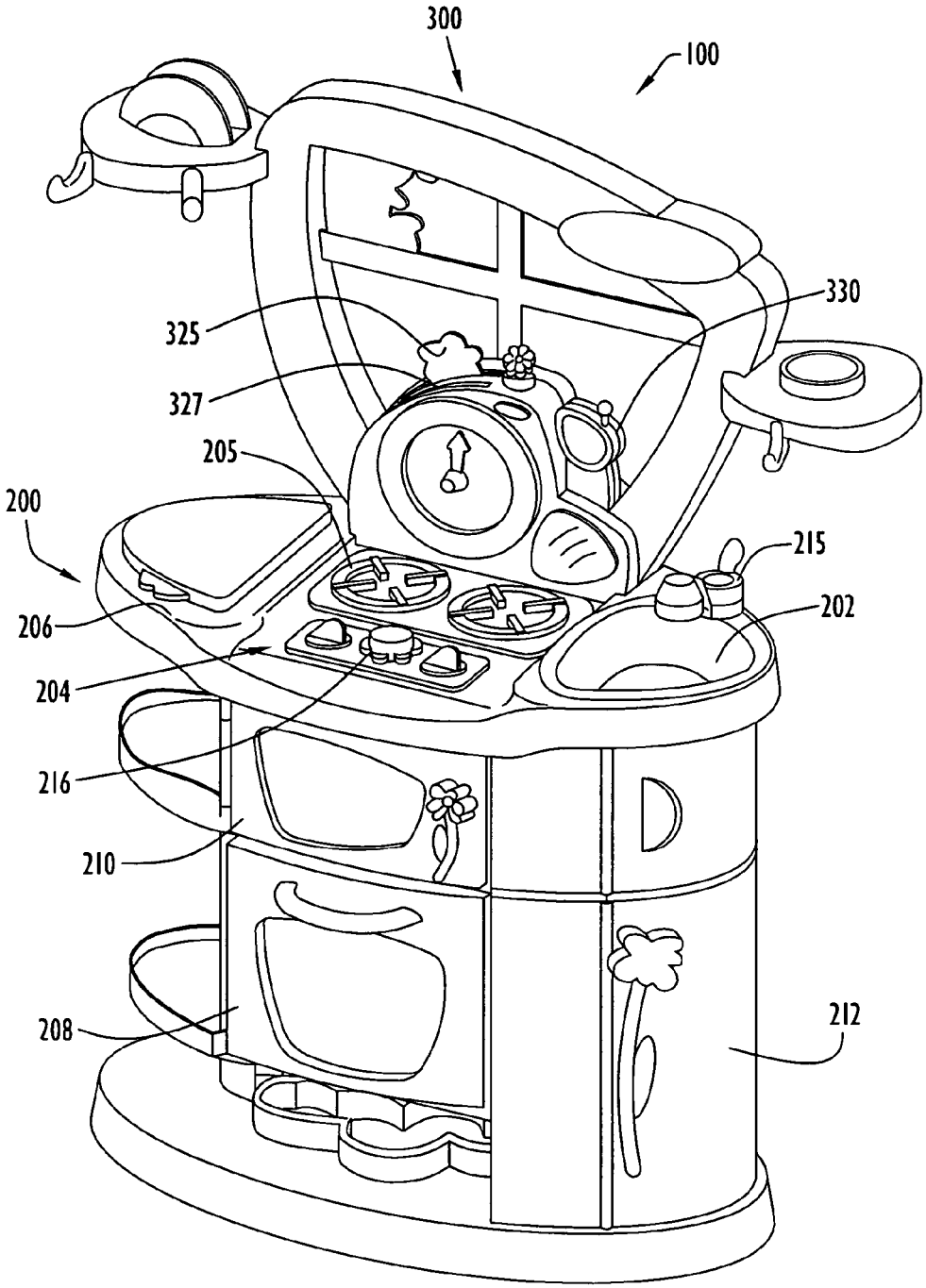
FIG. 1 is a perspective view of an electronic role play toy kitchen in accordance with the present invention.
Figure 2:
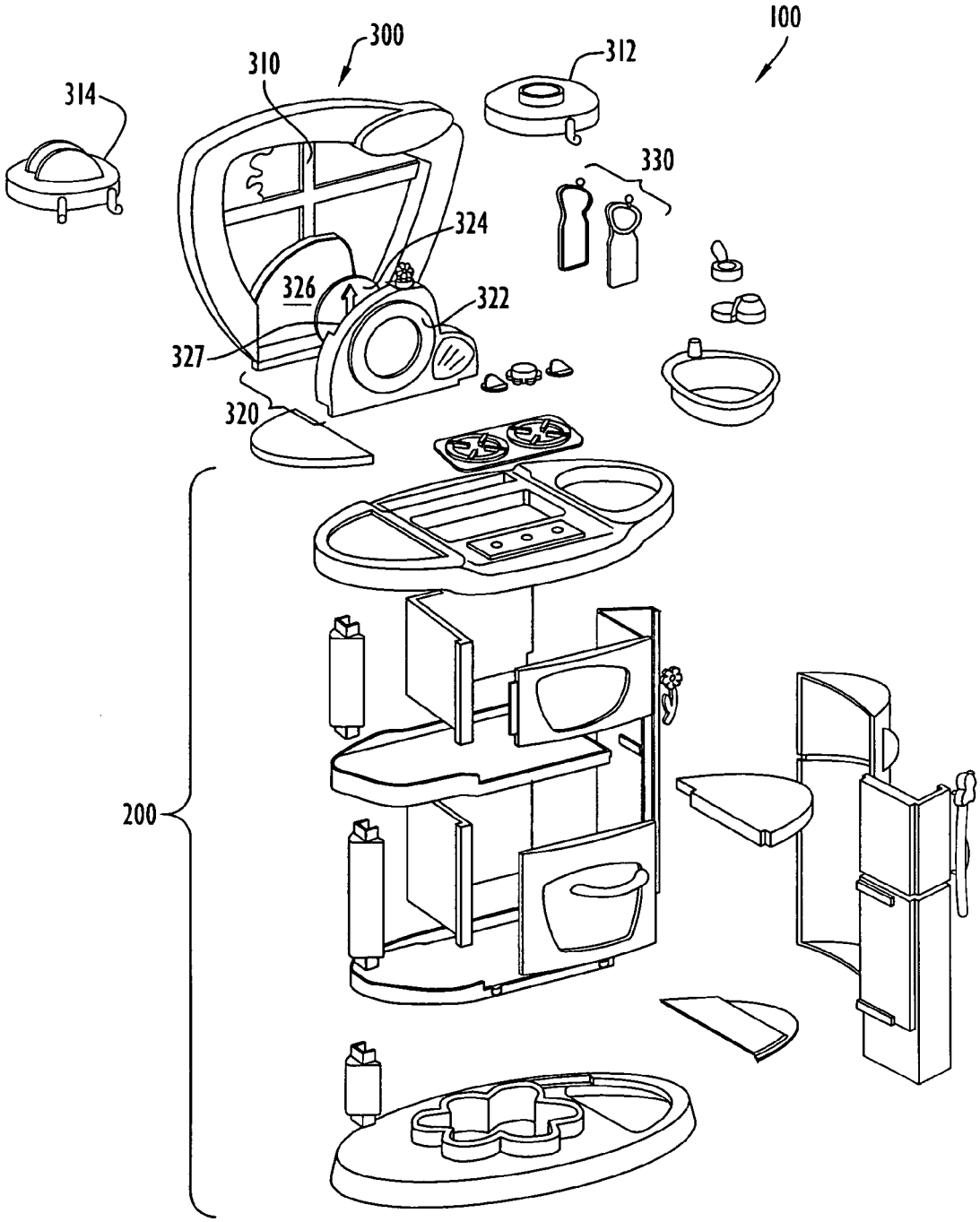
FIG. 2 is an exploded view of the electronic role play toy kitchen of FIG. 1.

Referring to FIGS. 1 and 2, an electronic toy in accordance with the present invention may be configured as an electronic role play toy kitchen 100. The role play toy kitchen 100 may include a base housing 200 and a window portion 300. The base housing 200 can include a plurality of design and display features, such as a sink 202, a cooktop 204 with burners 205, a countertop 206, an oven 208, a microwave oven 210, a refrigerator 212, and other decorative elements. The base housing 200 may include further kitchen details, such as a faucet 215, a plurality of knobs 216, and the like.

The window portion 300 may include a window 310, decorative shelves 312, 314, a telephone 330, and a clock assembly 320. The clock assembly 320 may include a clock front 322, a clock face 324, and a rear housing 326. The clock assembly 320 may also include a card receiving portion 327 into which a theme card 325 can be placed for use as well as a card storage portion 329 (see FIG. 3) into which a theme card 325 can be placed for storage purposes. The clock assembly 320 may also include a receiving portion for housing a hand-held toy telephone 330. As described in detail herein, the clock assembly 320 may also be used to house the electronics associated with electronic role play toy kitchen 100 according to the present invention.

Figure 3:
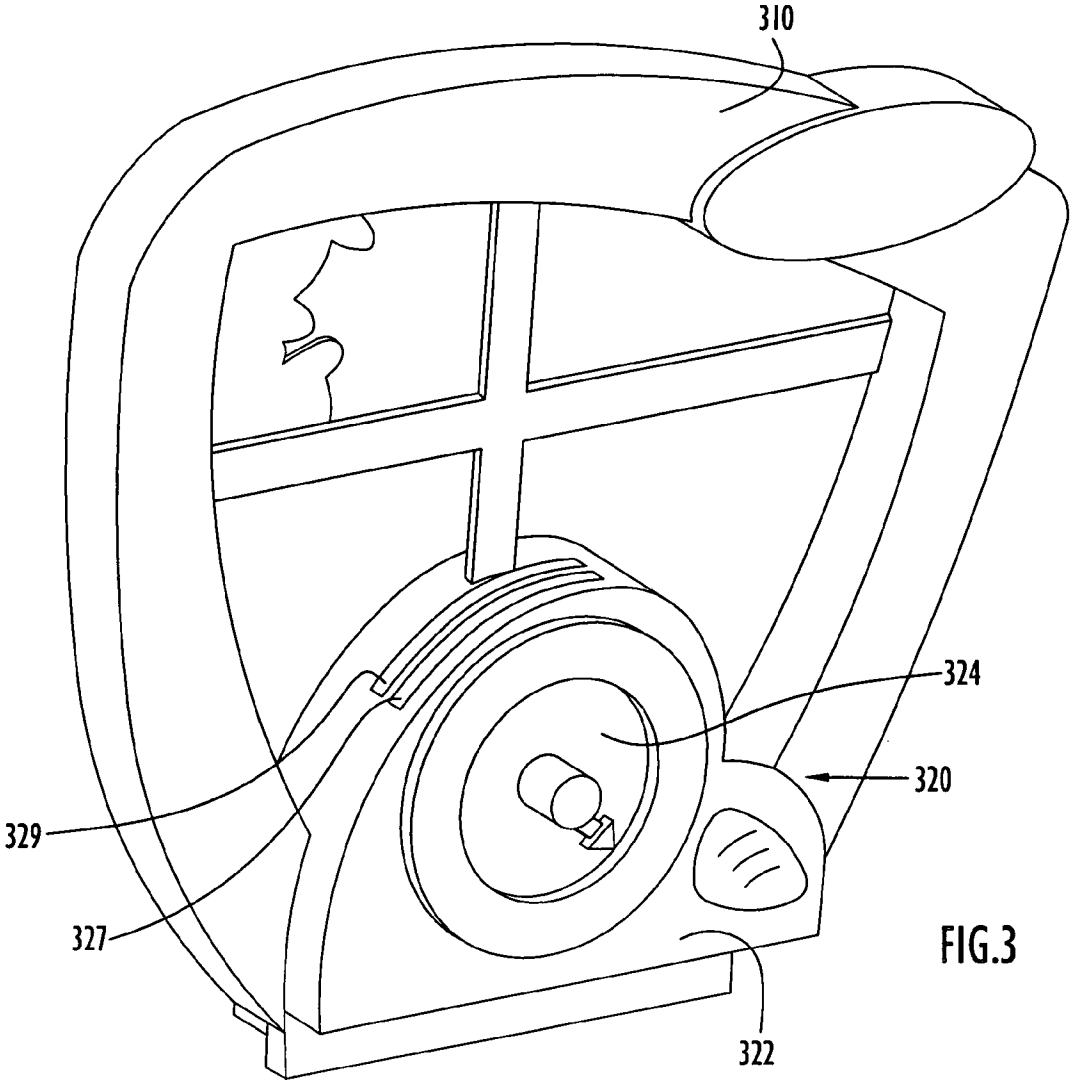
FIG. 3 is a perspective view of the window and clock portions of the electronics assembly of the electronic role play toy kitchen of FIG. 1.
Figure 4:
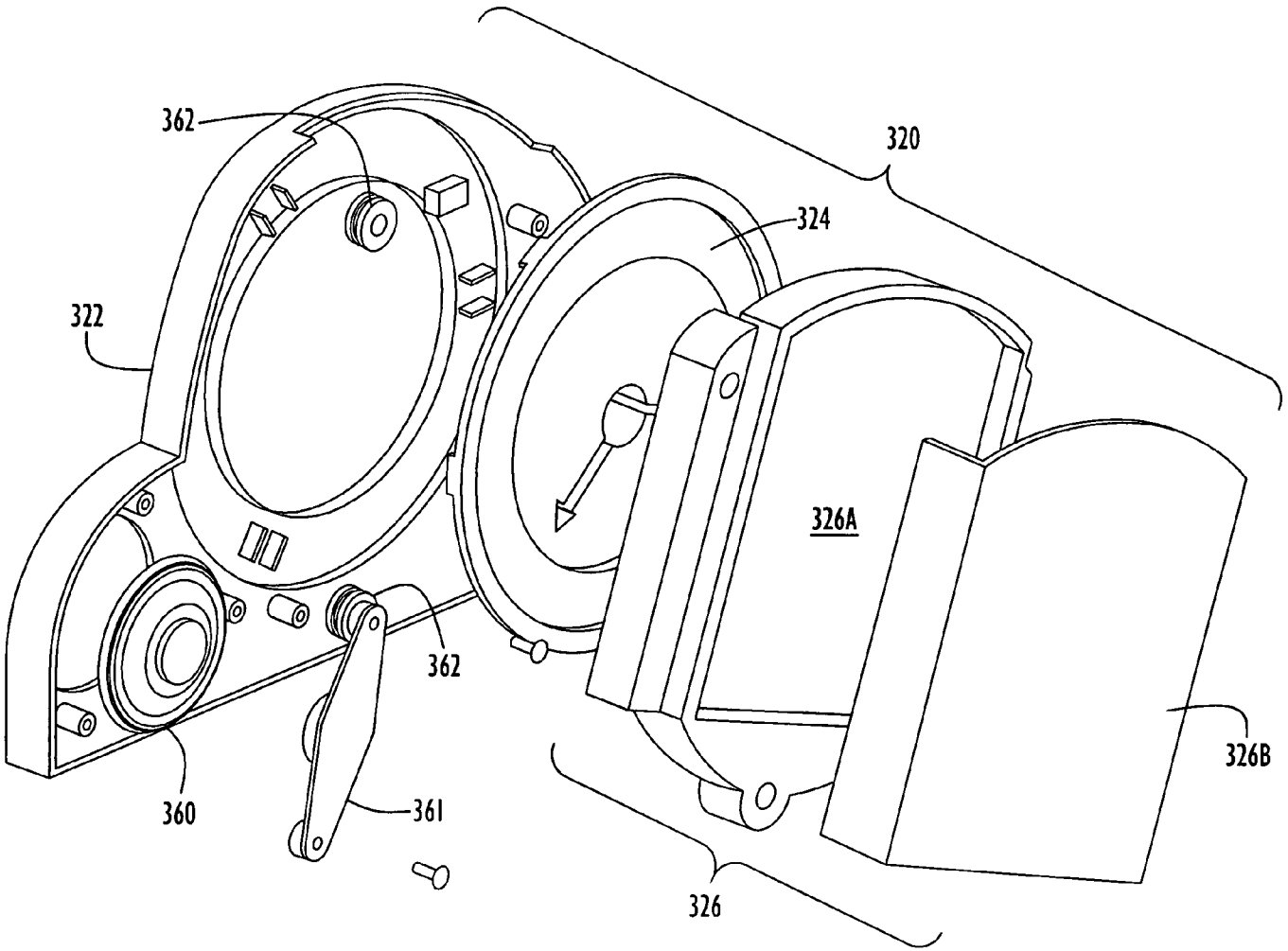
FIG. 4 is an exploded rear perspective view of the clock portion of the electronics assembly of FIG. 3.

The window 310 and the clock assembly 320 of the role play toy kitchen 100 are shown in more detail in FIGS. 3 and 4. The window 310 and the clock assembly 320 may be formed integrally with each other or may be formed of separate assemblies. A theme card 325 may be placed into card receiving portion 327. When a theme card 325 is placed into card receiving portion 327, the face of the theme card 325 is visible through the clock face 324, which is preferably formed from a transparent material. When no theme card 325 is in the card receiving portion 327, transparent clock face 324 allows the material printed on the inner surface of rear housing 326 to be viewed. The clock assembly 320 also includes a card storage portion 329 into which a theme card 325 may be placed when it is not in use. The clock assembly 320 may include the rear housing 326 formed by, for example, two portions 326A, 326B. The card receiving portion 327 is located between clock face 324 and rear housing portion 326A. The card storage portion 329 is located between rear housing portions 326A and 326B. The clock assembly 320 may also include a speaker 360 mounted to the rear of clock front 322. The speaker 360 may be mounted to the rear of clock front 322 using a speaker bracket 361. The clock assembly 320 may also include rollers 362 which both capture the edge of clock face 324 and facilitate its controlled rotational movement.

Figure 5:
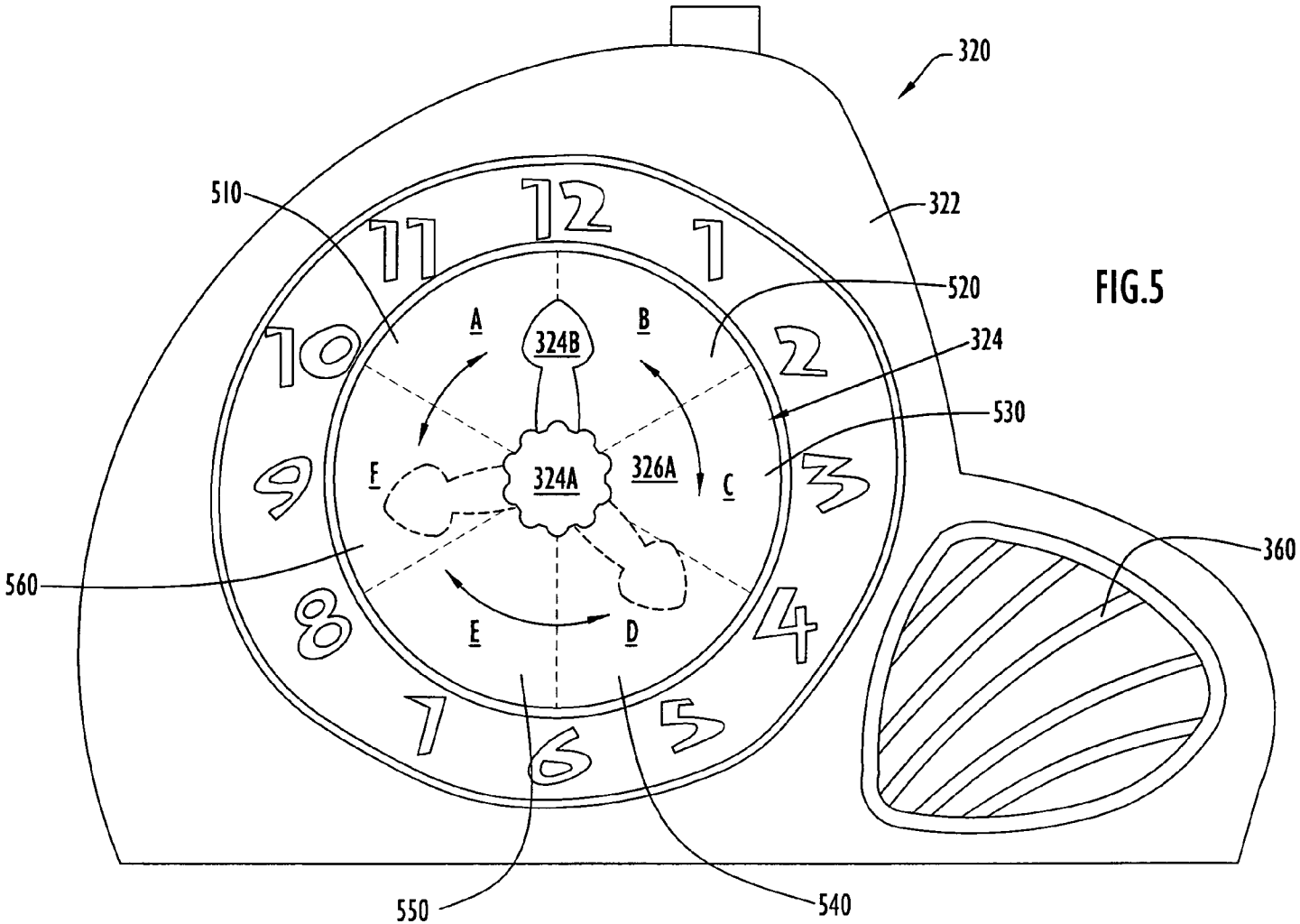
FIG. 5 is a detailed front view of the clock portion of the electronics assembly of the electronic role play toy kitchen of FIG. 1.
Figure 6:
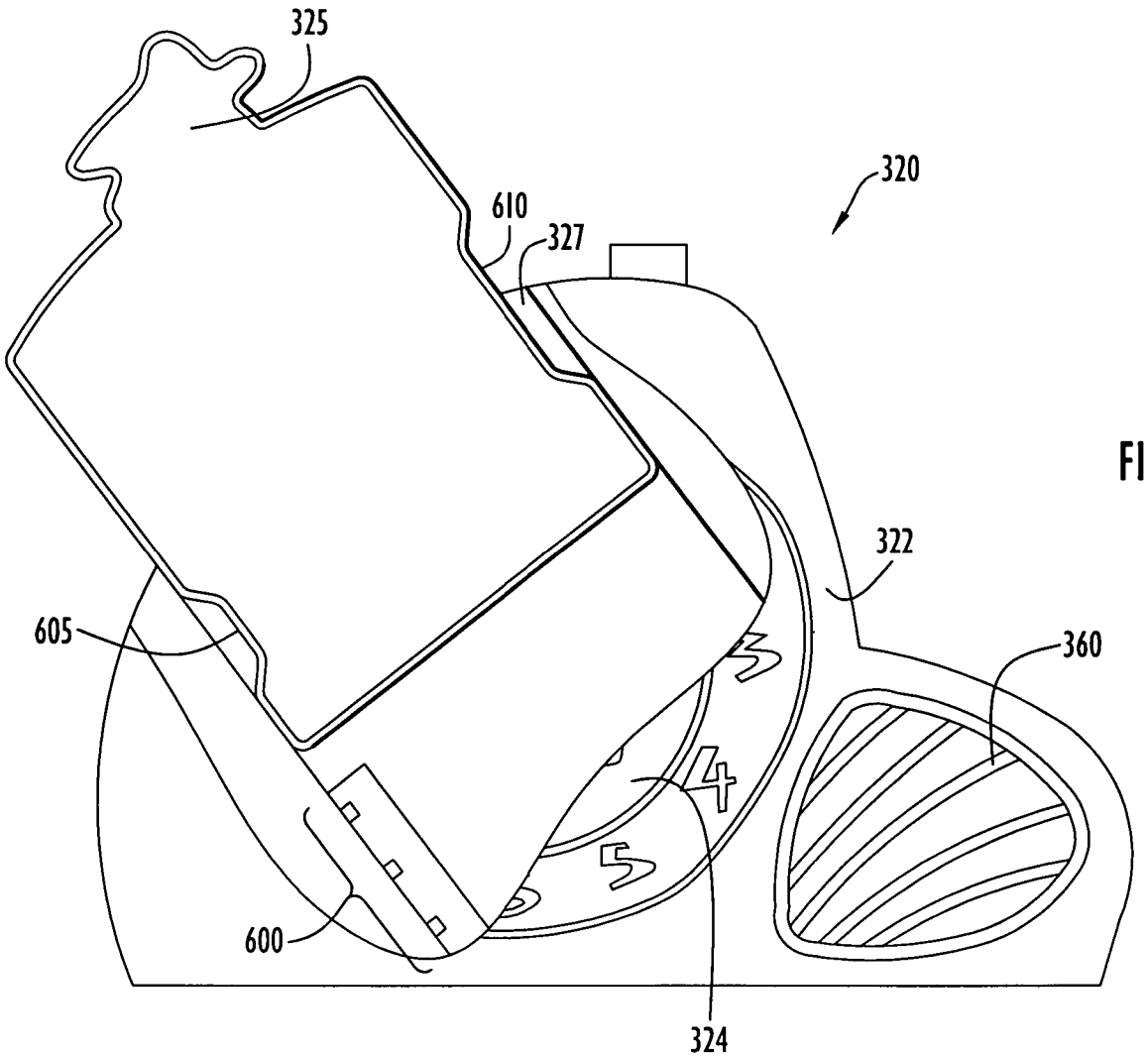
FIG. 6 is a front partial cut-away view of the clock portion of the electronics assembly of the electronic role play toy kitchen of FIG. 1 with a theme card being inserted.

Referring to FIGS. 5 and 6, a front view of the clock assembly 320 shows the clock face 324 attached to the clock front 322. The clock face 324 comprises a selector and includes a knob 324A and clock hand 324B. A child can rotate the clock face and, in turn, the clock hand 324B to illustrate different times of day. Because the clock face 324 is preferably formed from a transparent material, when no theme card 325 is placed in the card receiving portion 327, the transparency of the clock face 324 allows the material printed on the inner surface of the rear housing 326 to be viewed. The inner surface of the rear housing 326 is divided into six equal regions 510, 520, 530, 540, 550, and 560. Region 510 corresponds to the times between 10:01 and 12:00 on clock front 322. Region 520 corresponds to the times between 12:01 and 2:00 on clock front 322. Region 530 corresponds to the times between 2:01 and 4:00 on clock front 322. Region 540 corresponds to the times between 4:01 and 6:00 on clock front 322. Region 550 corresponds to the times between 6:01 and 8:00 on clock front 322. Region 560 corresponds to the times between 8:01 and 10:00 on clock front 322. For purposes of brevity herein, region 510 will be referred to as the 11 o'clock position, region 520 will be referred to as the 1 o'clock position, region 530 will be referred to as the 3 o'clock position, region 540 will be referred to as the 5 o'clock position, region 550 will be referred to as the 7 o'clock position, and region 560 will be referred to as the 9 o'clock position. Regions 510, 520, 530, 540, 550, and 560 each include unique visual indicia A, B, C, D, E, and F. By rotating knob 324A, clock hand 324B can be moved as shown by the dotted path in FIG. 5. As described herein rotation of knob 324A, clock hand 324B to one of the 11 o'clock position, the 1 o'clock position, the 3 o'clock position, the 5 o'clock position, the 7 o'clock position, and the 9 o'clock position can produce sensory output that corresponds to the unique visual indicia A, B, C, D, E, and F in the selected region (510, 520, 530, 540, 550, and 560).

As shown FIG. 6, behind the clock front 322, a theme card 325 can be disposed in a card receiving portion 327. Within the card receiving portion 327, a detector mechanism 600 may be mounted. The detector mechanism 600 can detect the identity of the theme card 325 that is inserted in the card receiving portion 327. The detector mechanism 600 may comprise any detection system capable of card recognition, including, for example, an optical reader that detects holes in or a barcode affixed to the theme card 325. Another example of an appropriate detector mechanism 600 is shown in FIG. 6—a series of mechanical switches that interact with a card identifying portion of theme card 325. For example, there can be three switches disposed in a lower side end of the card receiving portion 327. The theme card 325 can have a combination of none, one, or more notches or card identifying portions 605, 610 along the right and/or left sides of the theme card 325, as will be explained in more detail below. Note that if a two-sided card is desired for simplicity's sake, it is preferable to include card identifying portions 605, 610 along the right and left sides of the theme card 325.

Figure 7:
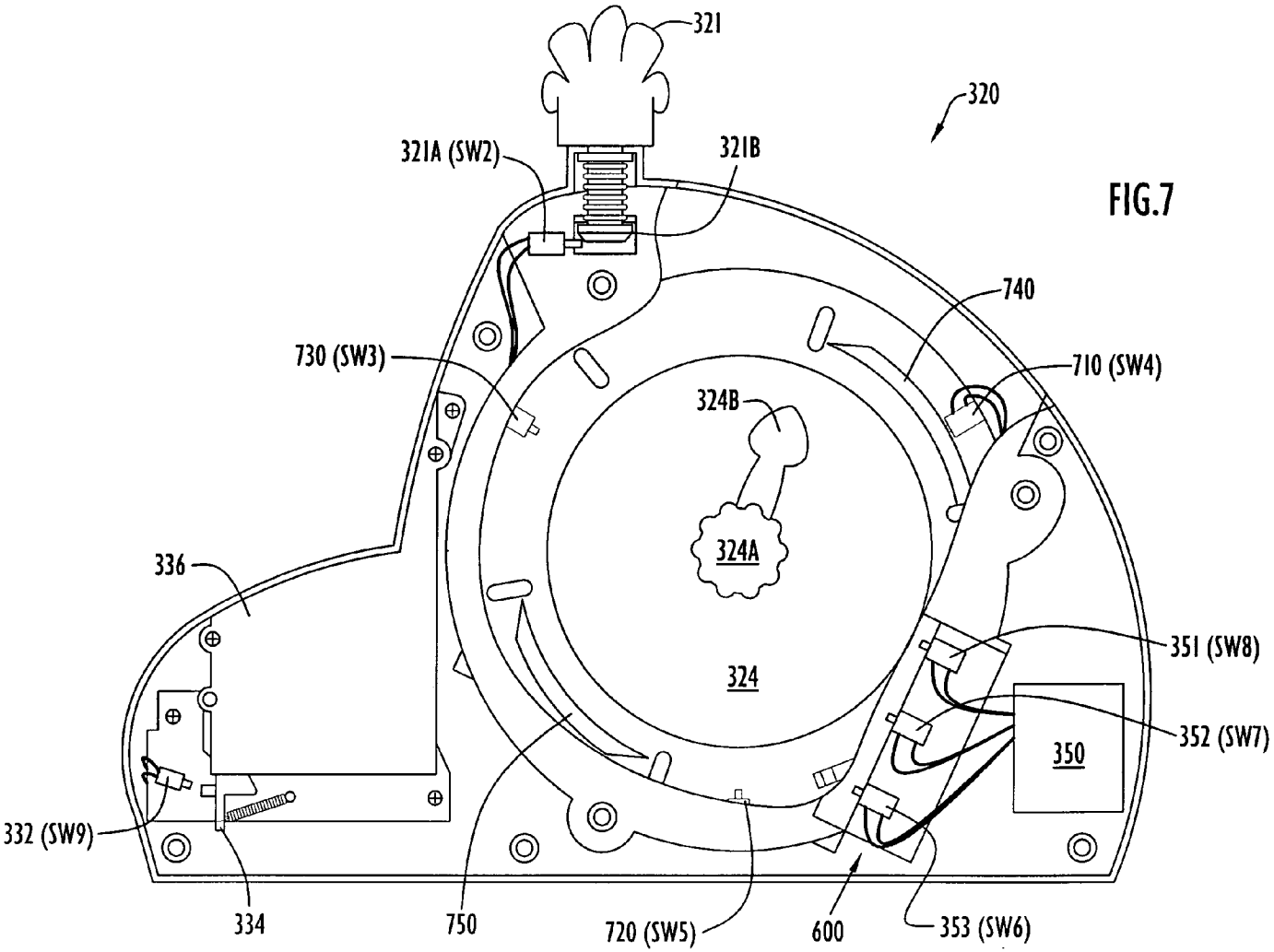
FIG. 7 is a rear partial cut-away view of the internal components of the clock portion of the electronics assembly of the electronic role play toy kitchen of FIG. 1.
Figure 8:
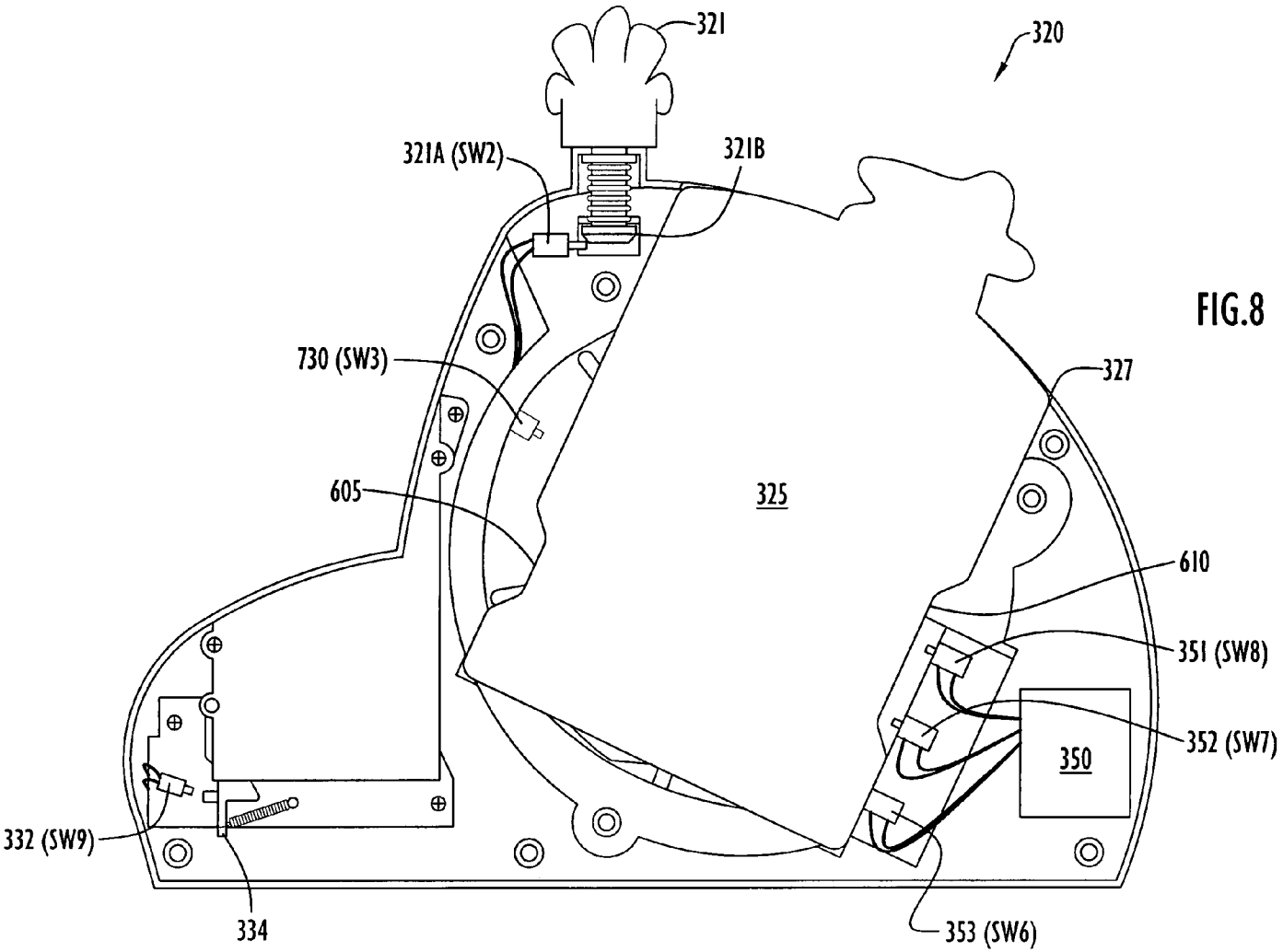
FIG. 8 is a rear partial cut-away view of the internal components of the clock portion of the electronics assembly of FIG. 7 with a theme card inserted.

Referring to FIGS. 7 and 8, an electronic role play toy kitchen in accordance with the present invention may include a switch 332 (SW9) and an actuator mechanism 334 associated with the toy telephone 330 and its holder 336. When the toy telephone 330 is placed into its holder 336, actuator mechanism 334 is moved to come into contact with switch 332 to produce an audible output (via the speaker 360) associated with the phone, such as the phone ringing or Barbie speaking. The actuator mechanism 334 can include, for example, a spring and a hinged plastic trigger or any other appropriate actuator.

In accordance with the present invention, the clock assembly 320 may include a main actuation switch. As shown in FIG. 7, main actuation switch 321 (SW2) is stylized as the petals of a flower. The main actuation switch 321 includes a mechanical (push-type) switch 321A and a switch actuation mechanism 321B. When the main actuation switch 321 is depressed, the actuation mechanism 321B comes into contact with and triggers the switch 321A and an audible output is emitted by the speaker 360.

As shown in FIG. 7, the detector mechanism 600 includes three mechanical (push-type) switches 351 (SW8), 352 (SW7), 353 (SW6), which remain open or are forced closed dependent upon the shape/size of the card identifying portions 605, 610 along the right and/or left sides of the theme card 325.

As can be seen, the clock face 324 has at least two arcuate raised bosses 740, 750 formed on its rear face. Additionally, there are three mechanical (push-type) switches 710 (SW4), 720 (SW5), and 730 (SW3) spaced about the circular opening of the clock front 322. As the clock face is rotated, i.e., the clock hand 324B is moved, the switches 710, 720, and 730 are selectively actuated to identify where the clock hand 324B is pointing and a sensory output, that is appropriate to that clock hand position, is emitted from the speaker 360.

Switches 321A, 730, 710, 720, 353, 352, 351, and 332 are connected to an electronic component 350 (a microcontroller or integrated circuit), which processes the input from the various switches and causes the various outputs to be provided. Examples of an electronic component 350 and switch processing sequences in accordance with an embodiment of the present invention are described in more detail below.

A theme card 325 can be inserted in a card receiving portion 327, as shown in FIG. 8. As mentioned above, the theme card 325 may trigger at least one switch 351, 352, 353 located in the lower side portion of the card receiving portion 327. In the example shown in FIG. 8, switch 353 is triggered by the card identifying portion 610 of theme card 325. Thus, electronic component 350 receives notification of the closed switch and processes the switch closure to identify which theme card 325 has been inserted in the card receiving portion 327, and more specifically, which side of theme card 325 is facing the transparent clock face 324.

Figure 9A:
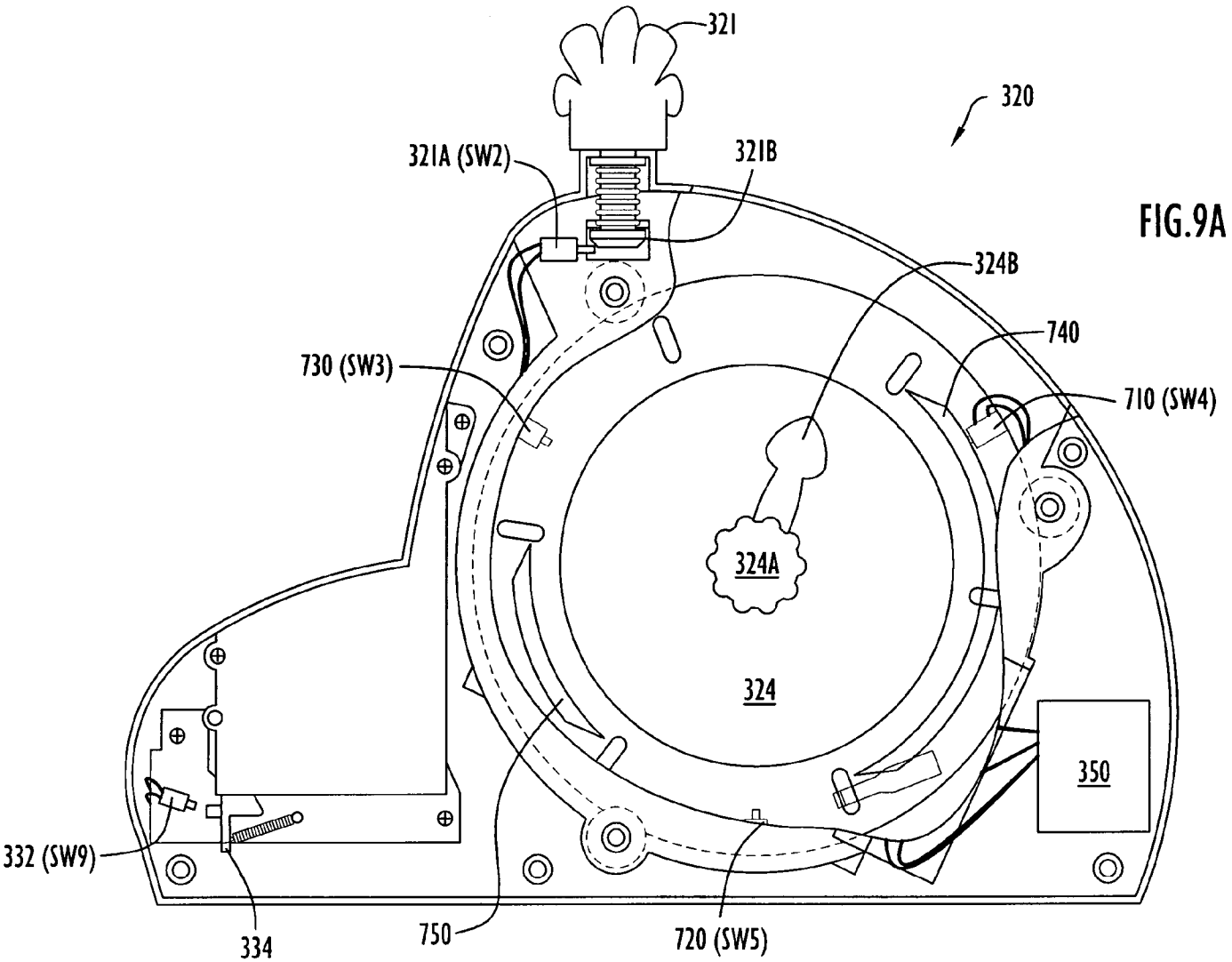
FIG. 9A is a rear partial cut-away view of the internal components of the selector portion of the electronics assembly of the electronic role play toy kitchen of FIG. 7 with the clock hand (selector) directed at the 11 o'clock position.
Figure 9B:
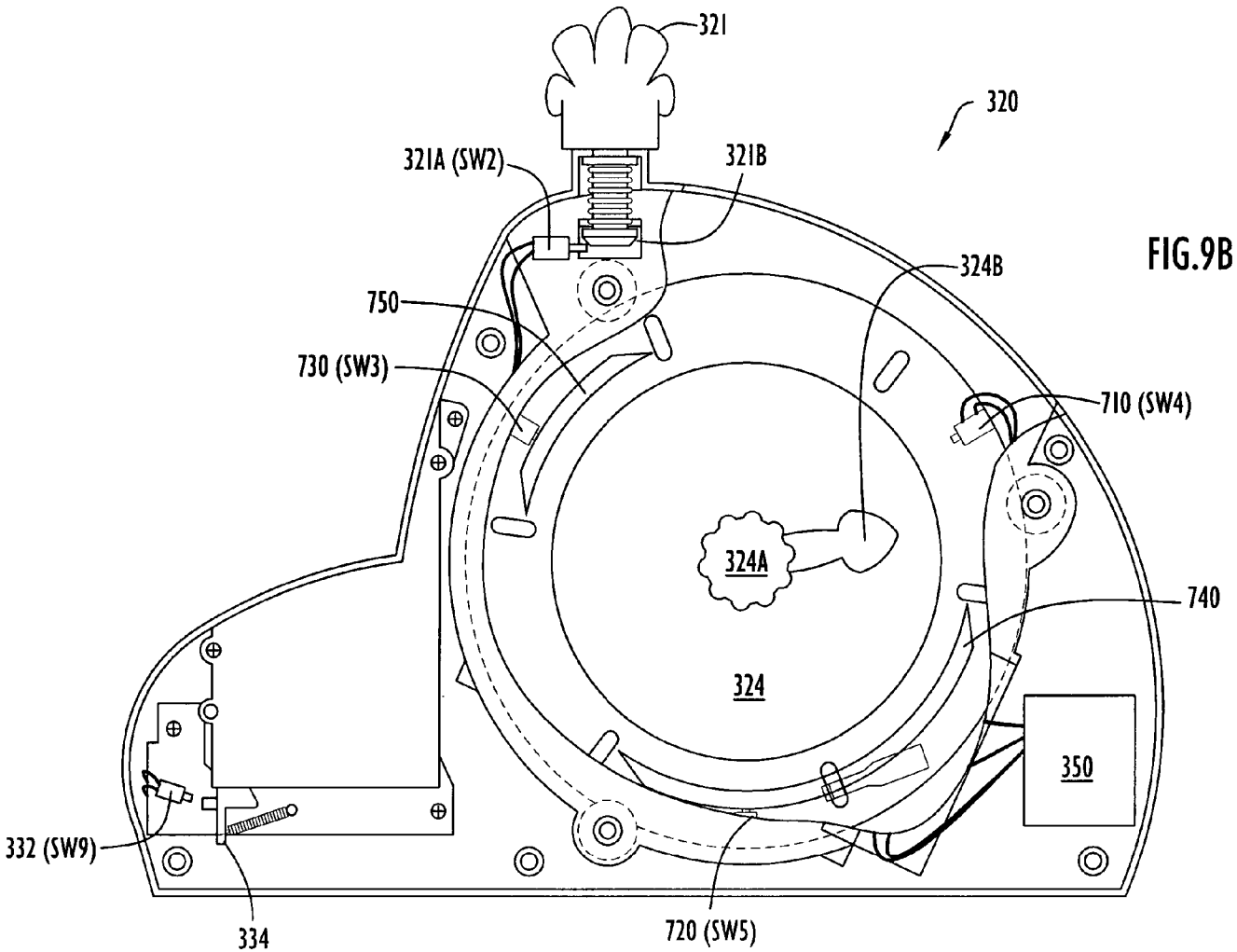
FIG. 9B is a rear partial cut-away view of the internal components of the selector portion of the electronics assembly of the electronic role play toy kitchen of FIG. 7 with the clock hand (selector) directed at the 9 o'clock position.

FIGS. 9A and 9B are rear partial cut-away views of the internal components of the clock assembly 320 of the role play toy kitchen 100 in accordance with the present invention. FIG. 9A (a rear view) shows the clock hand 324B rotated into the 11 o'clock position. In this position, only switch 710 (SW4) is actuated by the arcuate raised bosses 740, 750 on the rear of the clock face 324. Switches 720 (SW5) and 730 (SW3) are not closed in the 11 o'clock position. As shown in FIG. 9B, the clock hand 324B may rotated counterclockwise (with the respect to the front of clock assembly 320) to a position proximate 9 o'clock. In the 9 o'clock position, switches 720 (SW5) and 730 (SW3) are actuated by the arcuate raised bosses 740, 750 on the rear of the clock face 324. Switch 710 (SW4) is not closed in the 9 o'clock position. The electronic component 350 receives notification of the position of switches 710 (SW4), 720 (SW5), and 730 (SW3) and processes the switch positions to identify the position of the clock hand 324B relative to the indicia printed on the theme card 325 (if a theme card is inserted into the card receiving portion 327) or the inner surface of the rear housing 326.

Figure 10:
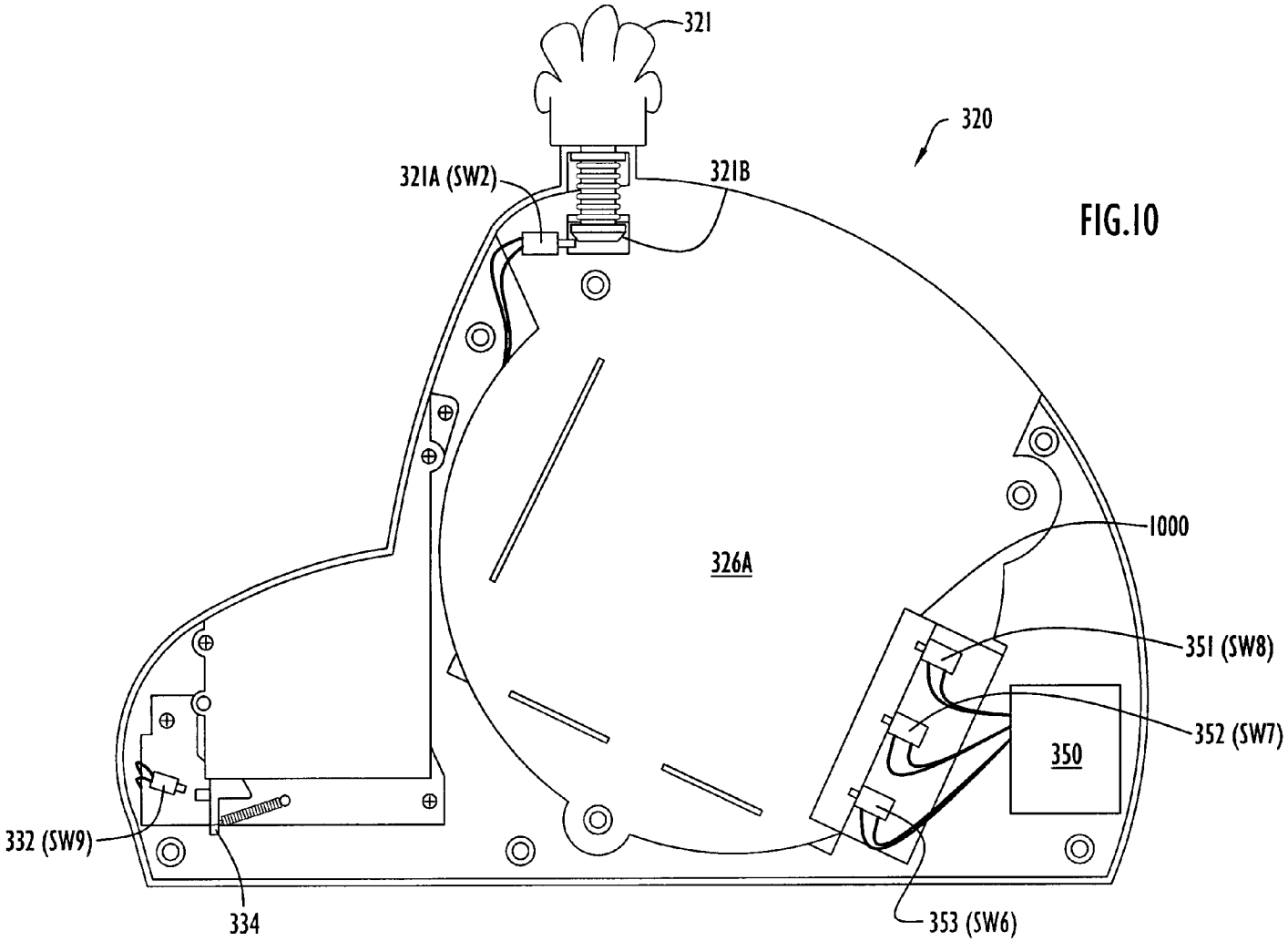
FIG. 10 is a rear cut-away view of the internal components of the clock portion of the electronics assembly of the electronic role play toy kitchen of FIG. 7 with the selector portion removed for clarity.
Figure 11:
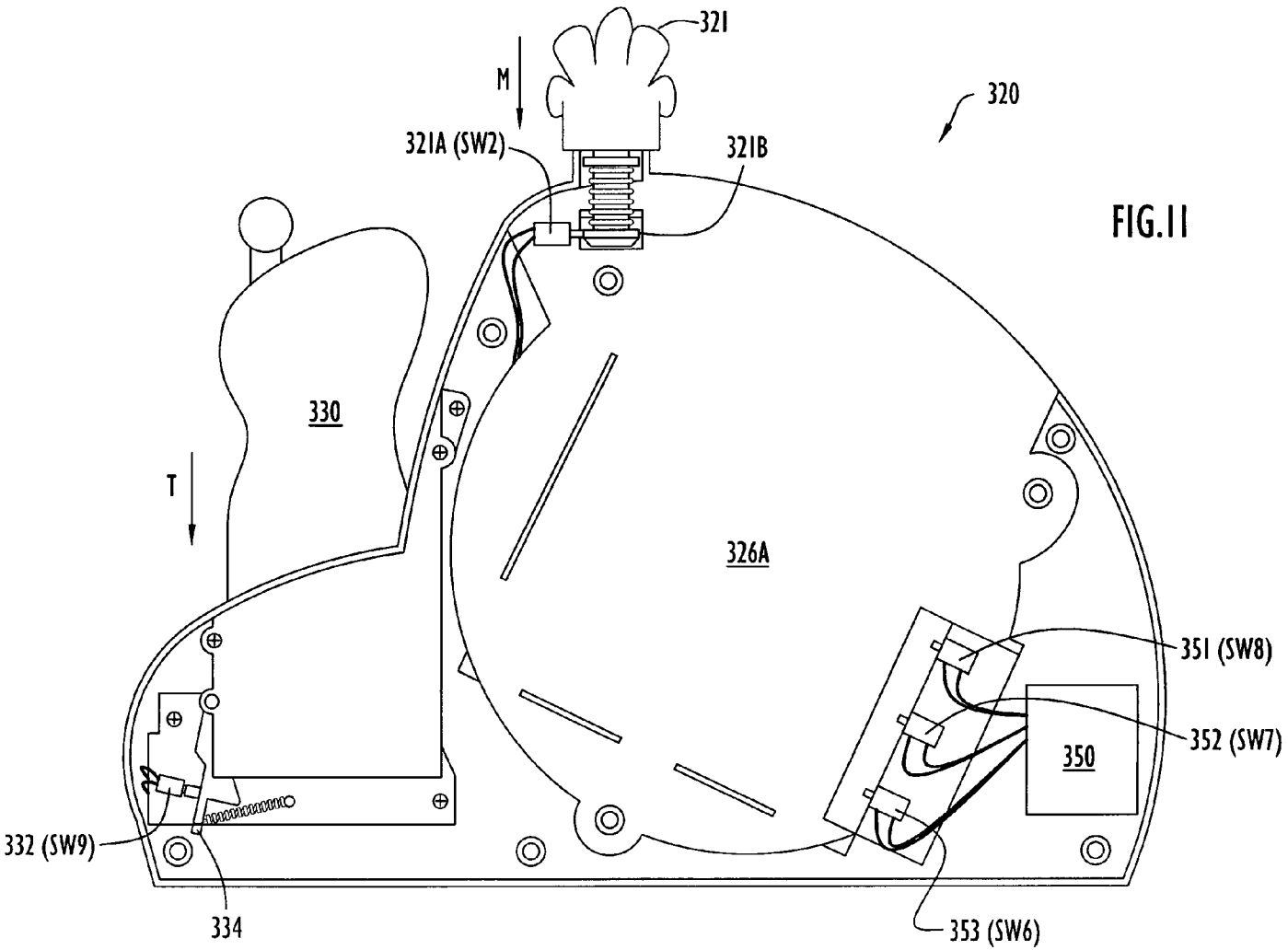
FIG. 11 is a rear cut-away view of the clock portion of the electronics assembly of the electronic role play toy kitchen of FIG. 7 with the toy telephone inserted into its holder.

Referring to FIGS. 10 and 11, the rear of the clock assembly 320 is shown with the outer rear housing portion 326B removed. The switches 351 (SW8), 352 (SW7), and 353 (SW6) can be seen through an opening 1000 in the inner rear housing portion 326A. As shown in FIG. 11, when the toy telephone 330 is placed in its holder 336 (i.e., in the direction of the arrow T), the actuator mechanism 334 (i.e., the spring and the hinged trigger, cause the switch 332 (SW9) to be activated. The electronic component 350 receives notification of the closed switch and processes the switch closure to identify the presence of the toy phone 330. Likewise, when the main actuation switch 321 (SW2) is depressed in the direction of the arrow M, spring-loaded actuator 321B causes the switch 321A (SW2) to be activated. The electronic component 350 receives notification of the closed switch 321A and processes the switch closure to identify the movement of the main actuation switch by the user of the toy 100.

A theme card 325 can be generally rectangular shaped with an extended portion 1205 (see FIG. 12), which can be grasped for manual manipulation, i.e., placing or removing the theme card 325 from a card receiving portion 327, or the turning of the theme card 325 around and reinserting it into the card receiving portion 327. The theme card 325 has two sides, i.e., two separate orientations of the card 325 to be received in the card receiving portion 327 of the role play toy kitchen 100 of the present invention. Each side of the theme card 325 may include a decorative sticker 1200 placed thereon. The decorative sticker 1200 may be in accordance with a theme, i.e., a tea party, a birthday party, a sleepover, and a picnic.

Figure 12:
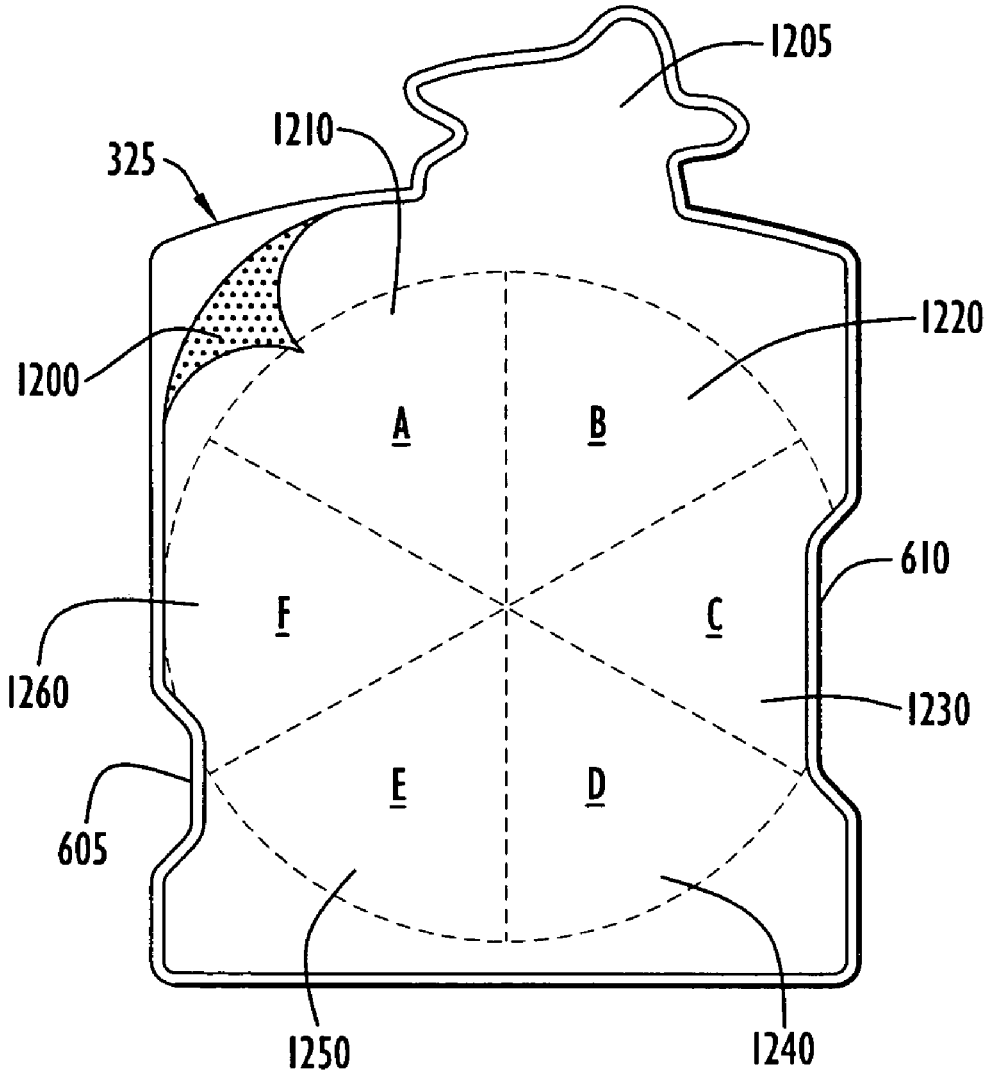
FIG. 12 is a front view of an exemplary theme card in accordance with the present invention.

As shown in FIG. 12, the decorative sticker 1200 is divided into six equal regions 1210, 1220, 1230, 1240, 1250, and 1260. For reference, note that theme card 325 is received into the card receiving portion 327 at an angle (rather than straight up and down). Thus, region 1210 corresponds to the times between 10:01 and 12:00 on clock front 322. Region 1220 corresponds to the times between 12:01 and 2:00 on clock front 322. Region 1230 corresponds to the times between 2:01 and 4:00 on clock front 322. Region 1240 corresponds to the times between 4:01 and 6:00 on clock front 322. Region 1250 corresponds to the times between 6:01 and 8:00 on clock front 322. Region 1260 corresponds to the times between 8:01 and 10:00 on clock front 322. For purposes of brevity herein, region 1210 will be referred to as the 11 o'clock position, region 1220 will be referred to as the 1 o'clock position, region 1230 will be referred to as the 3 o'clock position, region 1240 will be referred to as the 5 o'clock position, region 1250 will be referred to as the 7 o'clock position, and region 1260 will be referred to as the 9 o'clock position. Regions 1210, 1220, 1230, 1240, 1250, and 1260 each includes unique visual indicia A, B, C, D, E, and F.

Figure 13:
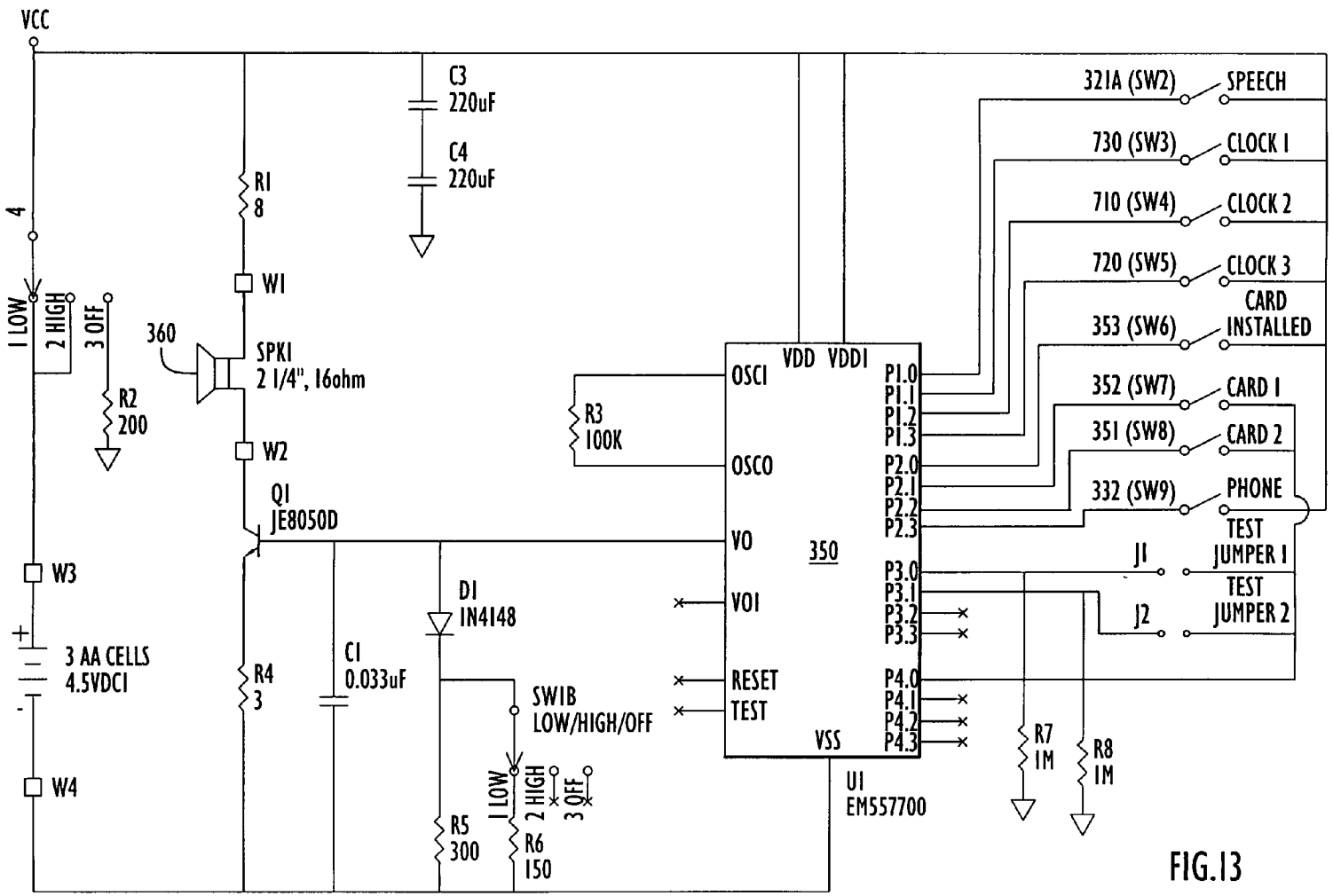
FIG. 13 is a schematic diagram of the electronics assembly of the electronic role play toy kitchen of FIG. 1.

Referring to FIG. 13, a schematic diagram of an example the electronics associated with an electronic role play toy kitchen in accordance with the present invention includes a plurality of components which correspond to the various features of the toy kitchen. For example, there are 9 switches in the electronics of the role play toy kitchen; each switch being associated with a particular feature.

For instance, a first switch SW1B (not illustrated in the other figures) may be used to turn the electronics unit on (low or high volume) and off. Switch 321A (SW2) may be used to activate an audio output, i.e., speech, music, and/or sound effects. Three switches 730 (SW3), 710 (SW4), and 720 (SW5) may be utilized indicate the position of the clock hand 324B, i.e., what time is shown on the clock face and/or which segment of the clock face has been selected. For example, for one o'clock, switch 730 (SW3) is open (0), and switches 710 (SW4) and 720 (SW5) are closed (1). For three o'clock, switch 730 (SW3) is closed (1), and switches 710 (SW4) and 720 (SW5) are open (0). For five o'clock, switches 730 (SW3) and 710 (SW4) are closed (1), and switch 720 (SW5) is open (0). For seven o'clock, switches 730 (SW3) and 710 (SW4) is open (0), and switch 720 (SW5) is closed (1). For nine o'clock, switches 730 (SW3) and 720 (SW5) are closed (1), and 710 (SW4) is open (0). Finally, for eleven o'clock, switches 730 (SW3) and 720 (SW5) are open (0), and switch 710 (SW4) is closed (1). (See FIG. 31 for a switch table relating to the position of the clock hand 324B).

A sixth switch 353 (SW6) can indicate whether a theme card 325 is disposed in the card receiving portion 327. The group of three switches 353 (SW6), 352 (SW7), and 351 (SW8) together indicate which theme card 325, if any, is located in the card receiving portion 327. For example, if there is no theme card 325 in the card receiving portion 327, the three switches 353 (SW6), 352 (SW7), and 351 (SW8) are open (0). Whereas, if there is a theme card 325 in the card receiving portion 327 and the theme card is the "birthday" card, then 353 (SW6) is closed (1), and switches 352 (SW7) and 351 (SW8) are open (0). If the theme card 325 inserted into the card receiving portion 327 is the "picnic" card, then switches 353 (SW6) and 352 (SW7) are closed (1), and switch 351 (SW8) is open (0). If the theme card 325 inserted into the card receiving portion 327 is the "tea party" card, then switches 353 (SW6) and 351 (SW8) are closed (1), and switch 352 (SW7) is open (0). Finally, if the theme card 325 inserted into the card receiving portion 327 is the "sleepover" card, then switches 353 (SW6), 352 (SW7), and 351 (SW8) are all closed (1). Thus, based on the combination of switches 353 (SW6), 352 (SW7), and 351 (SW8), it can be determined which theme card 325 is disposed in the card receiving portion 327. (See FIG. 32 for a switch table relating to the identity of the theme card 325 inserted into the card receiving portion 327).

A ninth switch SW9 may be associated with the toy telephone 330, i.e., to identify if the toy telephone 330 in its holder 336. The electronic toy in accordance with the present invention may utilize AC power or batteries to provide the power to execute its various functions. In the example illustrated in FIG. 13, three 1.5V AA batteries are used.

Thus, by utilizing numerous switches to detect (1) the actuation of the device (switch 321A (SW2)), (2) the position of the selector/clock hand 324B (switches 730 (SW3), 710 (SW4), and 720 (SW5)), and (3) the identity of the theme card 325 inserted into the card receiving portion 327 (switches 353 (SW6), 352 (SW7), and 351 (SW8)), and an electronic controller 350, an electronic toy 100 in accordance with the present invention produces, card specific, and more specifically, card and card indicia specific sensory output. For example, if the selector/clock hand 324B is position in the 1 o'clock position and theme card A' is inserted into the receiving portion 327, the output from electronic controller 350 corresponds not only to theme card A', but more specifically, the indicia on theme card A' located at the 1 o'clock position.

FIGS. 14-30B illustrate exemplary play sequences that may be executed by the electronic toy in accordance with the present invention.

Figure 14:
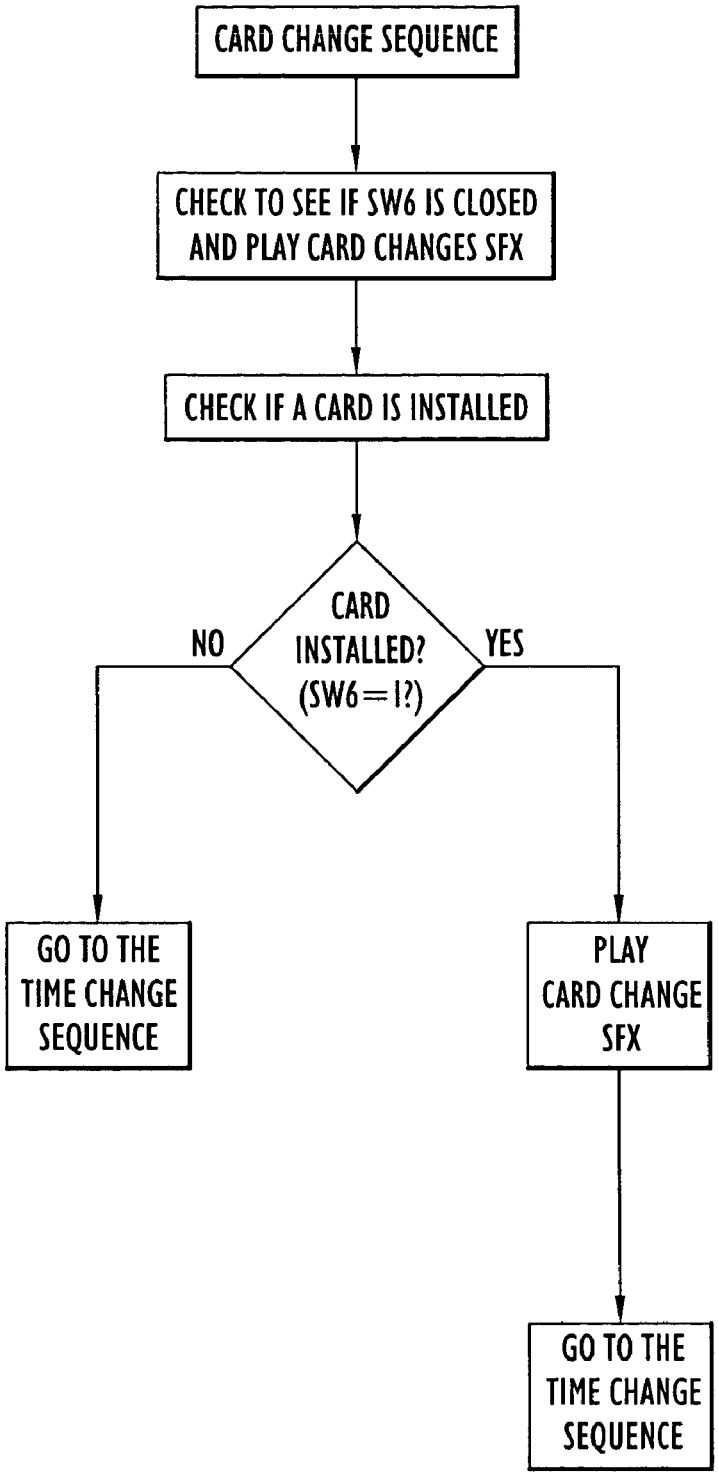
FIG. 14 is a flowchart depicting a theme card change play sequence in the electronic role play toy kitchen of FIG. 1.

Play Sequence—The Theme Card 325 Chanze (FIG. 14)

An example of a theme card 325 change sequence, i.e., the insertion of a new theme card 325 into the card receiving portion 327 of the electronic role play toy kitchen 100 of the present invention is illustrated in FIG. 14. By utilizing switch 353 (SW6), the electronic component 350 checks to see if switch 353 (SW6) is closed (1), and thus determines if a theme card 325 is installed in the card receiving portion 327. If a theme card 325 is installed in the card receiving portion 327, then a card change sound effect (sfx) is reproduced via speaker 360. The electronic component 350 then moves on to the time change play sequence (determining the position of the clock hand 324B) illustrated in FIG. 15.

Figure 15:
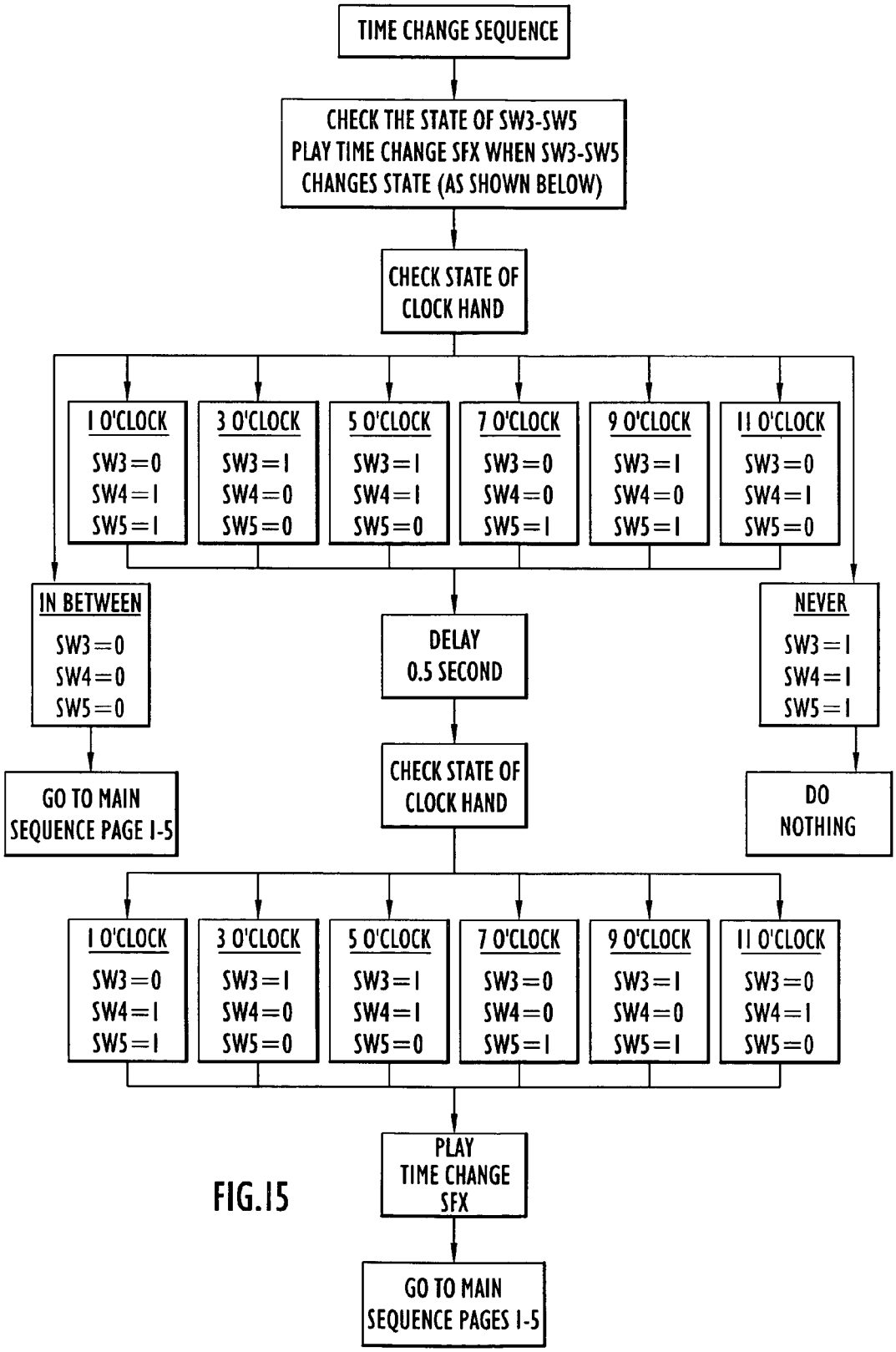
FIG. 15 is a flowchart depicting a time (selector) change play sequence in the electronic role play toy kitchen of FIG. 1.

Play Sequence—The Time Change (FIG. 15)

An example of a time change sequence, i.e., the detection of the position of clock hand 324B of the electronic role play toy kitchen 100 of the present invention is illustrated in FIG. 15. First, the electronic component 350 checks the states of switches 730 (SW3), 710 (SW4), and 720 (SW5). Then, the electronic component 350 compares the states of switches 730 (SW3), 710 (SW4), and 720 (SW5) with the clock switch look-up table (FIG. 31) to determine in what position the clock hand 324B is located (1 o'clock, 3 o'clock, 5 o'clock, 7 o'clock, 9 o'clock, 11 o'clock, or somewhere in between these times). Hereinafter, the clock times of 1 o'clock, 3 o'clock, 5 o'clock, 7 o'clock, 9 o'clock, and 11 o'clock are simply identified as 1, 3, 5, 7, 9, and 11. After a short time delay (≈0.5 seconds), the electronic component 350 repeats the processes of checking the states of switches 730 (SW3), 710 (SW4), and 720 (SW5), and comparing the states of switches 730 (SW3), 710 (SW4), and 720 (SW5) with the clock switch look-up table (FIG. 31) to verify in what position the clock hand 324B is located. If the position of clock hand 324B has been changed, a time change sound effect (sfx) is reproduced via speaker 360. The electronic component 350 then moves on to the main sequence pages 1-5 illustrated in FIGS. 16-20.

Figure 16:
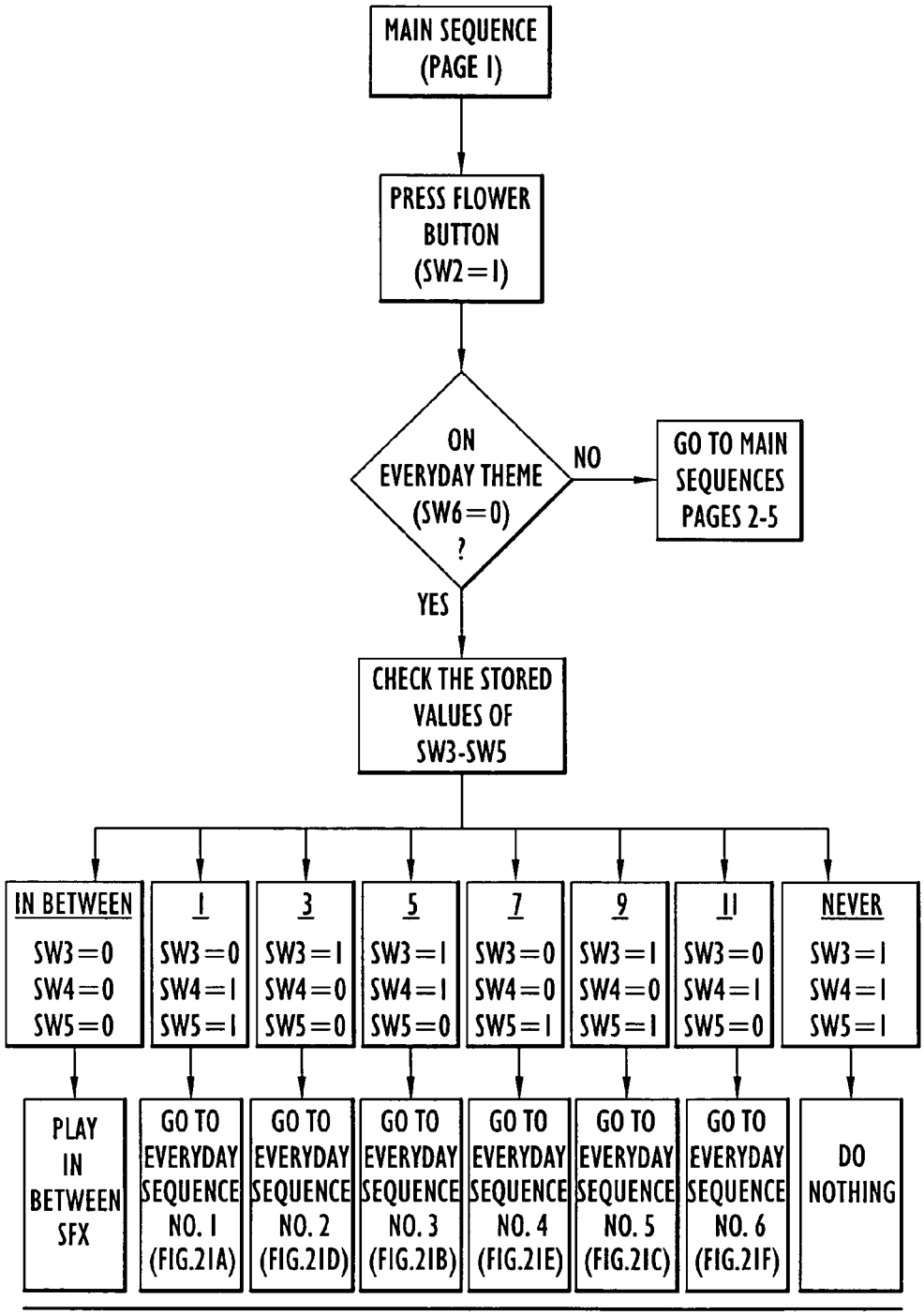
FIG. 16 is a flowchart depicting a play sequence relating to the everyday theme, where no theme card is present, in the electronic role play toy kitchen of FIG. 1.

Play Sequence—Main Play Sequence Page 1 (FIG. 16—No Theme Card Installed)

Main switch 321A (SW2) is actuated to allow electronic component 350 to check the state of switch 353 (SW6). If the switch 353 (SW6) is closed (1), then the electronic component 350 moves on to main sequence pages 2-5 illustrated in FIGS. 17-20. If switch 353 (SW6) is open (0), then no theme card 325 is received in card receiving portion 327. If no theme card 325 is installed, the electronic component 350 checks for the stored of value of the switches 730 (SW3), 710 (SW4), and 720 (SW5). Next, the electronic component 350 compares the states of switches 730 (SW3), 710 (SW4), and 720 (SW5) with the clock switch look-up table (FIG. 31) to determine in what position the clock hand 324B is located (1, 3, 5, 7, 9, or 11, or somewhere in between these times). Once the position of the clock hand 324B is identified, the electronic component 350 moves on to the appropriate "everyday" (no theme card present) sequence as shown in FIGS. 21A-21F and as discussed below.

Play Sequences—Everyday Play Sequences 1-6 (No Theme Card Installed)

Figure 21A:
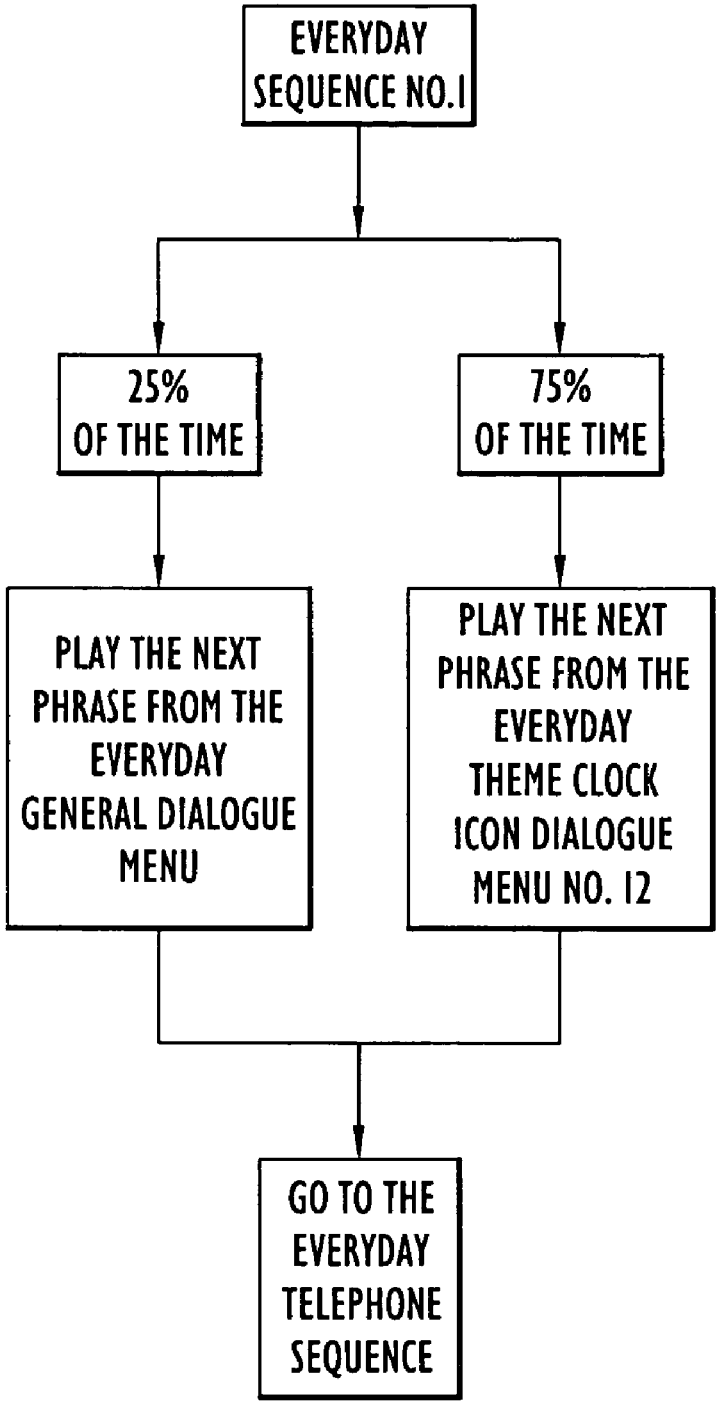
FIG. 21A is a flowchart depicting an everyday play sequence, where no theme card is present, with the clock hand (selector) directed at the 1 o'clock position in the electronic role play toy kitchen of FIG. 1.
Figure 21B:
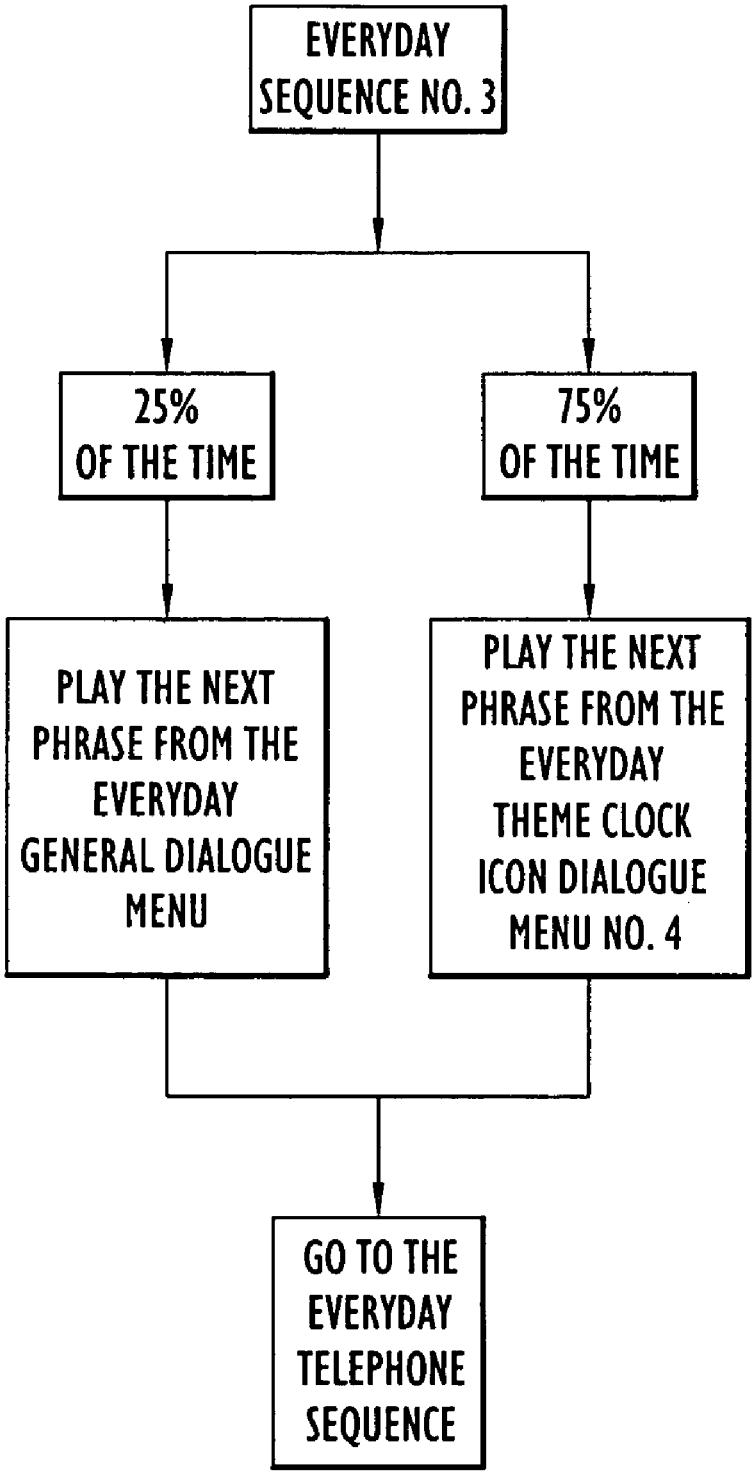
FIG. 21B is a flowchart depicting an everyday play sequence, where no theme card is present, with the clock hand (selector) directed at the 5 o'clock position in the electronic role play toy kitchen of FIG. 1.
Figure 21C:
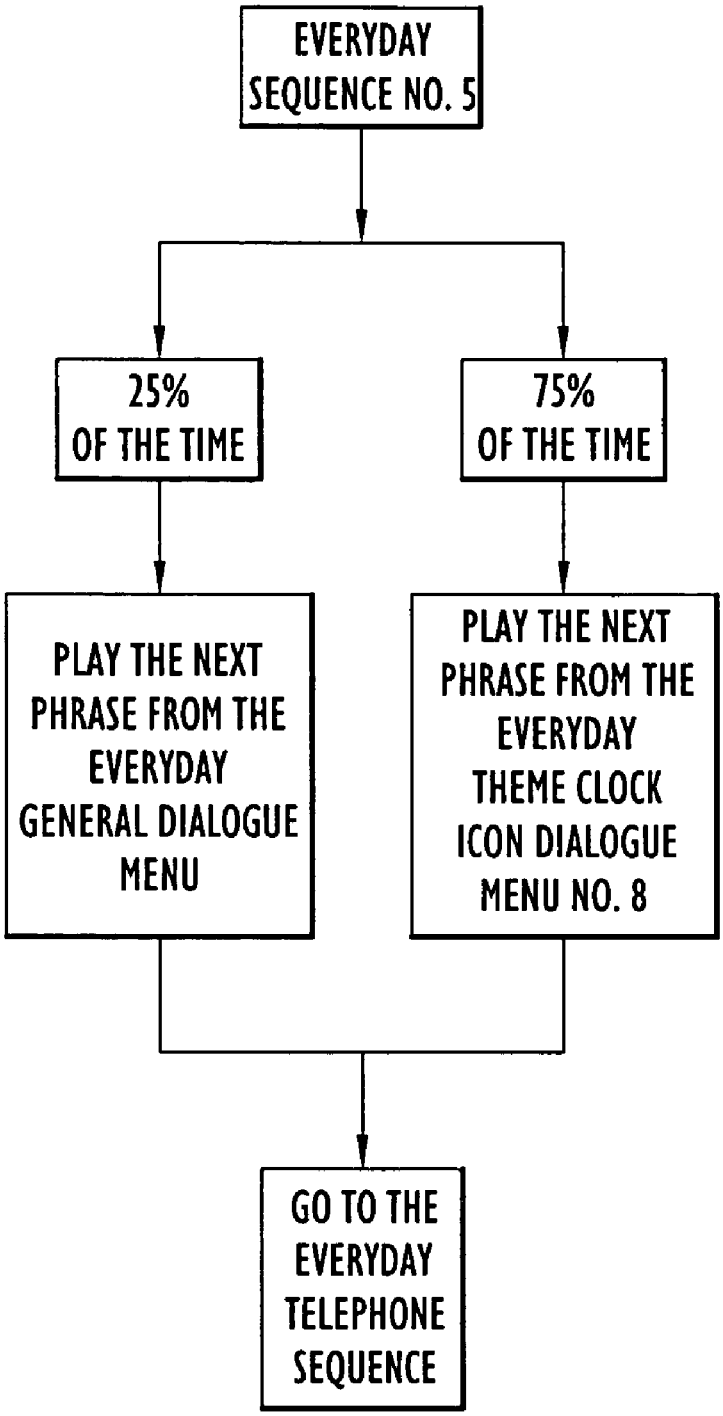
FIG. 21C is a flowchart depicting an everyday play sequence, where no theme card is present, with the clock hand (selector) directed at the 9 o'clock position in the electronic role play toy kitchen of FIG. 1.
Figure 21D:
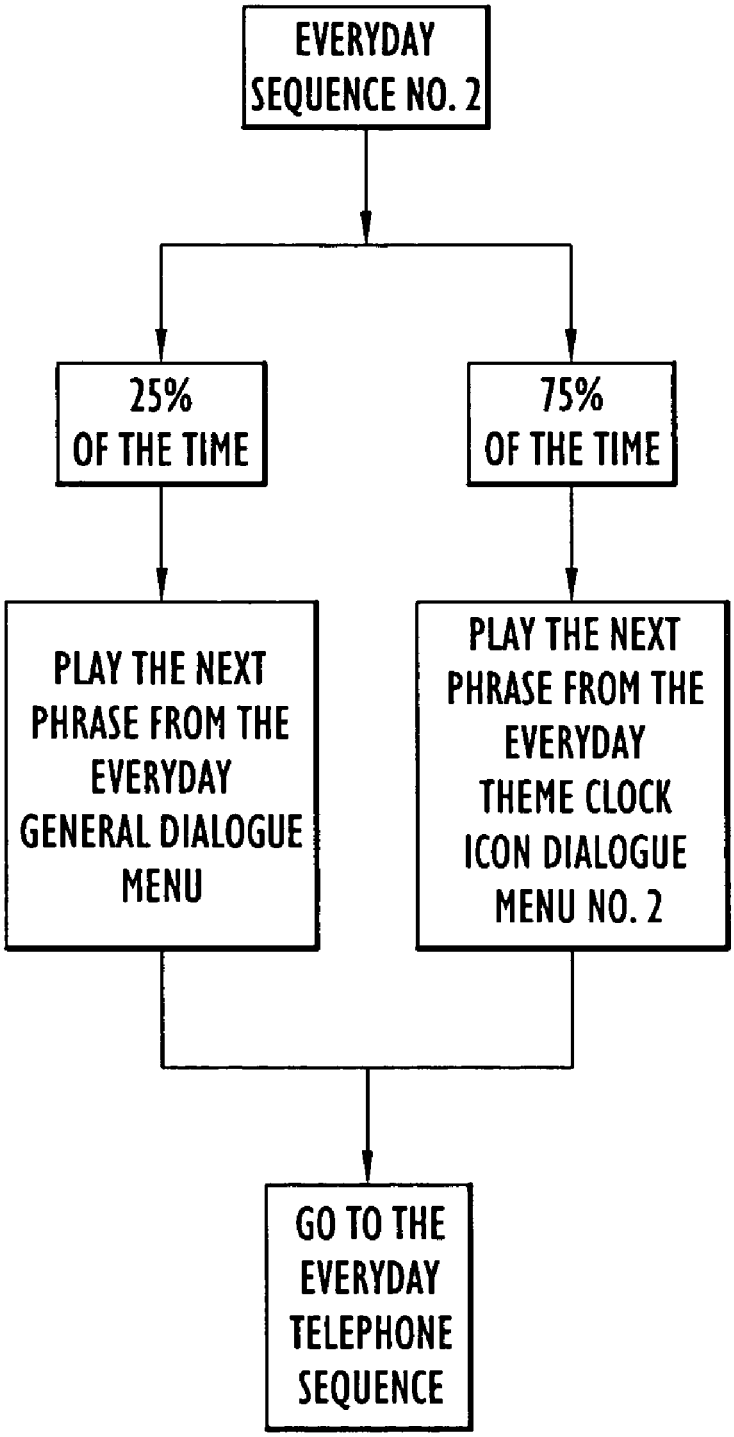
FIG. 21D is a flowchart depicting an everyday play sequence, where no theme card is present, with the clock hand (selector) directed at the 3 o'clock position in the electronic role play toy kitchen of FIG. 1.
Figure 21E:
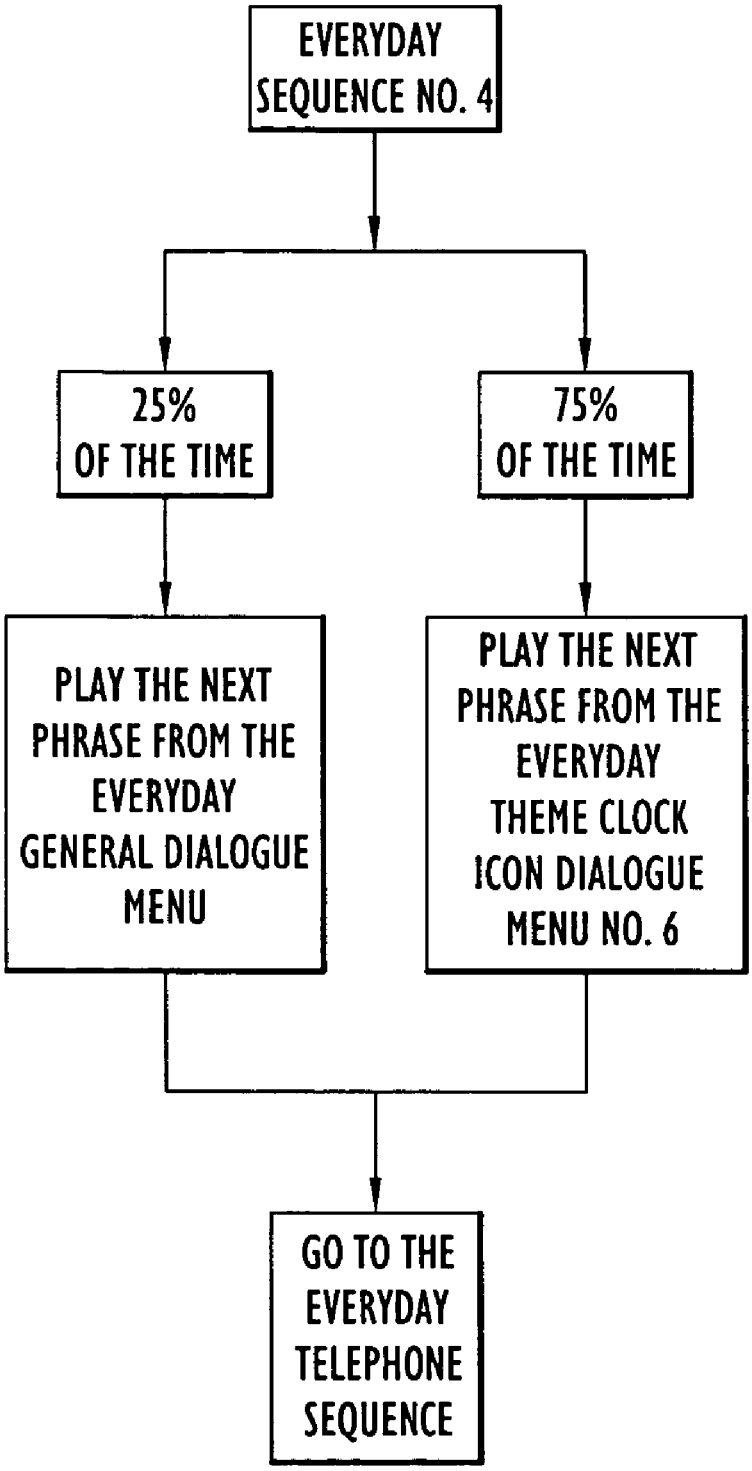
FIG. 21E is a flowchart depicting an everyday play sequence, where no theme card is present, with the clock hand (selector) directed at the 7 o'clock position in the electronic role play toy kitchen of FIG. 1.
Figure 21F:
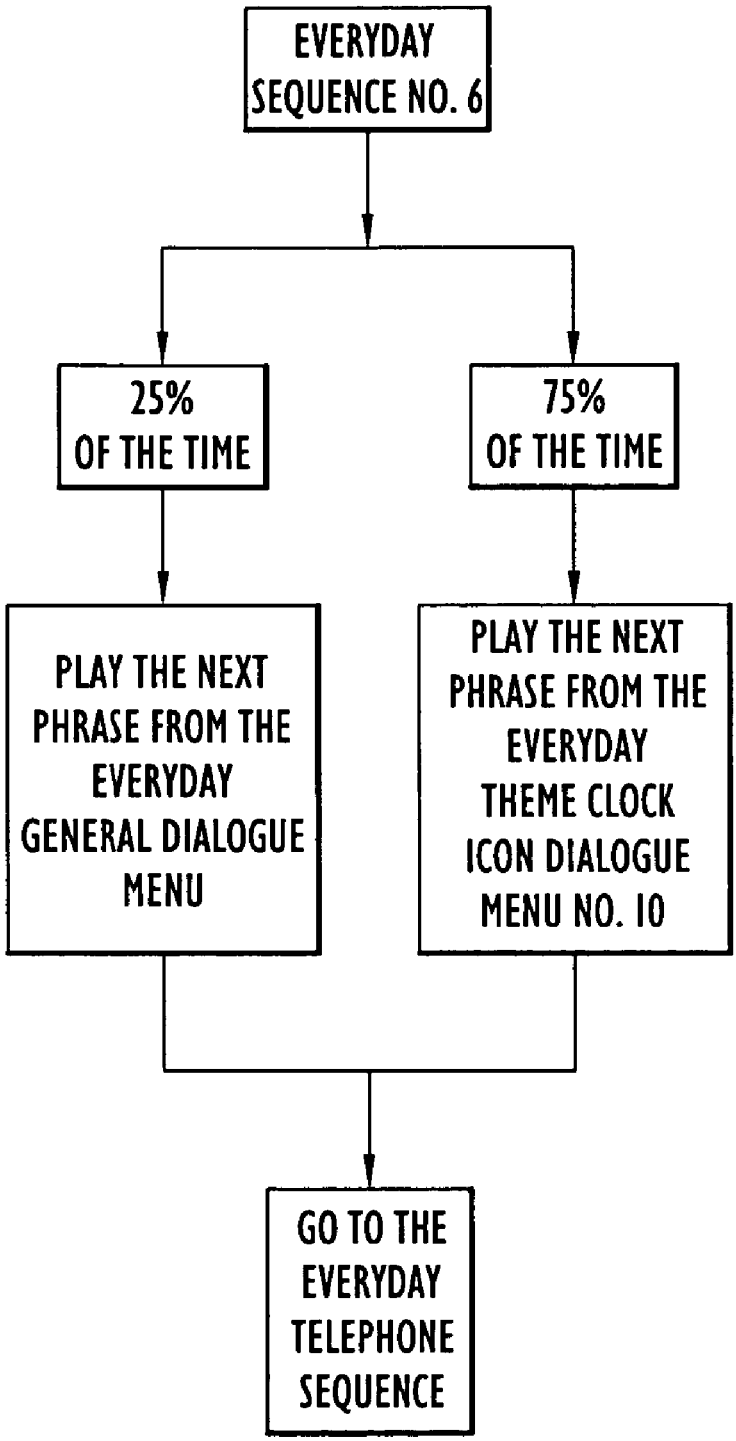
FIG. 21F is a flowchart depicting an everyday play sequence, where no theme card is present, with the clock hand (selector) directed at the 11 o'clock position in the electronic role play toy kitchen of FIG. 1.
Figure 26A:
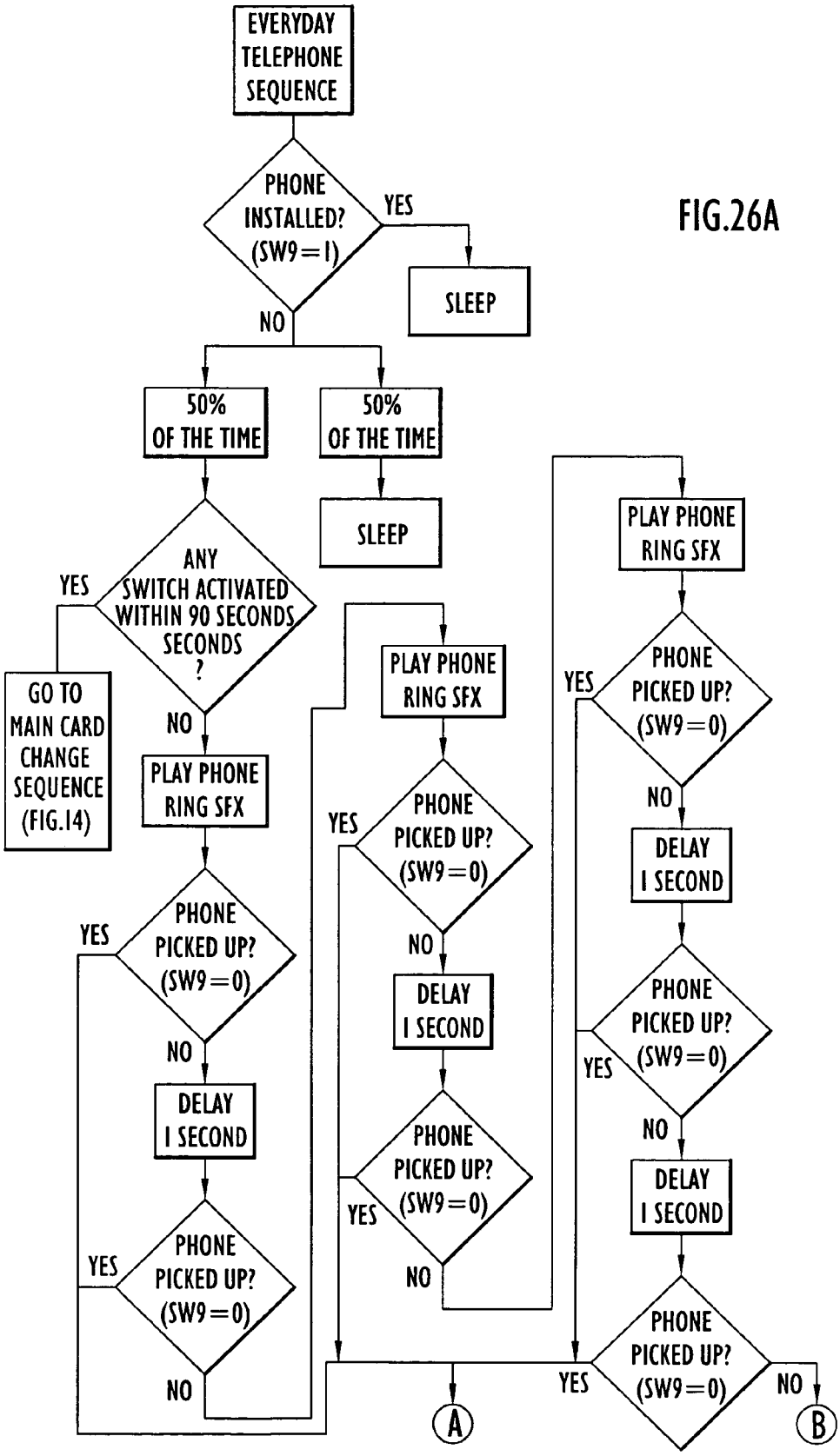
FIGS. 26A and 26B are flowcharts of an everyday telephone play sequence in the electronic role play toy kitchen of FIG. 1.
Figure 26B:
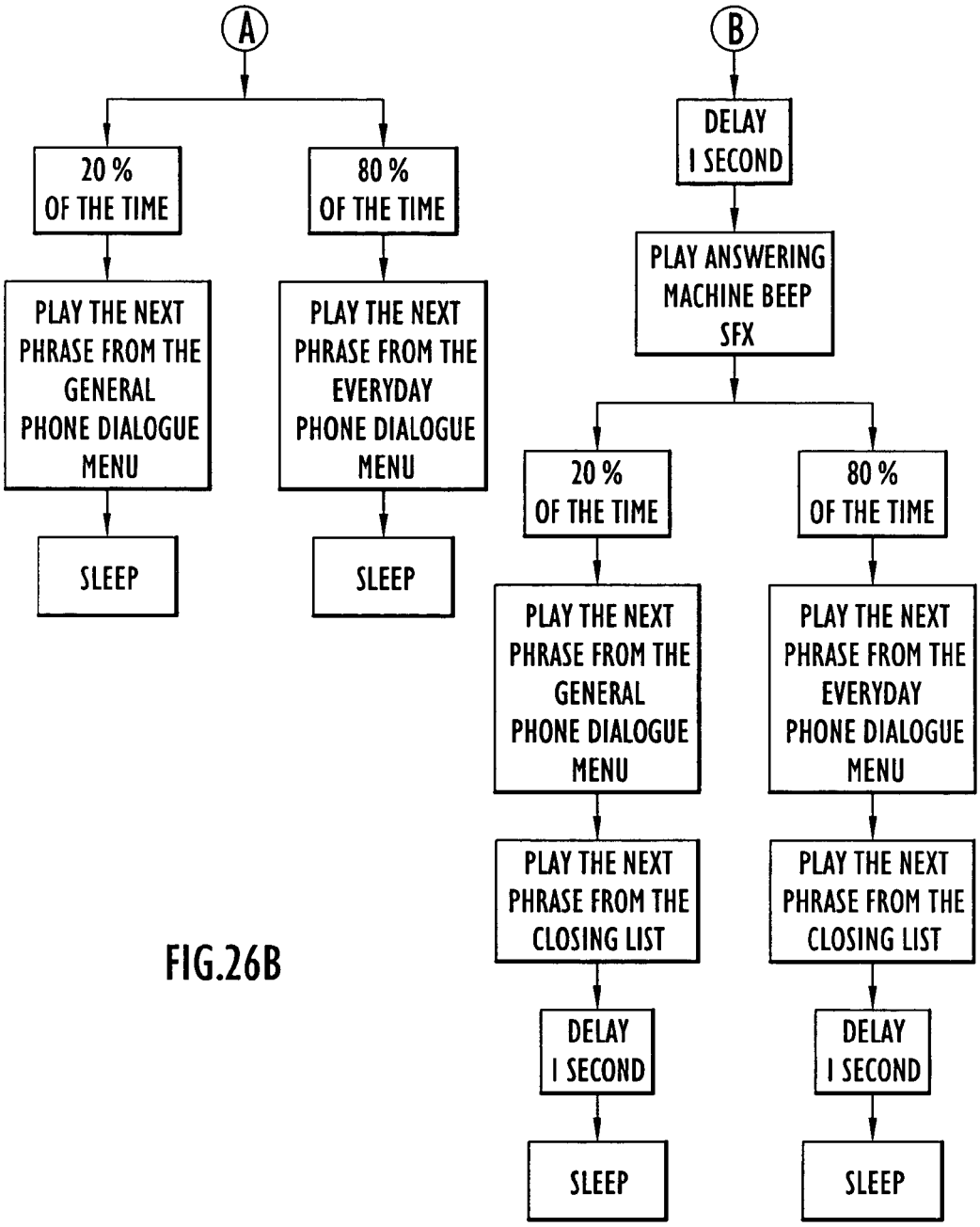

As shown in FIG. 21A, if no theme card 325 is installed in the card receiving portion 327 and the clock hand 324B is in the 1 o'clock position, electronic component 350 moves through "Everyday Sequence No. 1." At this point, electronic component 350 introduces some pseudo-randomness in that 25% of the time a phrase from the "Everyday General Dialogue Menu" will be output through the speaker 360, and 75% of the time a phrase from the "Everyday Theme Clock Icon Dialogue Menu No. 12" will be output through the speaker 360. While the dialogue menus are not shown herein, each specific menu contains unique, situation appropriate dialogue. As shown in FIG. 21D, if no theme card 325 is installed in the card receiving portion 327 and the clock hand 324B is in the 3 o'clock position, electronic component 350 moves through "Everyday Sequence No. 2." If no theme card 325 is installed in the card receiving portion 327 and the clock hand 324B is in the 5 o'clock position, electronic component 350 moves through "Everyday Sequence No. 3" (illustrated in FIG. 21B). If no theme card 325 is installed in the card receiving portion 327 and the clock hand 324B is in the 7 o'clock position, electronic component 350 moves through "Everyday Sequence No. 4" (illustrated in FIG. 21E). If no theme card 325 is installed in the card receiving portion 327 and the clock hand 324B is in the 9 o'clock position, electronic component 350 moves through "Everyday Sequence No. 5" (illustrated in FIG. 21C). Finally, if no theme card 325 is installed in the card receiving portion 327 and the clock hand 324B is in the 11 o'clock position, electronic component 350 moves through "Everyday Sequence No. 6" (illustrated in FIG. 21F). After completion of the play sequence, the electronic component 350 begins the self-explanatory "Everyday Telephone Sequence" as illustrated in FIGS. 26A and 26B.

Figure 17:
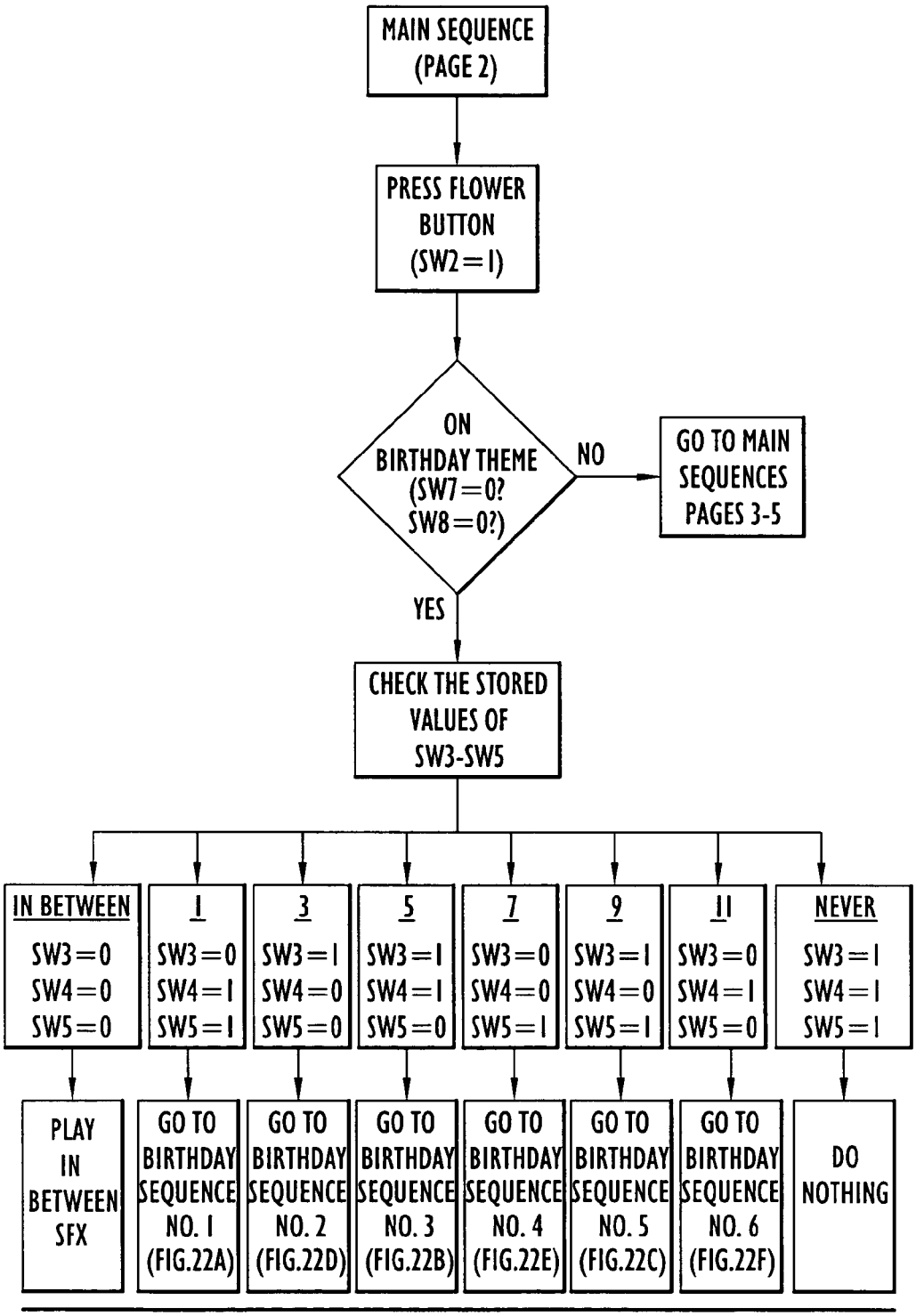
FIG. 17 is a flowchart depicting a play sequence relating to the birthday theme card in the electronic role play toy kitchen of FIG. 1.

Play Sequence—Main Play Sequence Page 2 (FIG. 17—Birthday Theme Card Installed)

Main switch 321A (SW2) is actuated to allow electronic component 350 to check the state of switches 352 (SW7) and 351 (SW8). If either or both of the switches 352 (SW7) and 351 (SW8) are closed (1), then the electronic component 350 moves on to main sequence pages 3-5 illustrated in FIGS. 18-20. If both of the switches 352 (SW7) and 351 (SW8) are open (0), then the birthday theme card 325 is received in card receiving portion 327. If the birthday theme card 325 is installed, the electronic component 350 then checks for the stored value of the switches 730 (SW3), 710 (SW4), and 720 (SW5). Next, the electronic component 350 compares the states of switches 730 (SW3), 710 (SW4), and 720 (SW5) with the clock switch look-up table (FIG. 31) to determine in what position the clock hand 324B is located (1, 3, 5, 7, 9, or 11, or somewhere in between these times). Once the position of the clock hand 324B is identified, the electronic component 350 moves on to the appropriate "birthday" sequence as shown in FIGS. 22A-22F and as discussed below.

Play Sequences—Birthday Play Sequences 1-6 (Birthday Theme Card Installed)

Figure 22A:
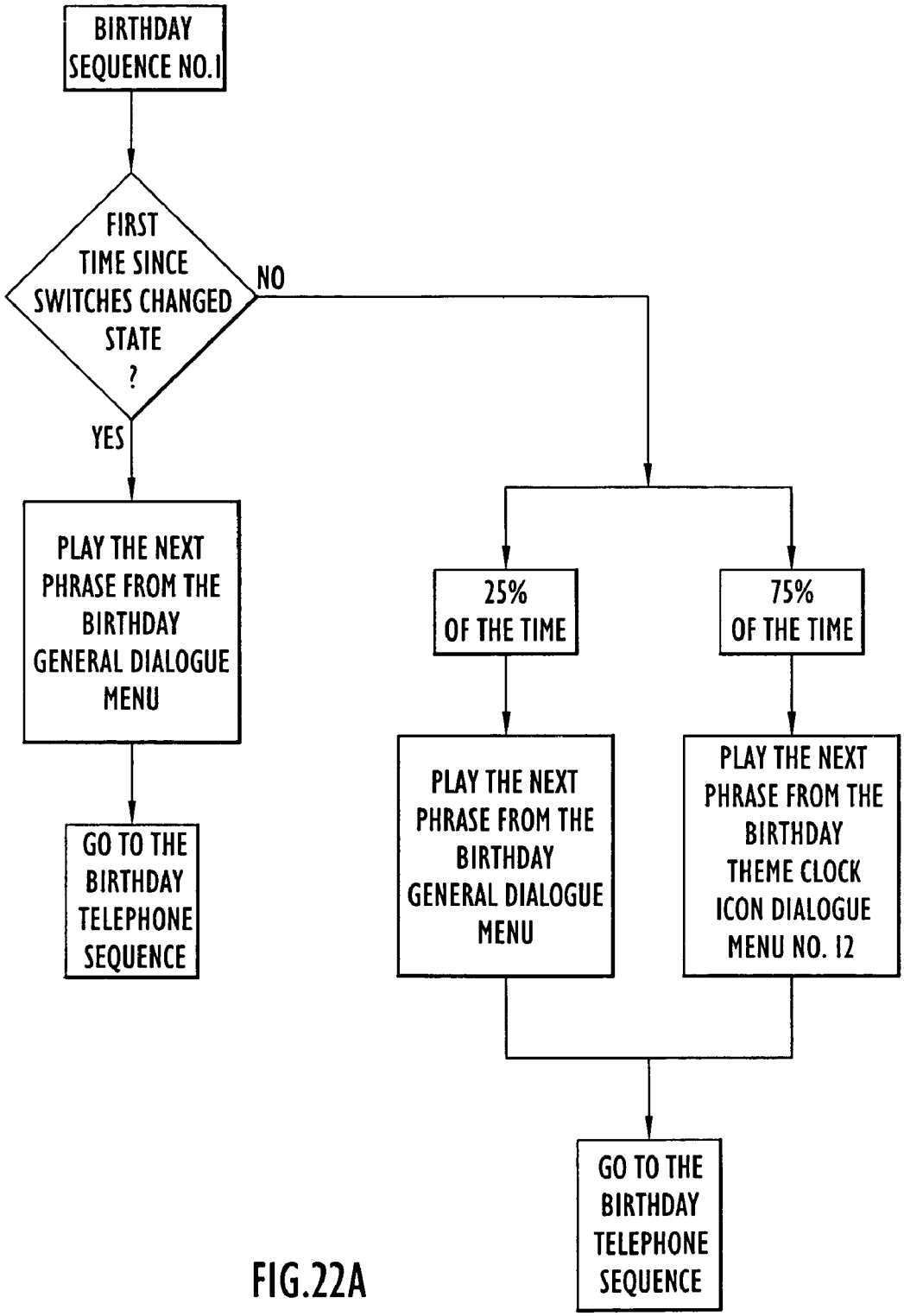
FIG. 22A is a flowchart depicting a birthday play sequence, where the birthday theme card is inserted into the card receiving portion and with the clock hand (selector) directed at the 1 o'clock position in the electronic role play toy kitchen of FIG. 1.
Figure 22B:
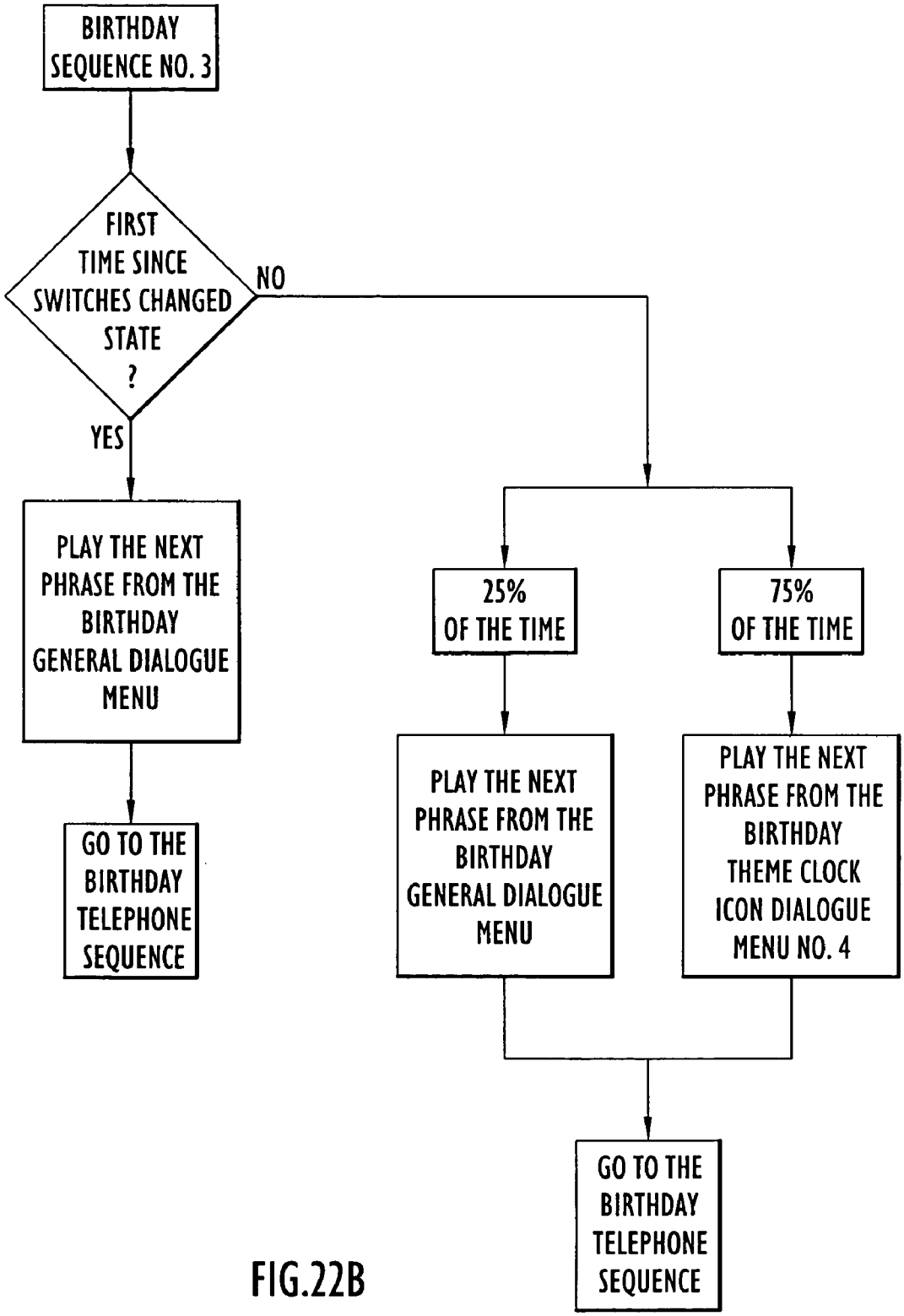
FIG. 22B is a flowchart depicting a birthday play sequence, where the birthday theme card is inserted into the card receiving portion and with the clock hand (selector) directed at the 5 o'clock position in the electronic role play toy kitchen of FIG. 1.
Figure 22C:
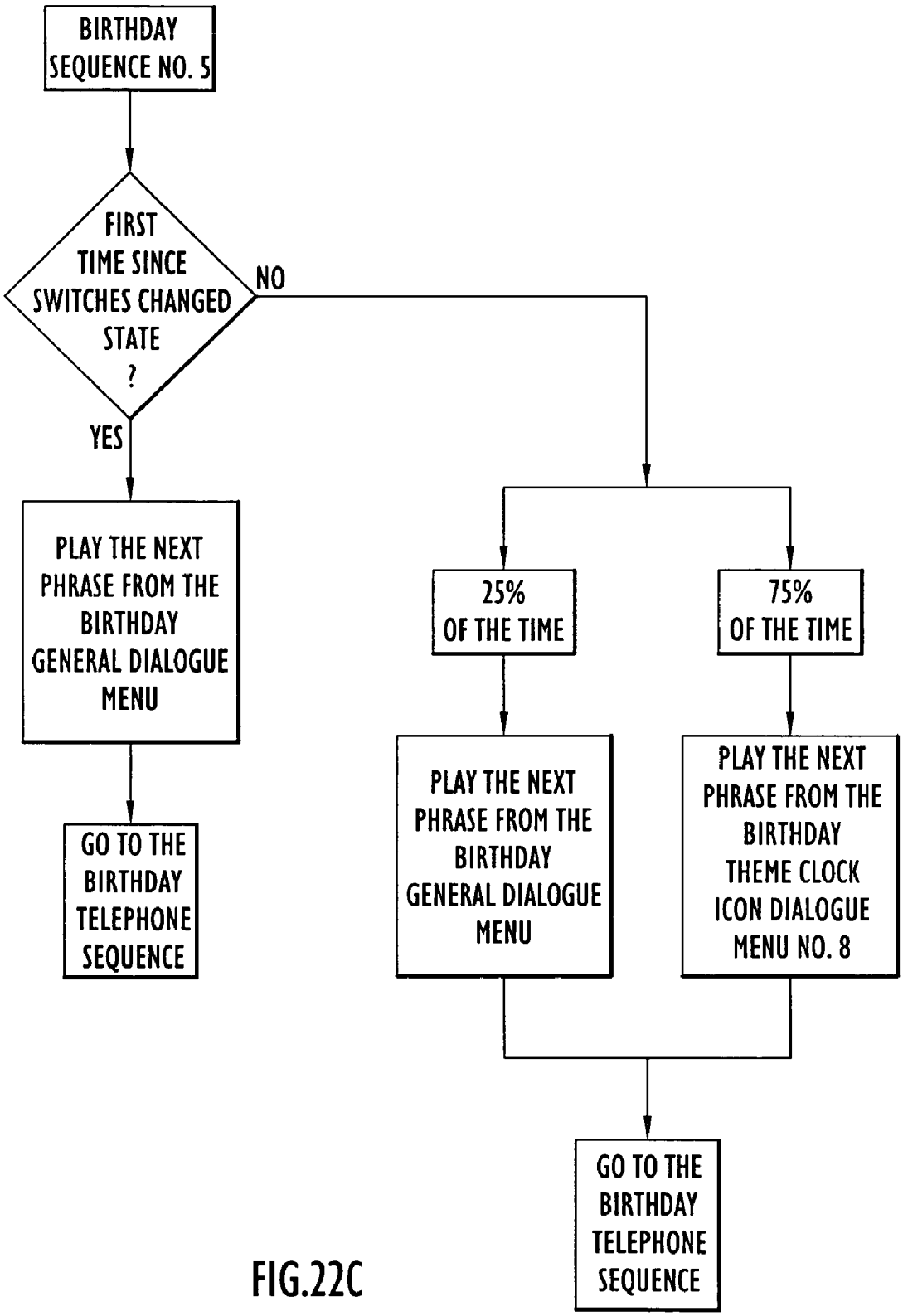
FIG. 22C is a flowchart depicting a birthday play sequence, where the birthday theme card is inserted into the card receiving portion and with the clock hand (selector) directed at the 9 o'clock position in the electronic role play toy kitchen of FIG. 1.
Figure 22D:
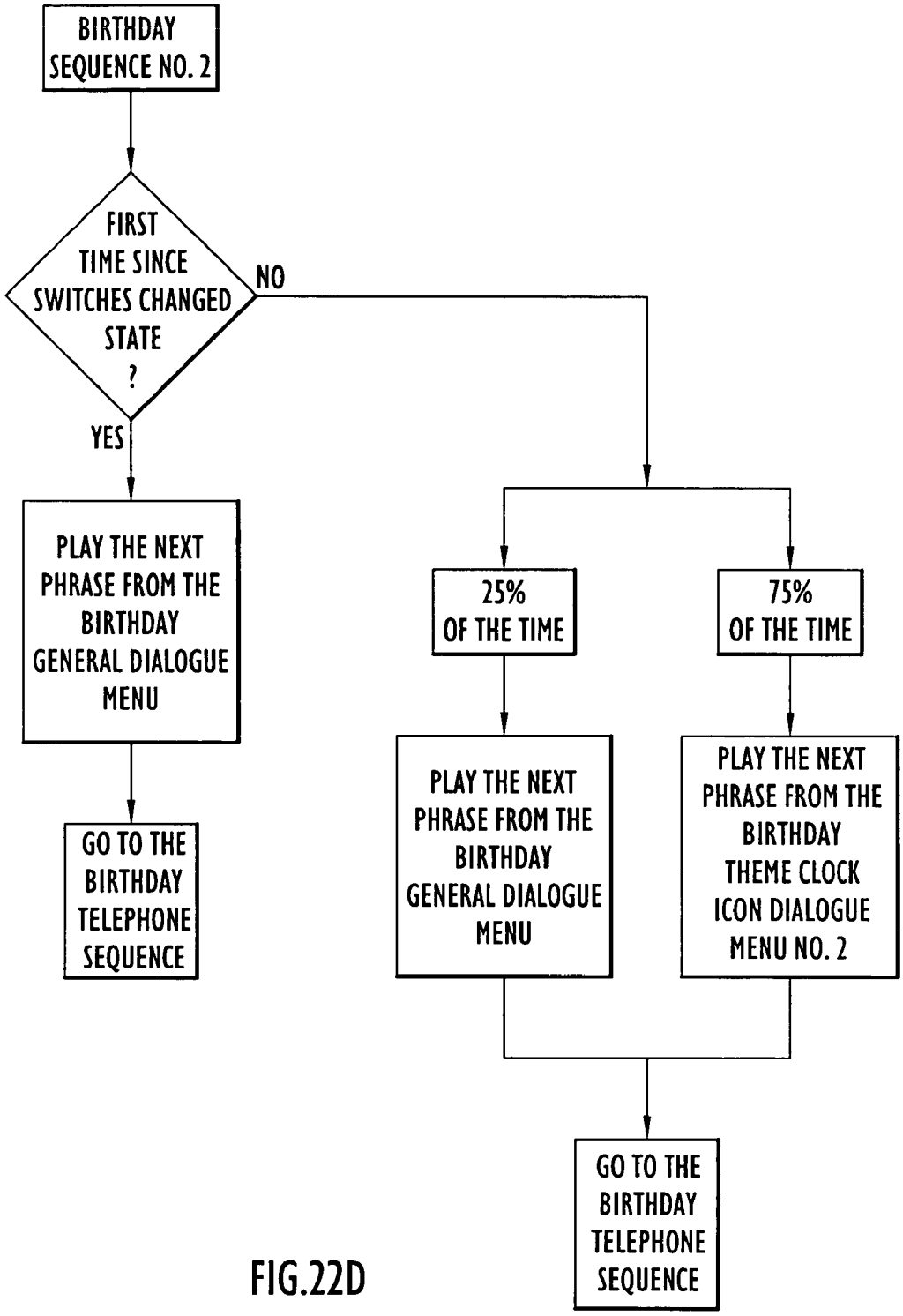
FIG. 22D is a flowchart depicting a birthday play sequence, where the birthday theme card is inserted into the card receiving portion and with the clock hand (selector) directed at the 3 o'clock position in the electronic role play toy kitchen of FIG. 1.
Figure 22E:
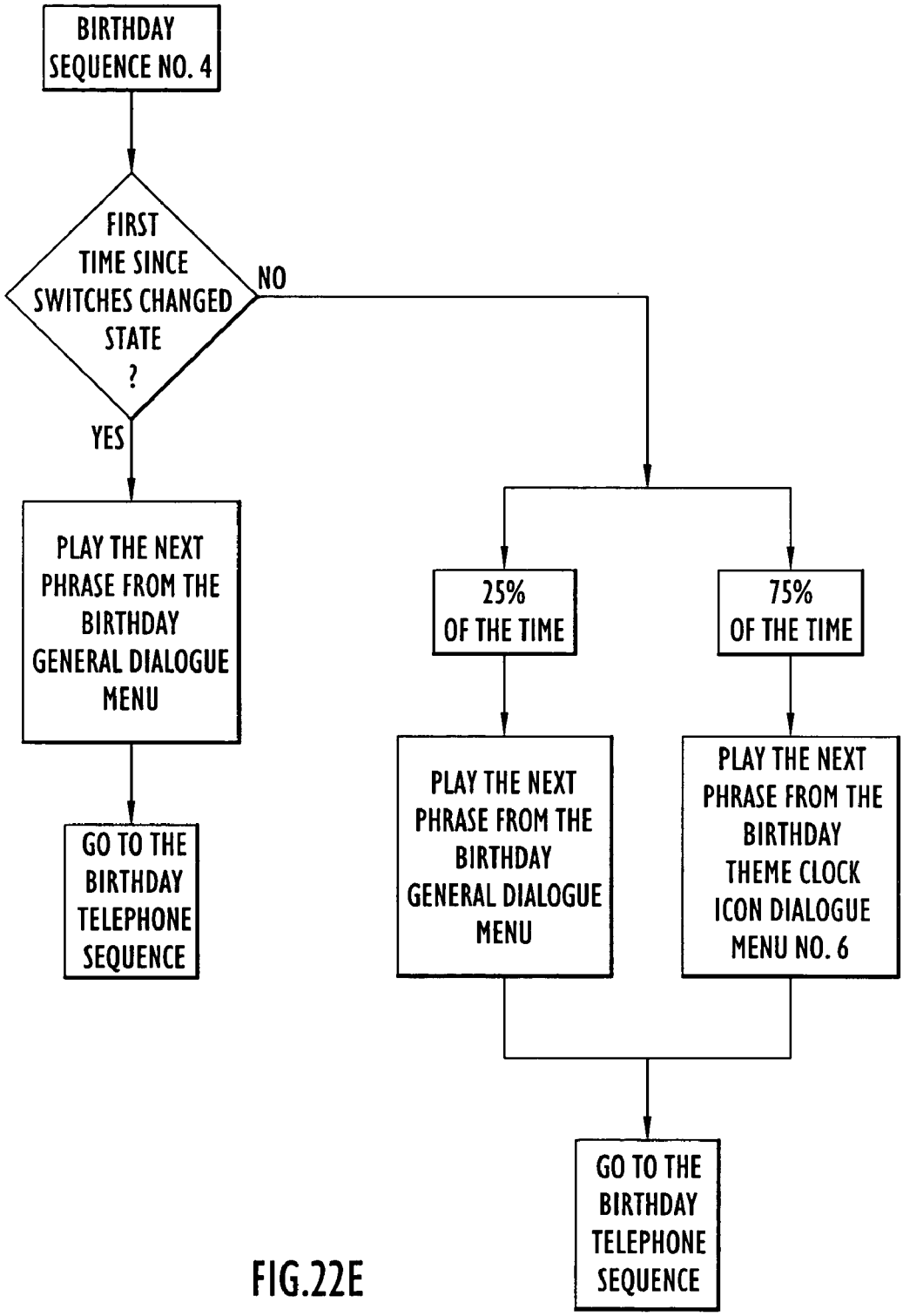
FIG. 22E is a flowchart depicting a birthday play sequence, where the birthday theme card is inserted into the card receiving portion and with the clock hand (selector) directed at the 7 o'clock position in the electronic role play toy kitchen of FIG. 1.
Figure 22F:
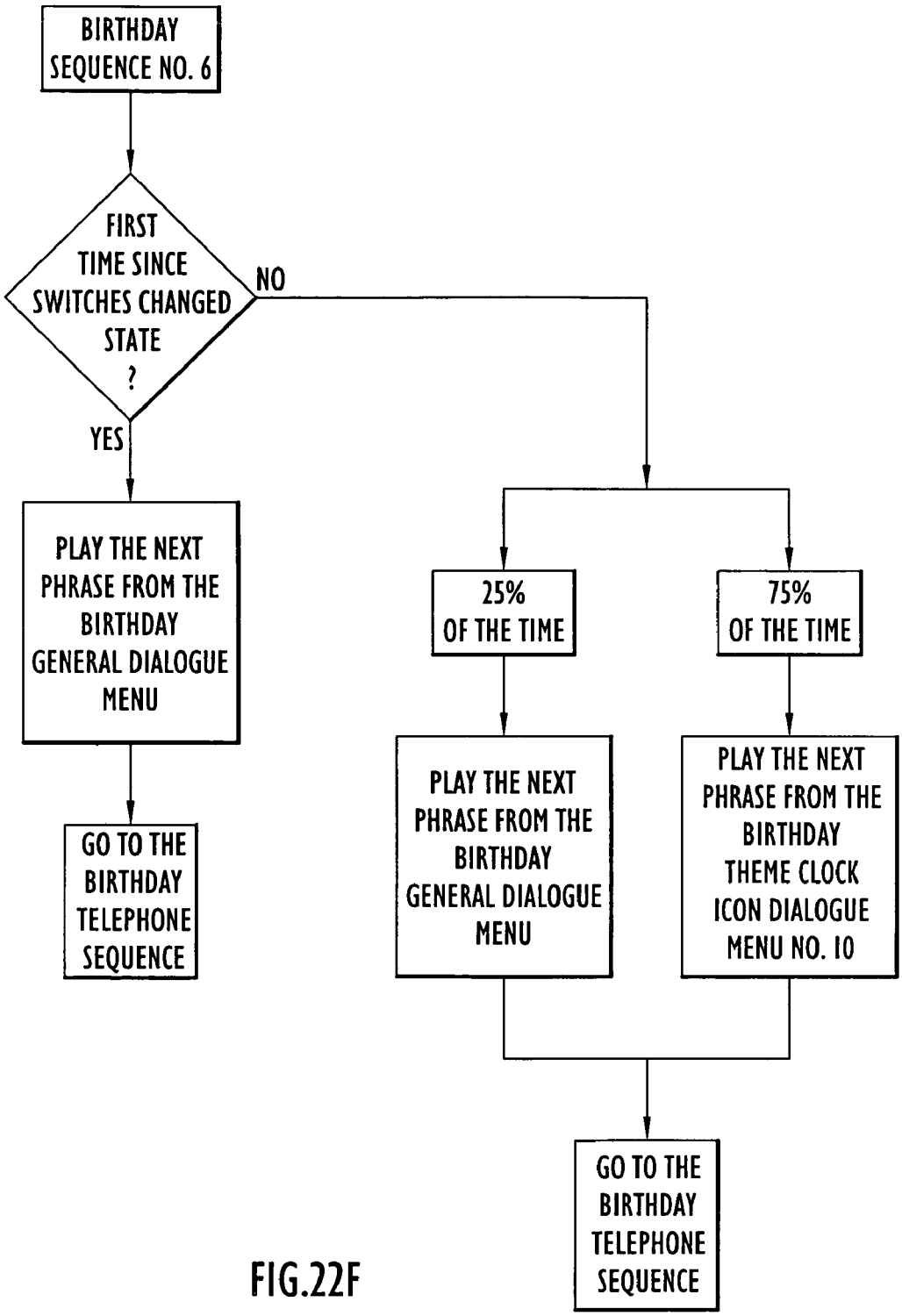
FIG. 22F is a flowchart depicting a birthday play sequence, where the birthday theme card is inserted into the card receiving portion and with the clock hand (selector) directed at the 11 o'clock position in the electronic role play toy kitchen of FIG. 1.
Figure 27A:
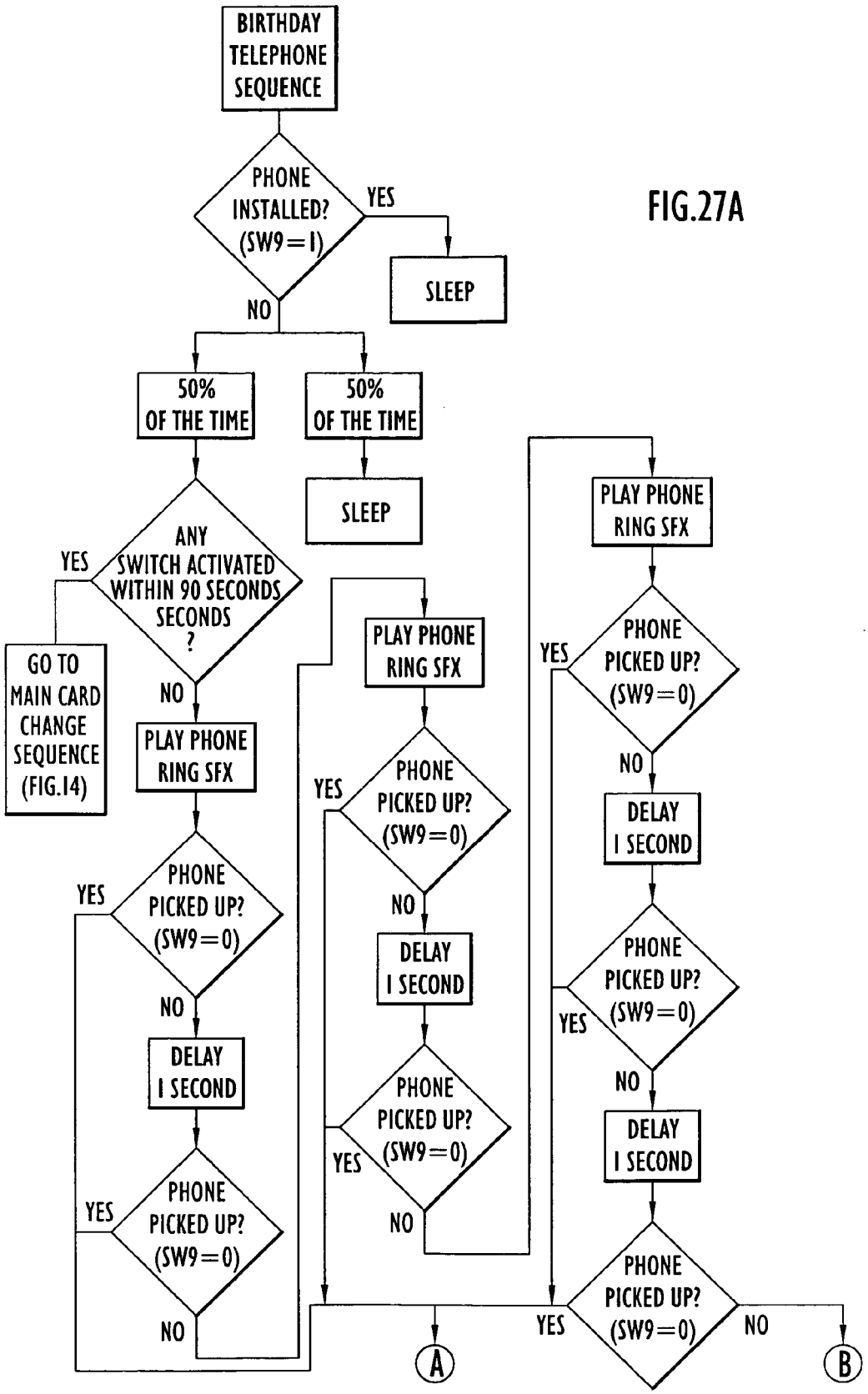
FIGS. 27A and 27B are flowcharts of a birthday telephone play sequence in the electronic role play toy kitchen of FIG. 1.
Figure 27B:
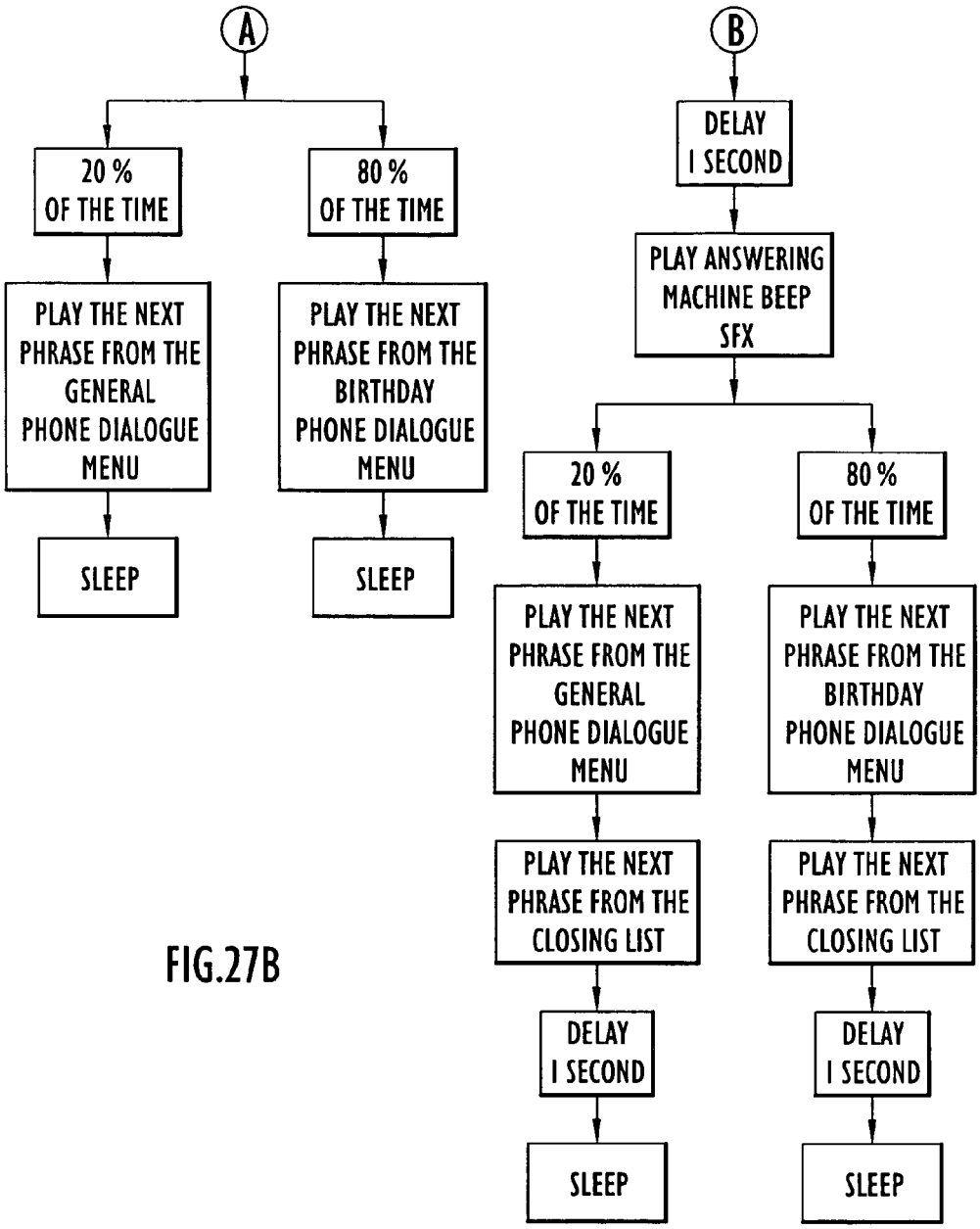

As shown in FIG. 22A, if the birthday theme card 325 is installed in the card receiving portion 327 and the clock hand 324B is in the 1 o'clock position, electronic component 350 moves through "Birthday Sequence No. 1." If this is the first time through, the electronic component 350 outputs a phrase (via speaker 360) from the "Birthday General Dialogue Menu". If this is not the first time through, electronic component 350 introduces some pseudo-randomness in that 25% of the time a phrase from the "Birthday General Dialogue Menu" will be output through the speaker 360, and 75% of the time a phrase from the "Birthday Theme Clock Icon Dialogue Menu No. 12" will be output through the speaker 360. As shown in FIG. 22D, if the birthday theme card 325 is installed in the card receiving portion 327 and the clock hand 324B is in the 3 o'clock position, electronic component 350 moves through "Birthday Sequence No. 2." If the birthday theme card 325 is installed in the card receiving portion 327 and the clock hand 324B is in the 5 o'clock position, electronic component 350 moves through "Birthday Sequence No. 3" (illustrated in FIG. 22B). If the birthday theme card 325 is installed in the card receiving portion 327 and the clock hand 324B is in the 7 o'clock position, electronic component 350 moves through "Birthday Sequence No. 4" (illustrated in FIG. 22E). If the birthday theme card 325 is installed in the card receiving portion 327 and the clock hand 324B is in the 9 o'clock position, electronic component 350 moves through "Birthday Sequence No. 5" (illustrated in FIG. 22C). Finally, if the birthday theme card 325 is installed in the card receiving portion 327 and the clock hand 324B is in the 11 o'clock position, electronic component 350 moves through "Birthday Sequence No. 6" (illustrated in FIG. 22F). After completion of the play sequence, the electronic component 350 begins the self-explanatory "Birthday Telephone Sequence" as illustrated in FIGS. 27A and 27B.

Figure 18:
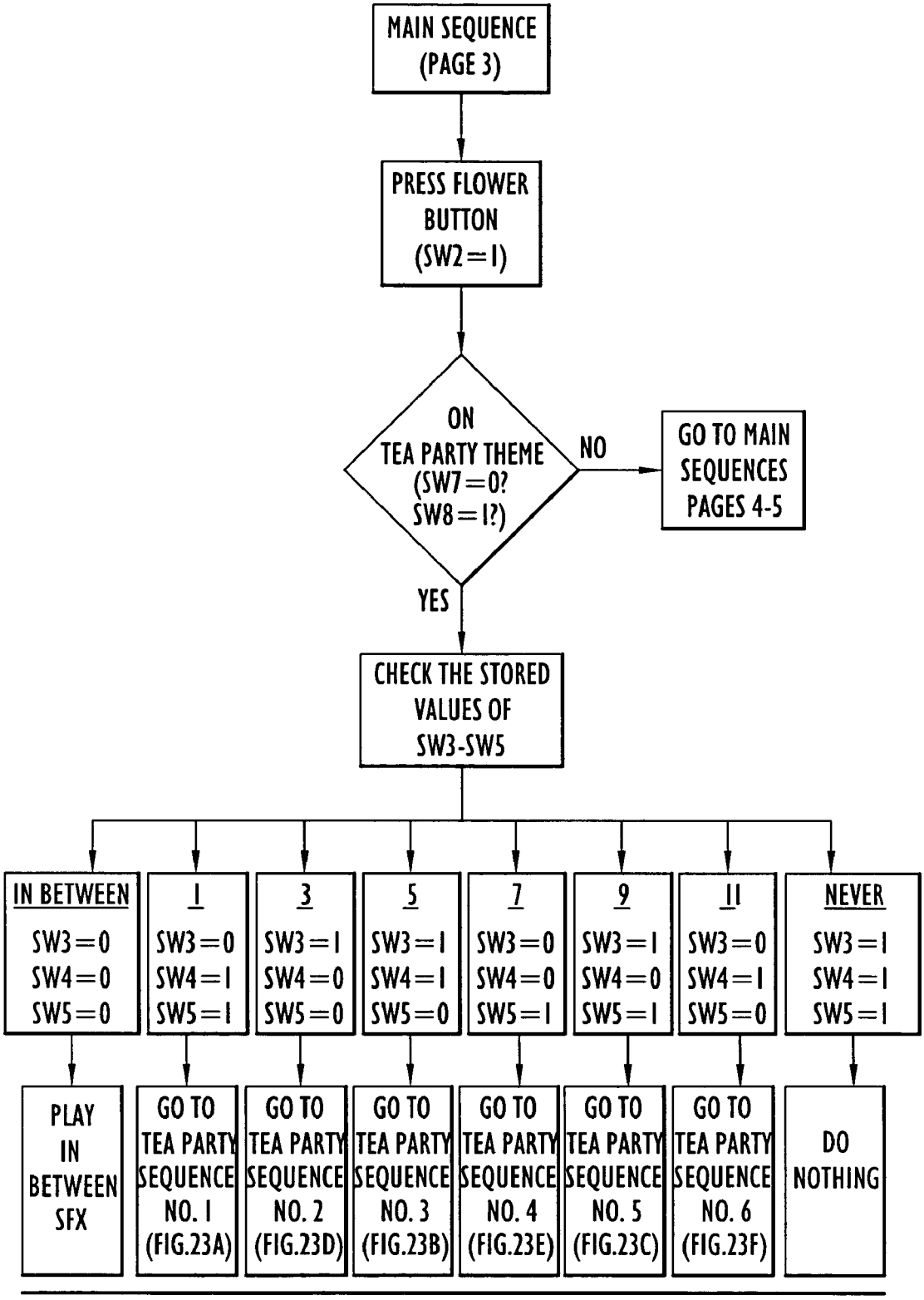
FIG. 18 is a flowchart depicting a play sequence relating to the tea party theme card in the electronic role play toy kitchen of FIG. 1.

Play Sequence—Main Play Sequence Page 3 (FIG. 18—Tea Party Theme Card Installed)

Main switch 321A (SW2) is actuated to allow electronic component 350 to check the state of switches 352 (SW7) and 351 (SW8). If switch 352 (SW7) is open (0) and switch 351 (SW8) is closed (1), then the tea party theme card 325 is received in card receiving portion 327, and if not, then the electronic component 350 moves on to main sequence pages 4-5 illustrated in FIGS. 19-20. If the tea party theme card 325 is installed, the electronic component 350 then checks for the stored of value of the switches 730 (SW3), 710 (SW4), and 720 (SW5). Next, the electronic component 350 compares the states of switches 730 (SW3), 710 (SW4), and 720 (SW5) with the clock switch look-up table (FIG. 31) to determine in what position the clock hand 324B is located (1, 3, 5, 7, 9, or 11, or somewhere in between these times). Once the position of the clock hand 324B is identified, the electronic component 350 moves on to the appropriate "tea party" sequence as shown in FIGS. 23A-23F and as discussed below.

Play Sequences—Tea Party Play Sequences 1-6 (Tea Party Theme Card Installed)

Figure 23A:
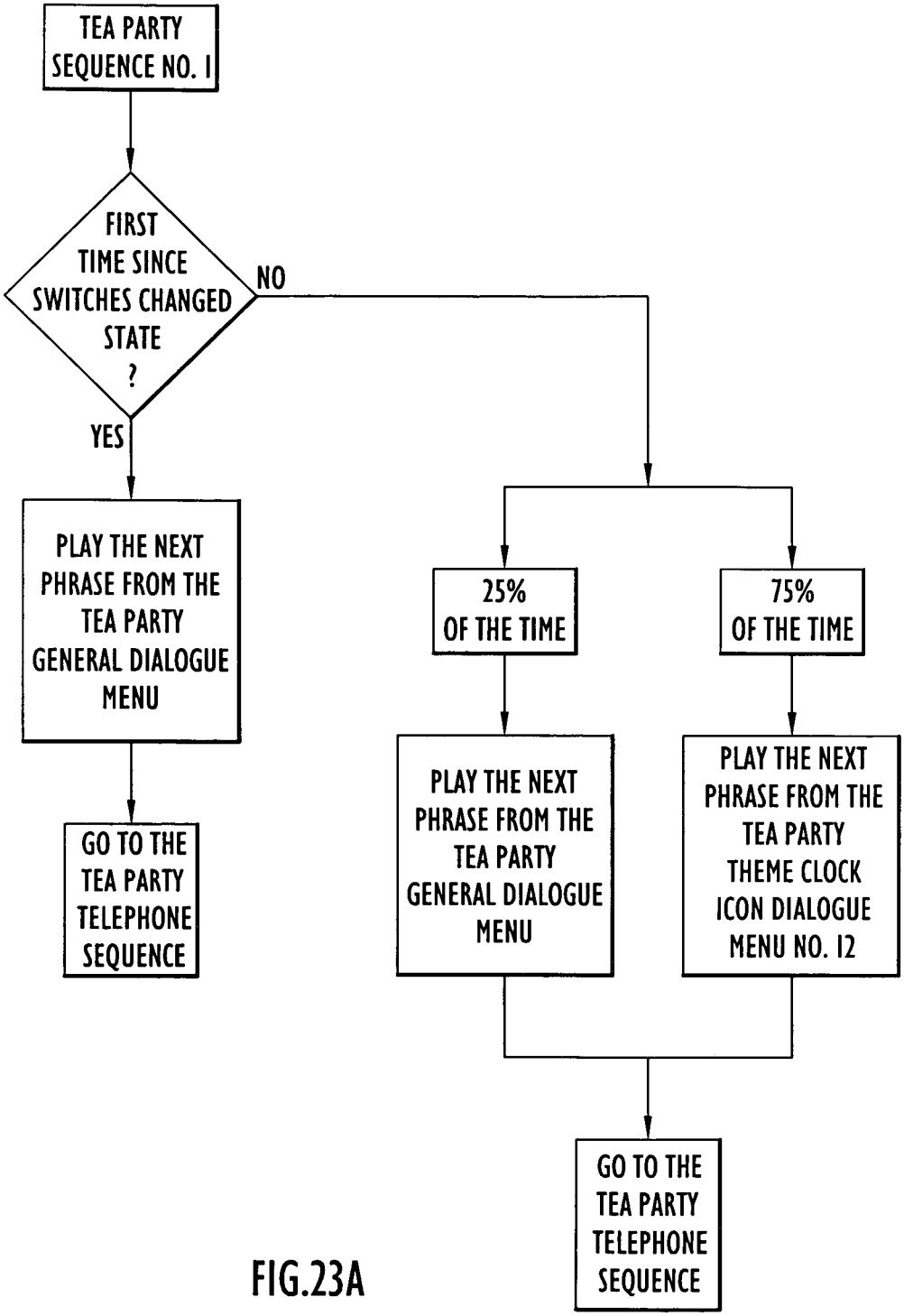
FIG. 23A is a flowchart depicting a tea party play sequence, where the tea party theme card is inserted into the card receiving portion and with the clock hand (selector) directed at the 1 o'clock position in the electronic role play toy kitchen of FIG. 1.
Figure 23B:
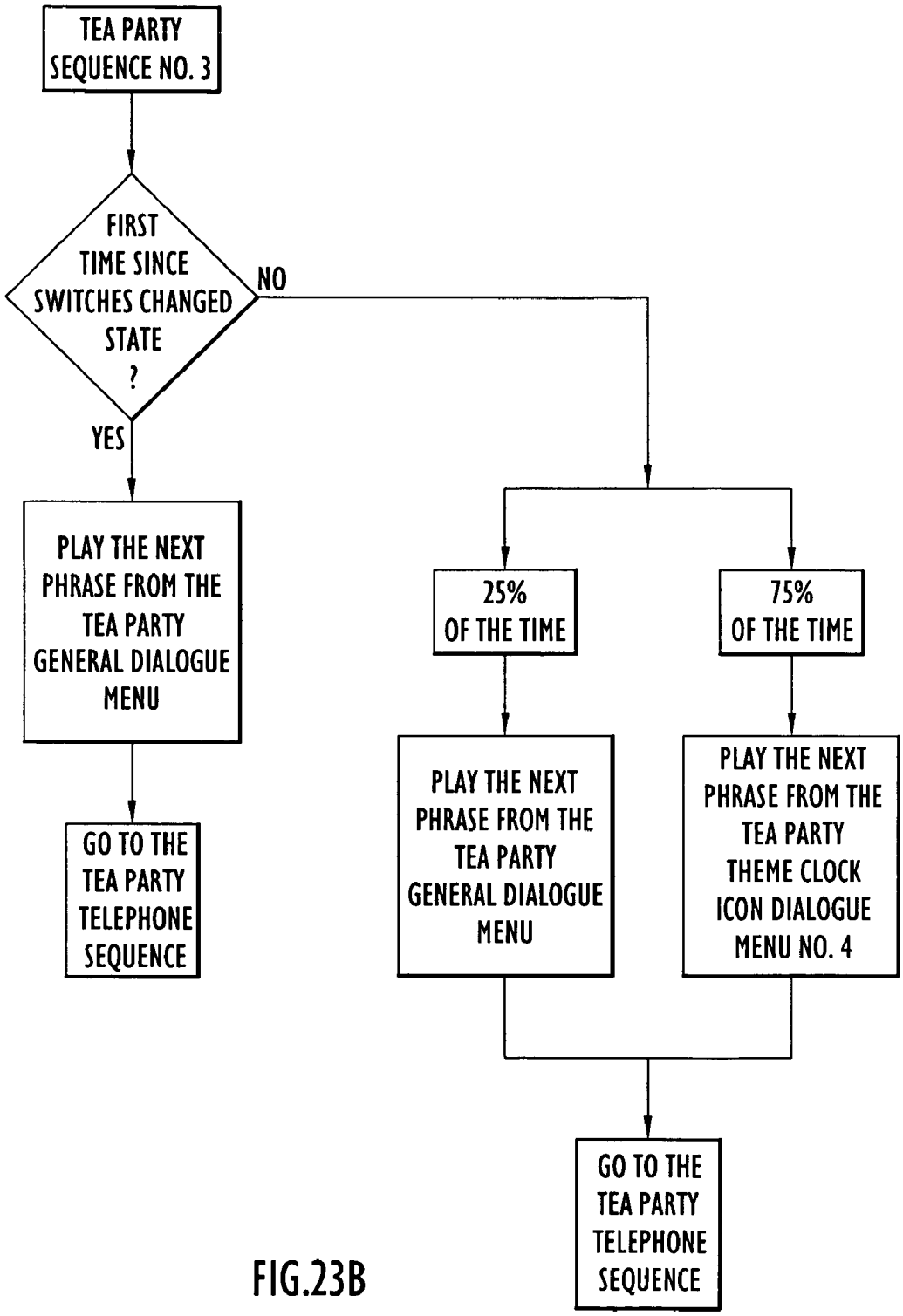
FIG. 23B is a flowchart depicting a tea party play sequence, where the tea party theme card is inserted into the card receiving portion and with the clock hand (selector) directed at the 5 o'clock position in the electronic role play toy kitchen of FIG. 1.
Figure 23C:
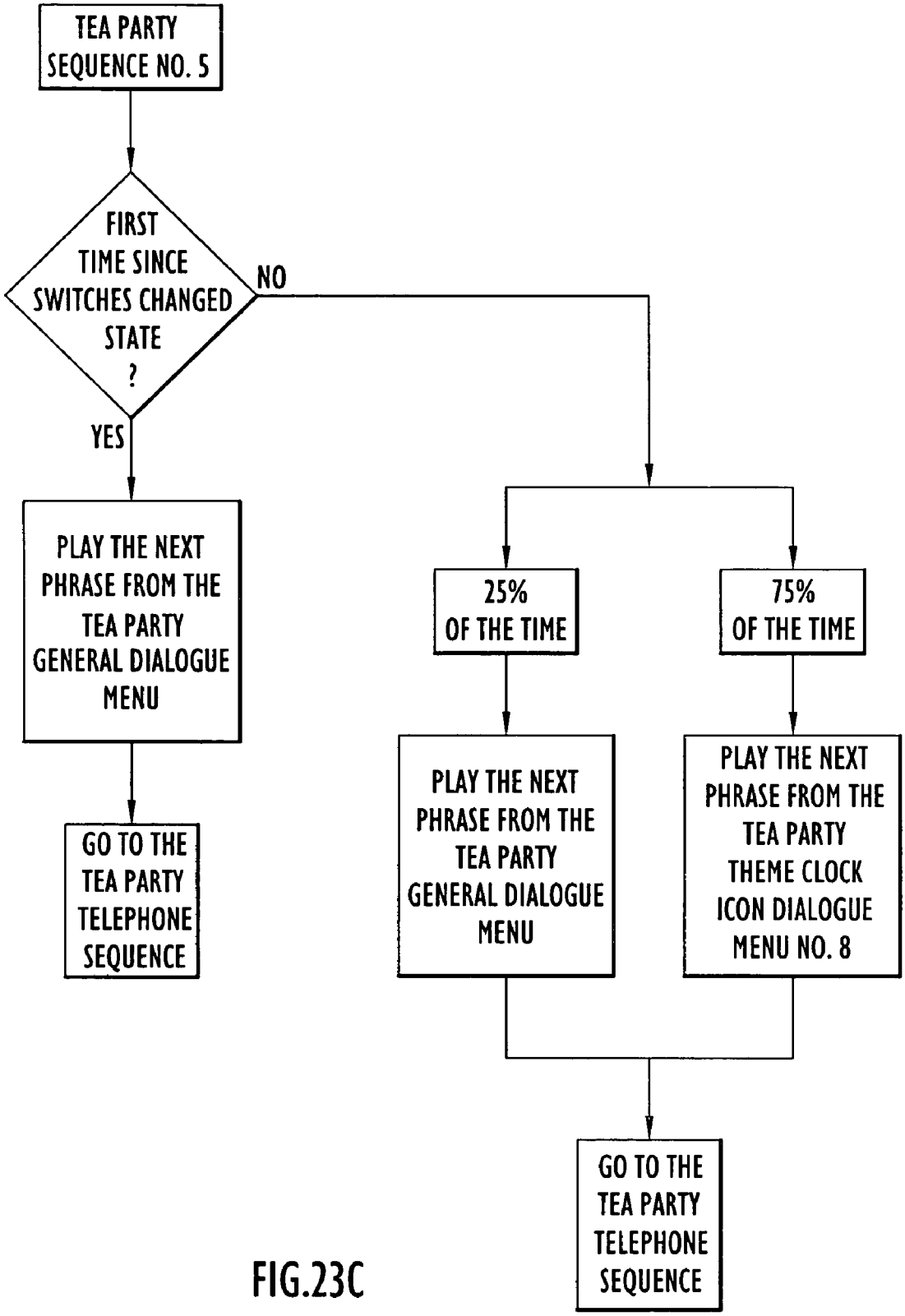
FIG. 23C is a flowchart depicting a tea party play sequence, where the tea party theme card is inserted into the card receiving portion and with the clock hand (selector) directed at the 9 o'clock position in the electronic role play toy kitchen of FIG. 1.
Figure 23D:
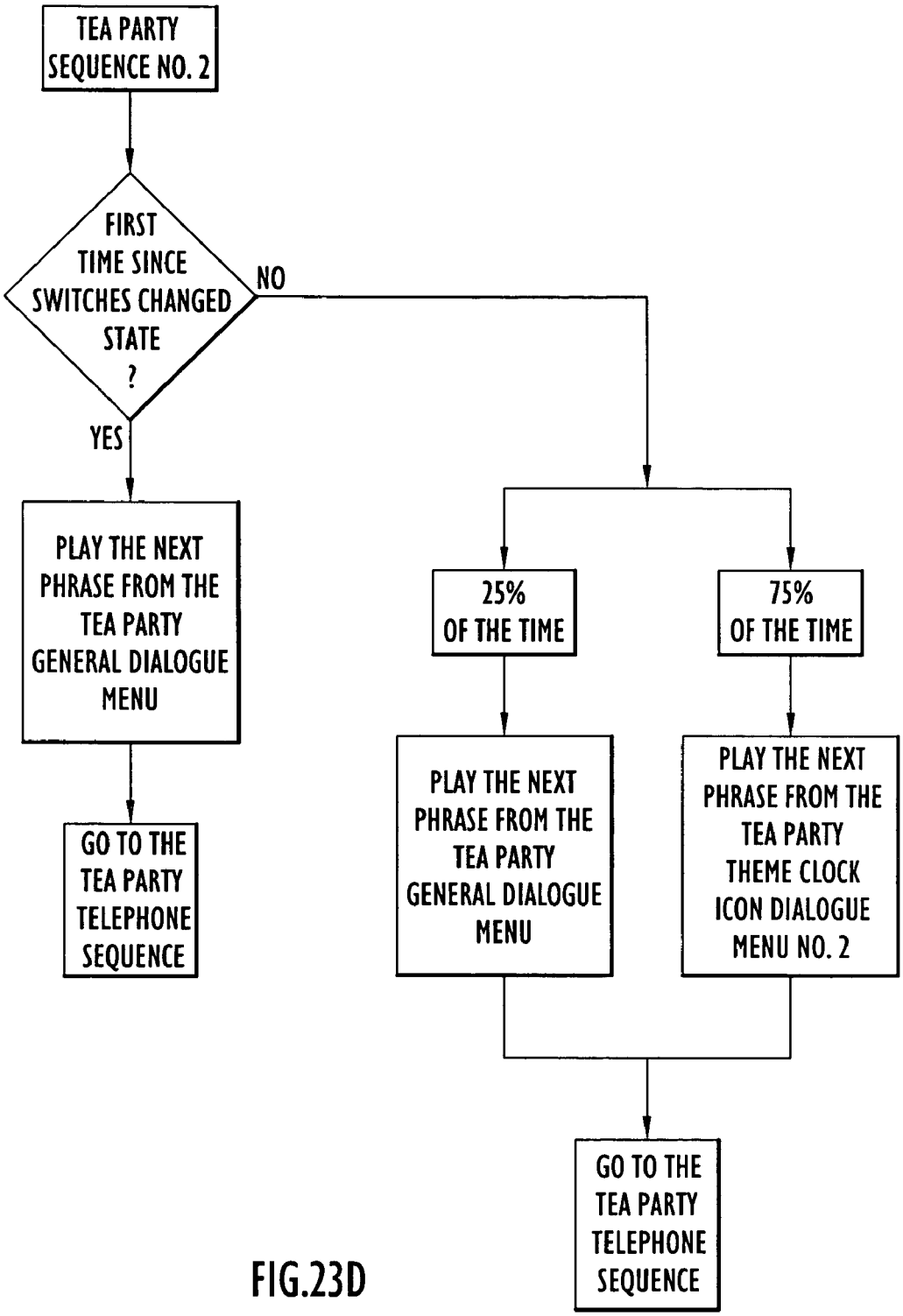
FIG. 23D is a flowchart depicting a tea party play sequence, where the tea party theme card is inserted into the card receiving portion and with the clock hand (selector) directed at the 3 o'clock position in the electronic role play toy kitchen of FIG. 1.
Figure 23E:
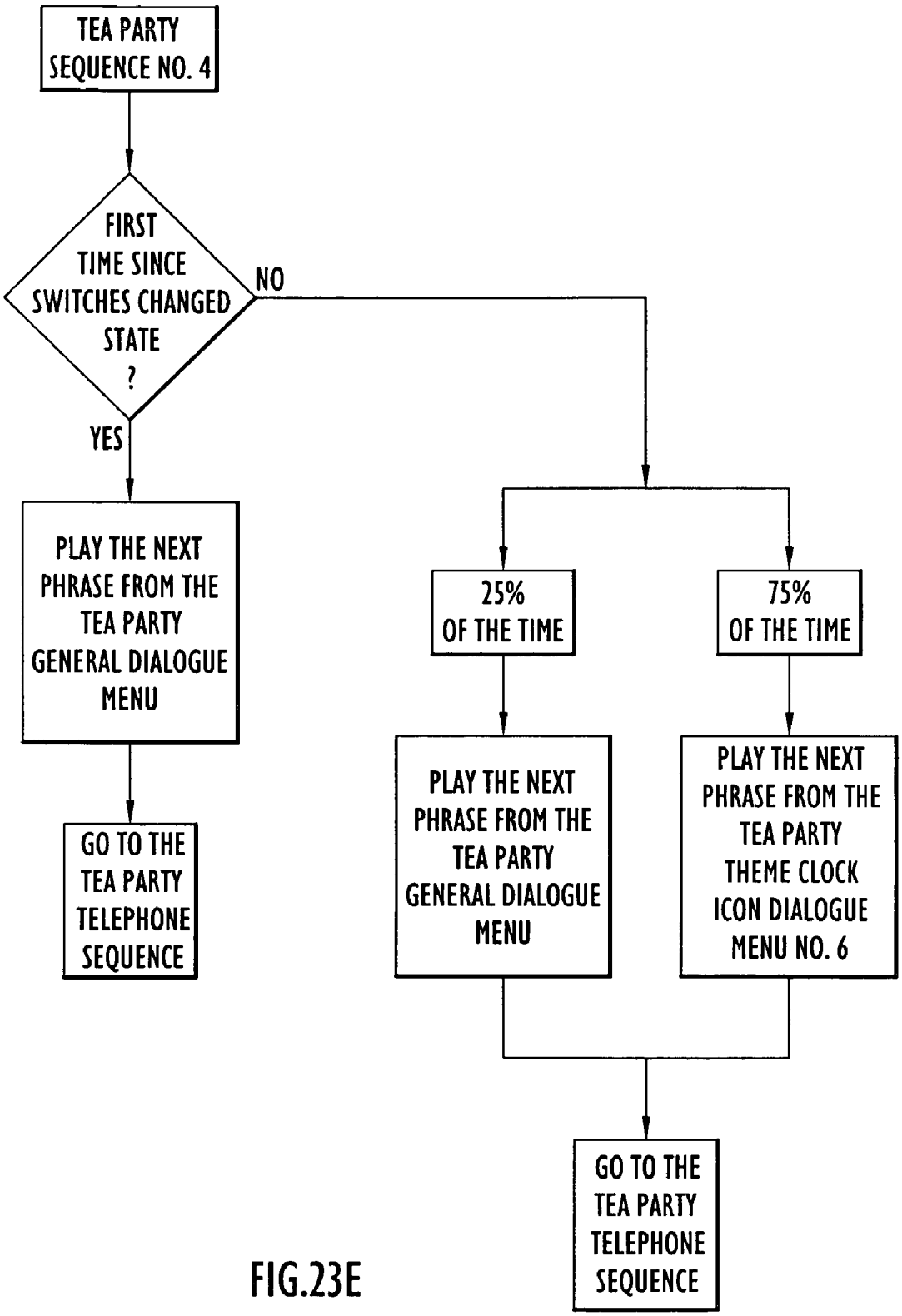
FIG. 23E is a flowchart depicting a tea party play sequence, where the tea party theme card is inserted into the card receiving portion and with the clock hand (selector) directed at the 7 o'clock position in the electronic role play toy kitchen of FIG. 1.
Figure 23F:
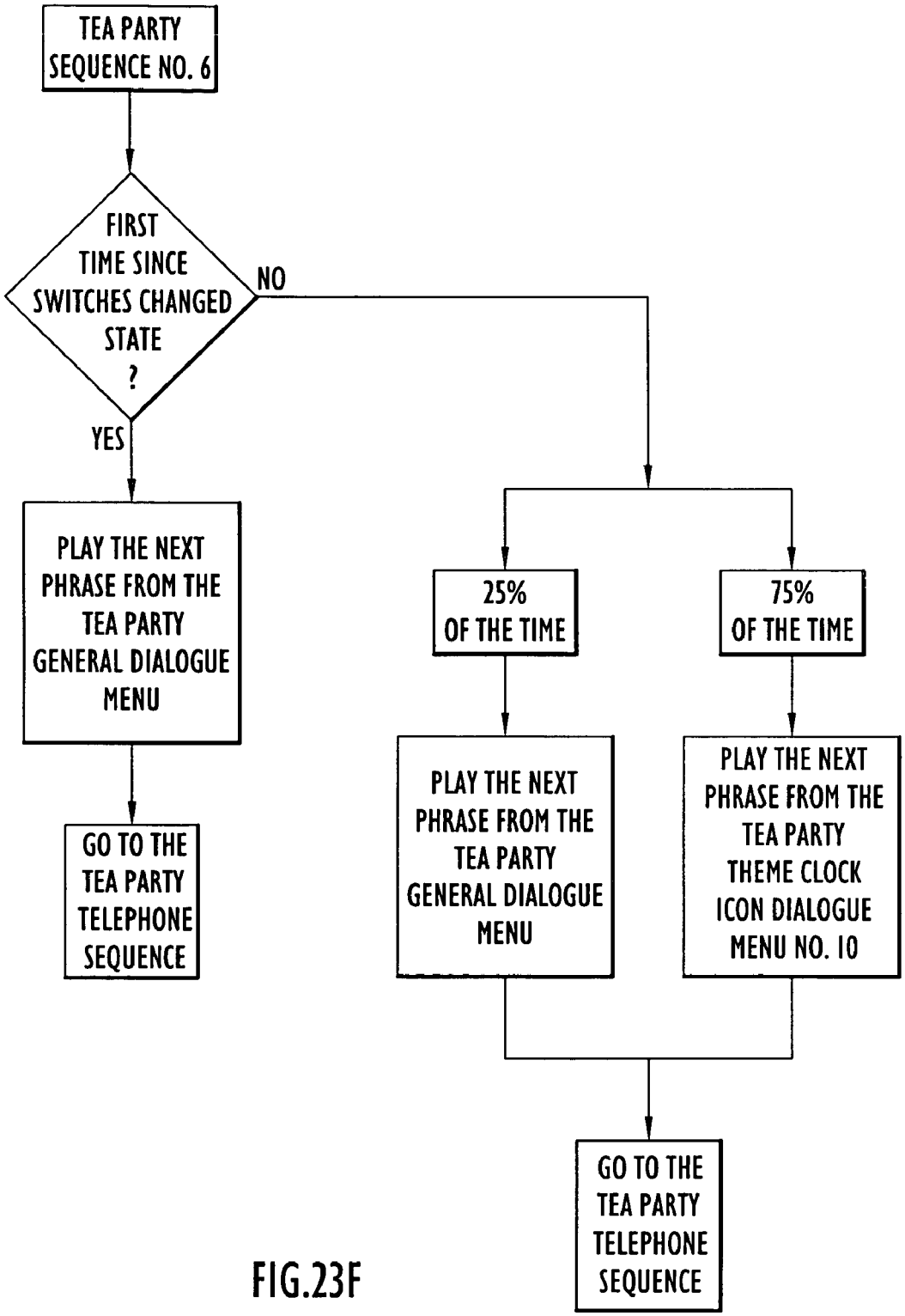
FIG. 23F is a flowchart depicting a tea party play sequence, where the tea party theme card is inserted into the card receiving portion and with the clock hand (selector) directed at the 11 o'clock position in the electronic role play toy kitchen of FIG. 1.
Figure 28A:
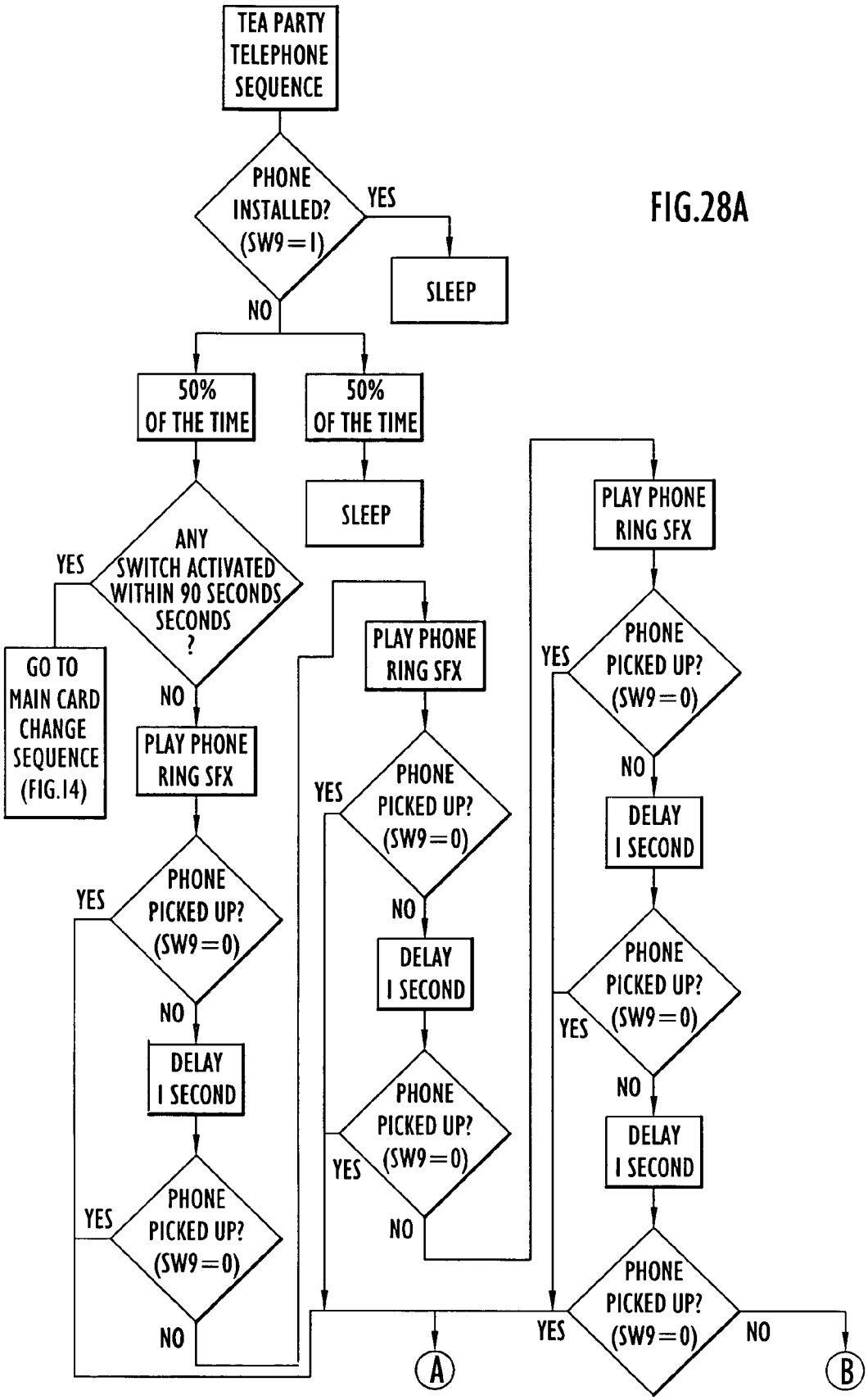
FIGS. 28A and 28B are flowcharts of a tea party telephone play sequence in the electronic role play toy kitchen of FIG. 1.
Figure 28B:
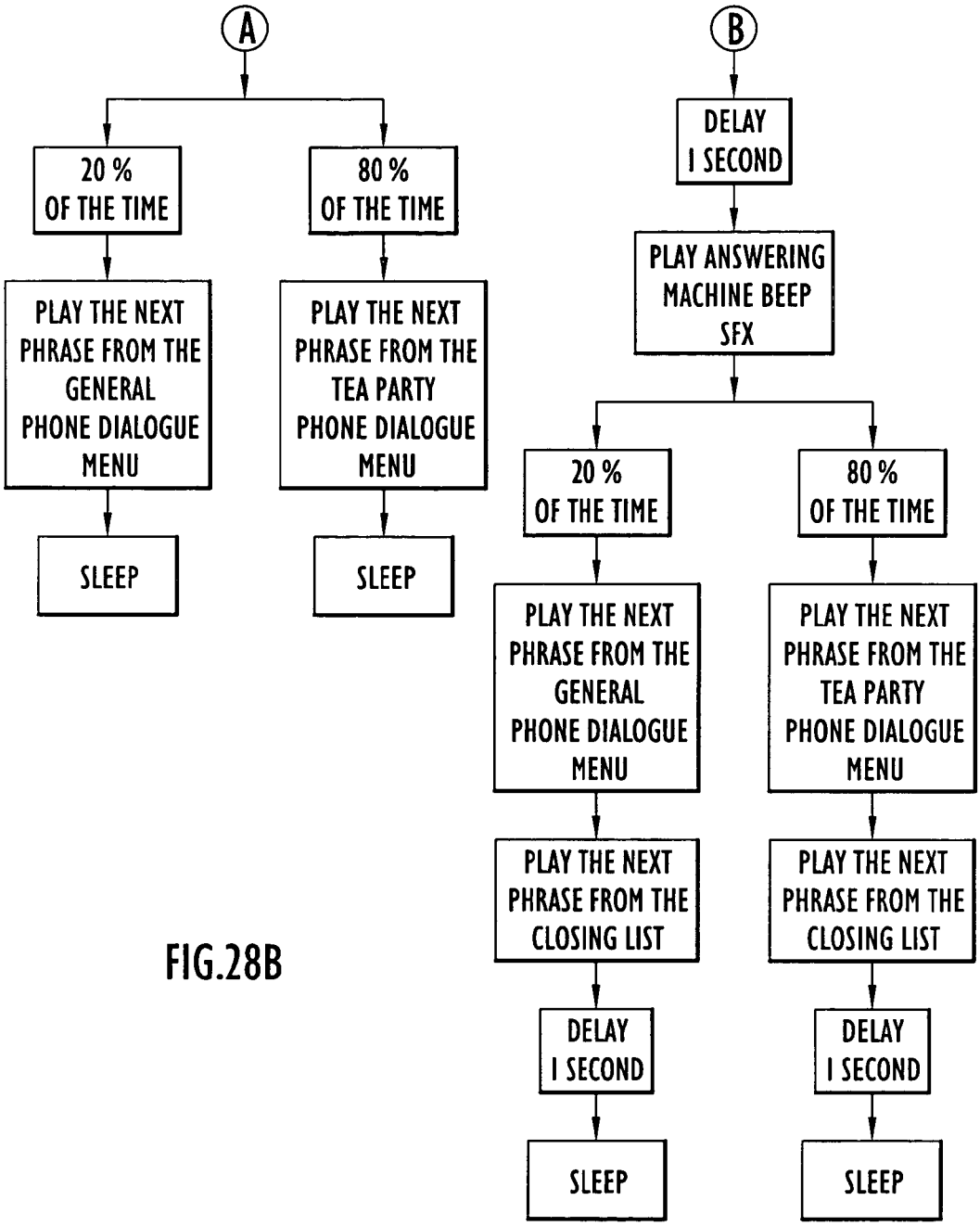

As shown in FIG. 23A, if the tea party theme card 325 is installed in the card receiving portion 327 and the clock hand 324B is in the 1 o'clock position, electronic component 350 moves through "Tea Party Sequence No. 1." If this is the first time through, the electronic component 350 outputs a phrase (via speaker 360) from the "Tea Party General Dialogue Menu". If this is not the first time through, electronic component 350 introduces some pseudo-randomness in that 25% of the time a phrase from the "Tea Party General Dialogue Menu" will be output through the speaker 360, and 75% of the time a phrase from the "Tea Party Theme Clock Icon Dialogue Menu No. 12" will be output through the speaker 360. As shown in FIG. 23D, if the tea party theme card 325 is installed in the card receiving portion 327 and the clock hand 324B is in the 3 o'clock position, electronic component 350 moves through "Tea Party Sequence No. 2." If the tea party theme card 325 is installed in the card receiving portion 327 and the clock hand 324B is in the 5 o'clock position, electronic component 350 moves through "Tea Party Sequence No. 3" (illustrated in FIG. 23B). If the tea party theme card 325 is installed in the card receiving portion 327 and the clock hand 324B is in the 7 o'clock position, electronic component 350 moves through "Tea Party Sequence No. 4" (illustrated in FIG. 23E). If the tea party theme card 325 is installed in the card receiving portion 327 and the clock hand 324B is in the 9 o'clock position, electronic component 350 moves through "Tea Party Sequence No. 5" (illustrated in FIG. 23C). Finally, if the tea party theme card 325 is installed in the card receiving portion 327 and the clock hand 324B is in the 11 o'clock position, electronic component 350 moves through "Tea Party Sequence No. 6" (illustrated in FIG. 23F). After completion of the play sequence, the electronic component 350 begins the self-explanatory "Tea Party Telephone Sequence" as illustrated in FIGS. 28A and 28B.

Figure 19:
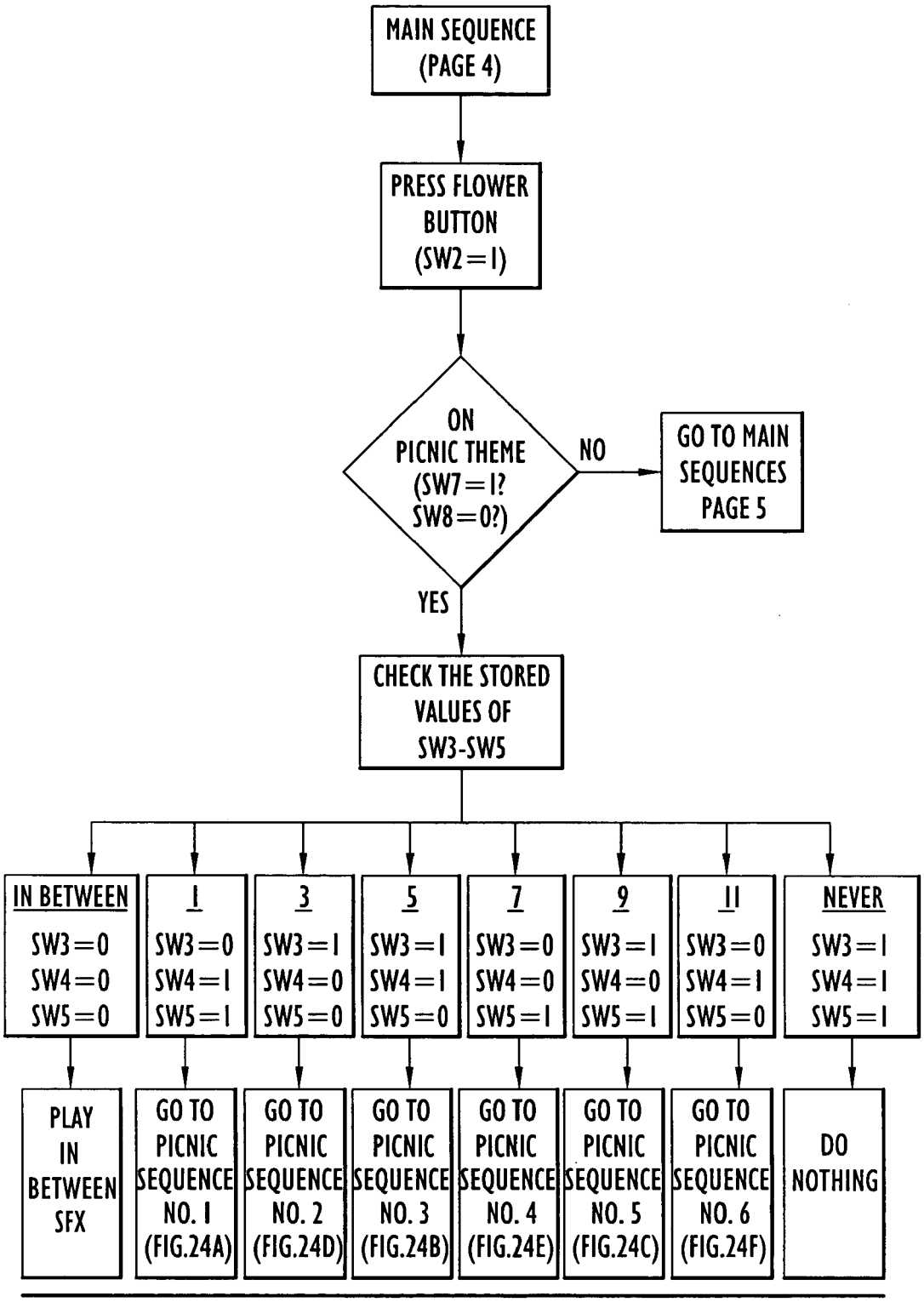
FIG. 19 is a flowchart depicting a play sequence relating to the picnic theme card in the electronic role play toy kitchen of FIG. 1.

Play Sequence—Main Play Sequence Page 4 (FIG. 19—Picnic Theme Card Installed)

Main switch 321A (SW2) is actuated to allow electronic component 350 to check the state of switches 352 (SW7) and 351 (SW8). If switch 352 (SW7) is closed (1) and switch 351 (SW8) is open (0), then the picnic theme card 325 is received in card receiving portion 327, and if not, then the electronic component 350 moves on to main sequence page 5 illustrated in FIG. 20. If the picnic theme card 325 is installed, the electronic component 350 then checks for the stored of value of the switches 730 (SW3), 710 (SW4), and 720 (SW5). Next, the electronic component 350 compares the states of switches 730 (SW3), 710 (SW4), and 720 (SW5) with the clock switch look-up table (FIG. 31) to determine in what position the clock hand 324B is located (1, 3, 5, 7, 9, or 11, or somewhere in between these times). Once the position of the clock hand 324B is identified, the electronic component 350 moves on to the appropriate "picnic" sequence as shown in FIGS. 24A-24F and as discussed below.

Play Sequences—Picnic Play Sequences 1-6 (Picnic Theme Card Installed)

Figure 24A:
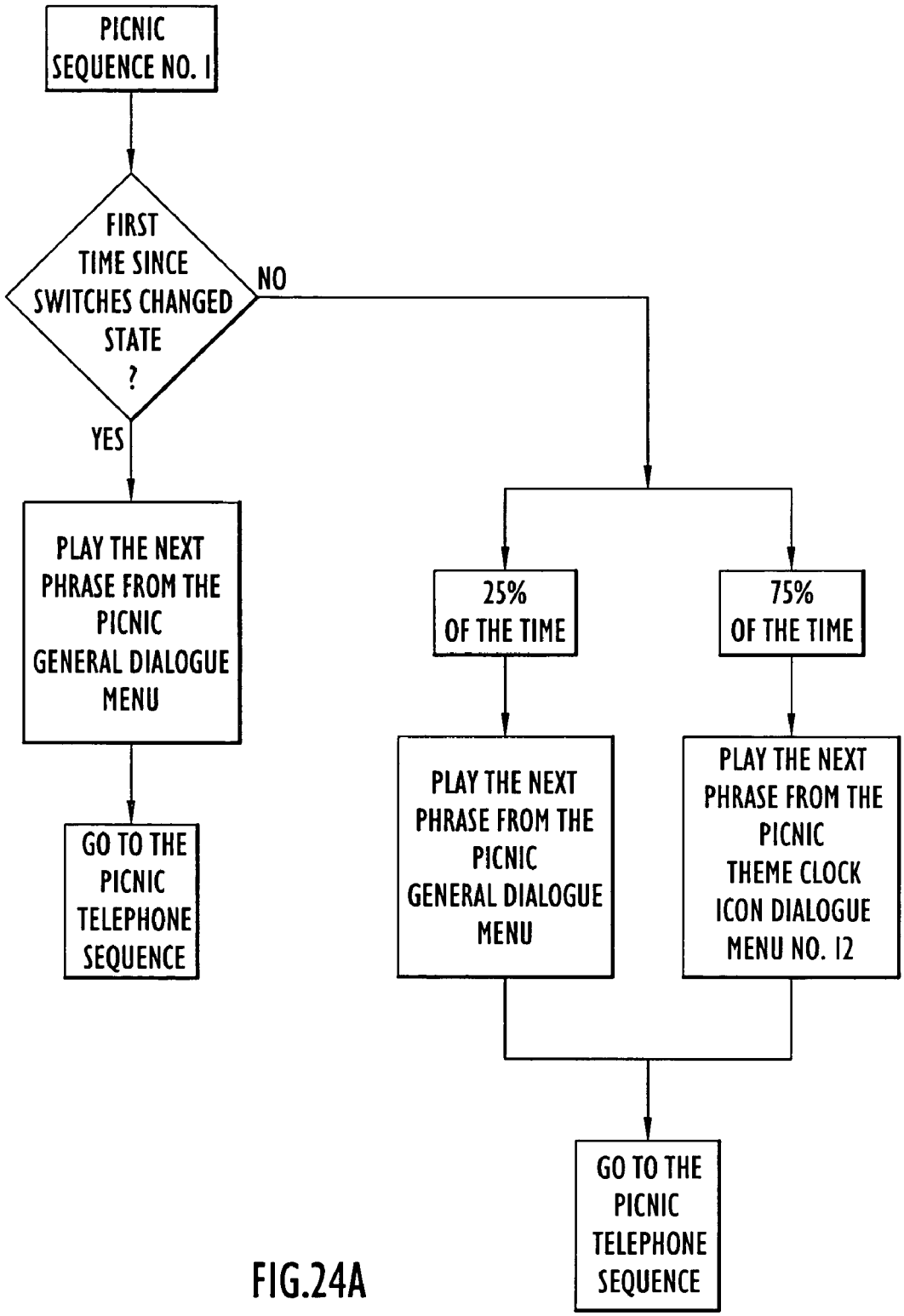
FIG. 24A is a flowchart depicting a picnic play sequence, where the picnic theme card is inserted into the card receiving portion and with the clock hand (selector) directed at the 1 o'clock position in the electronic role play toy kitchen of FIG. 1.
Figure 24B:
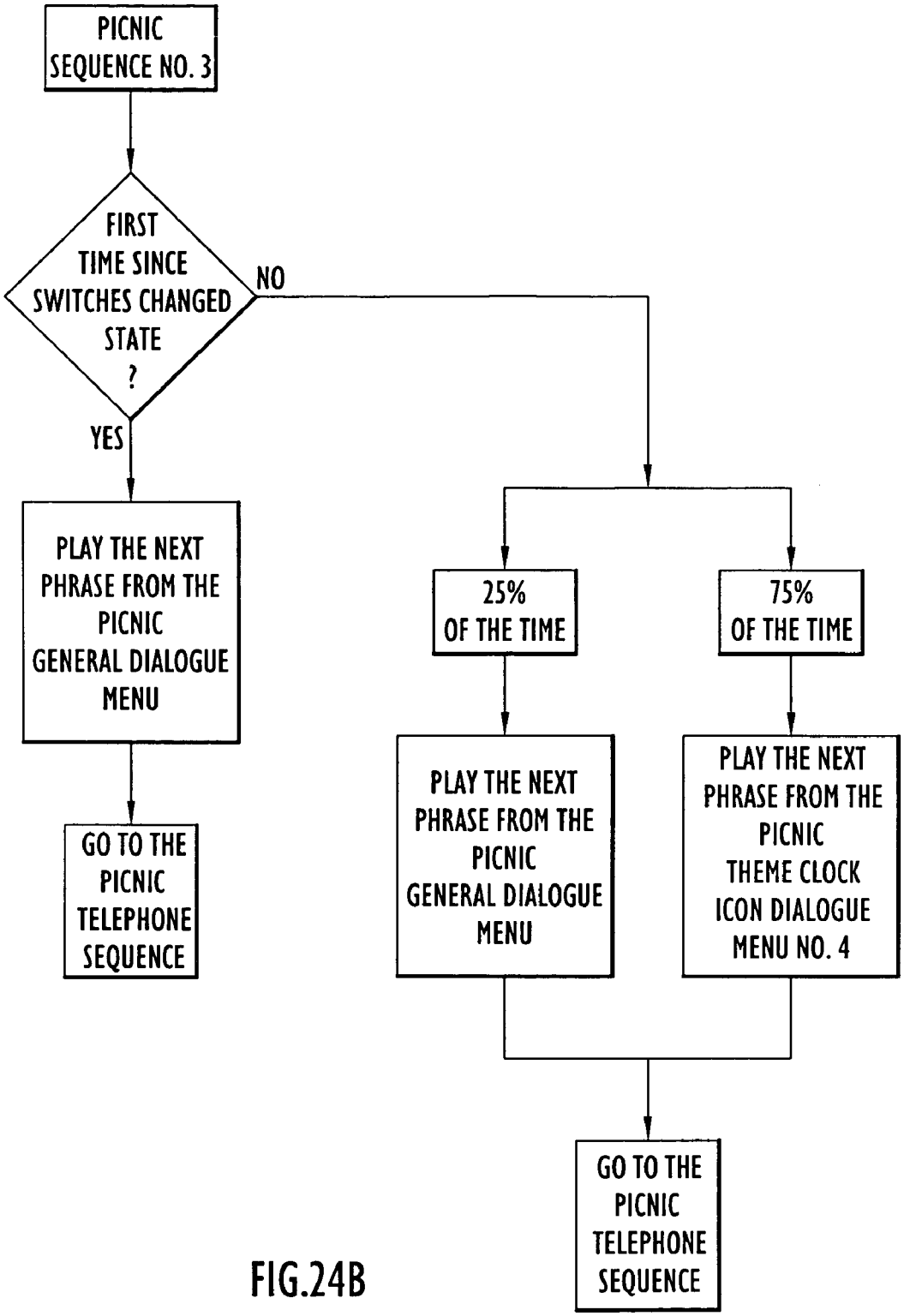
FIG. 24B is a flowchart depicting a picnic play sequence, where the picnic theme card is inserted into the card receiving portion and with the clock hand (selector) directed at the 5 o'clock position in the electronic role play toy kitchen of FIG. 1.
Figure 24C:
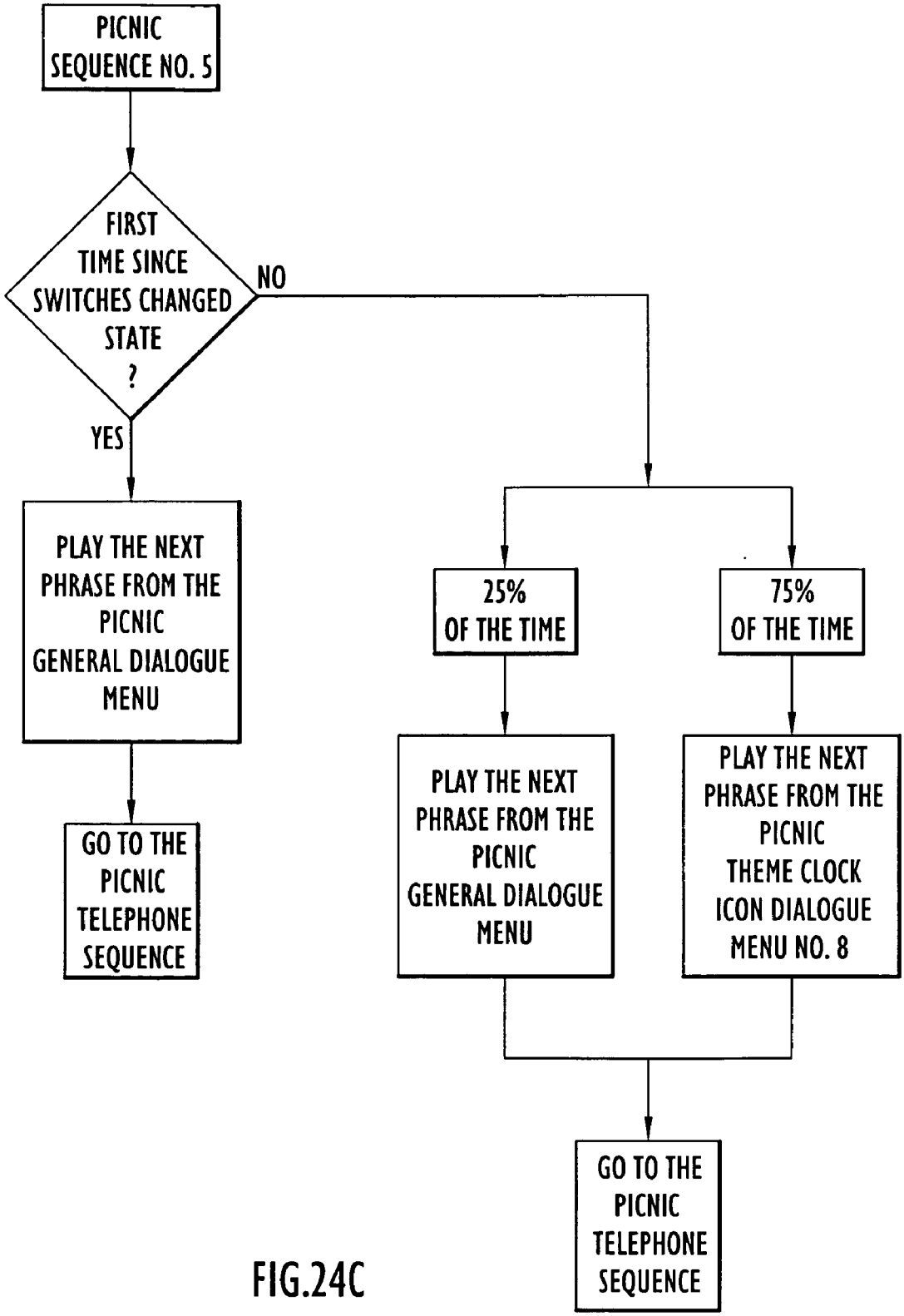
FIG. 24C is a flowchart depicting a picnic play sequence, where the picnic theme card is inserted into the card receiving portion and with the clock hand (selector) directed at the 9 o'clock position in the electronic role play toy kitchen of FIG. 1.
Figure 24D:
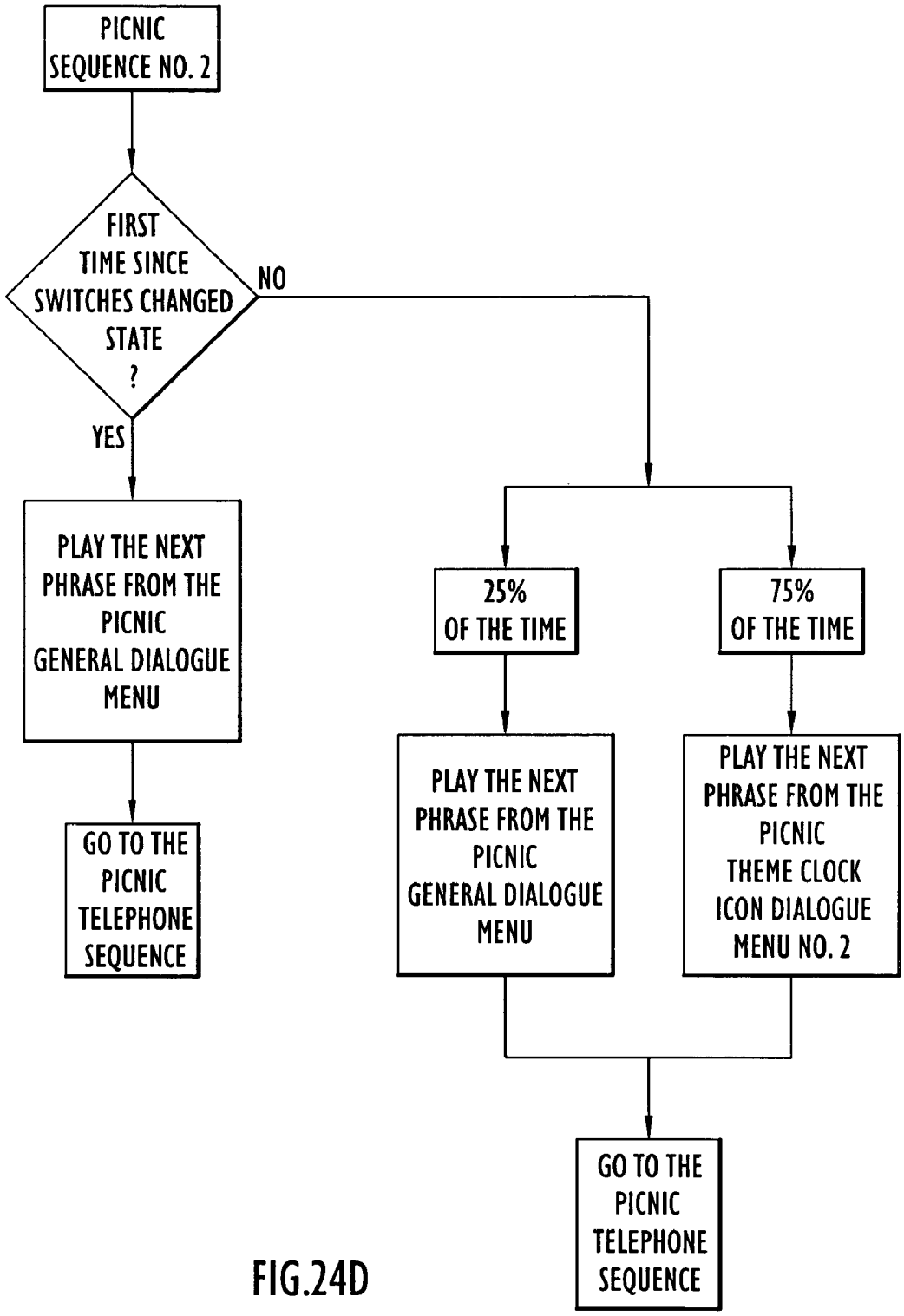
FIG. 24D is a flowchart depicting a picnic play sequence, where the picnic theme card is inserted into the card receiving portion and with the clock hand (selector) directed at the 3 o'clock position in the electronic role play toy kitchen of FIG. 1.
Figure 24E:
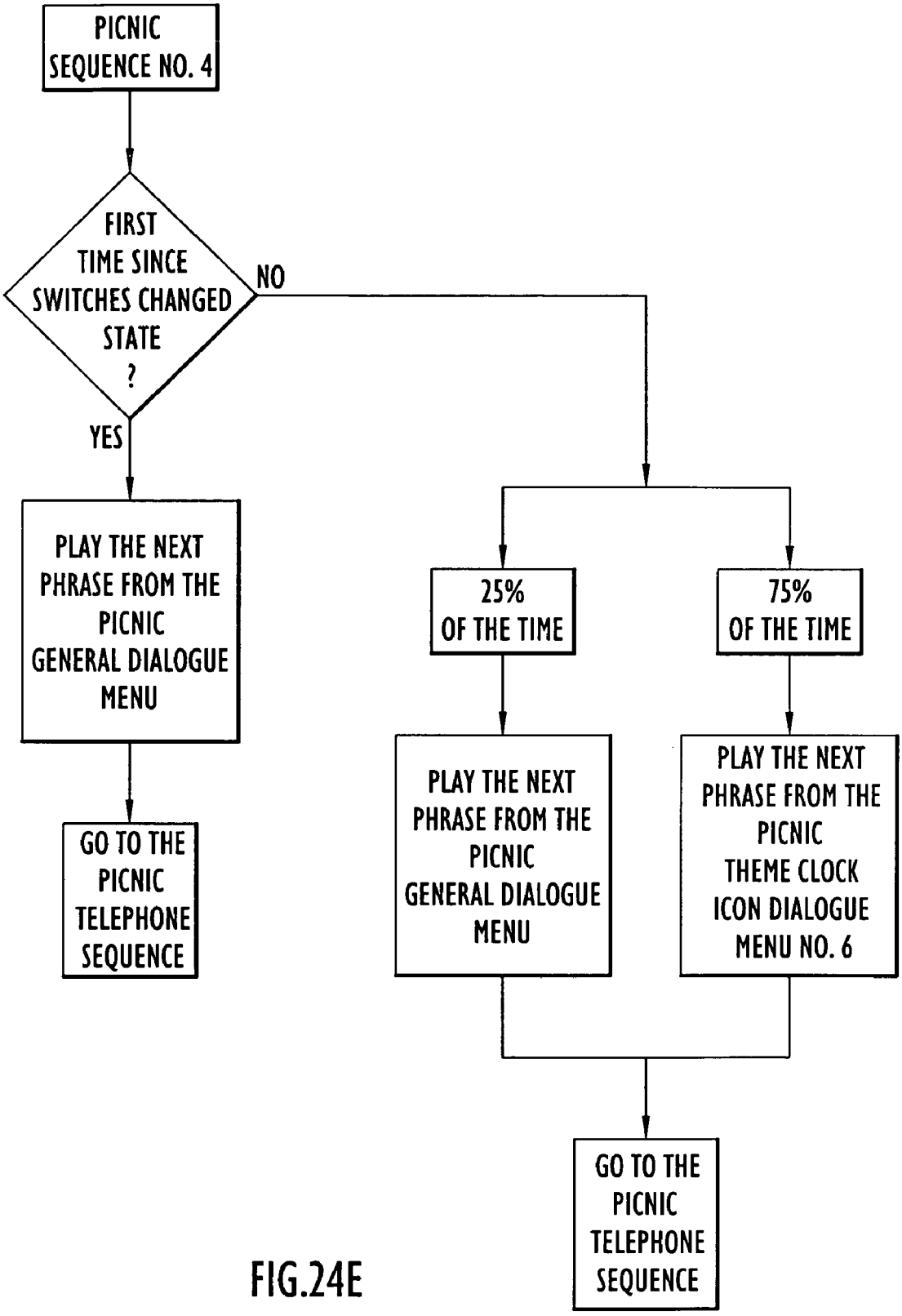
FIG. 24E is a flowchart depicting a picnic play sequence, where the picnic theme card is inserted into the card receiving portion and with the clock hand (selector) directed at the 7 o'clock position in the electronic role play toy kitchen of FIG. 1.
Figure 24F:
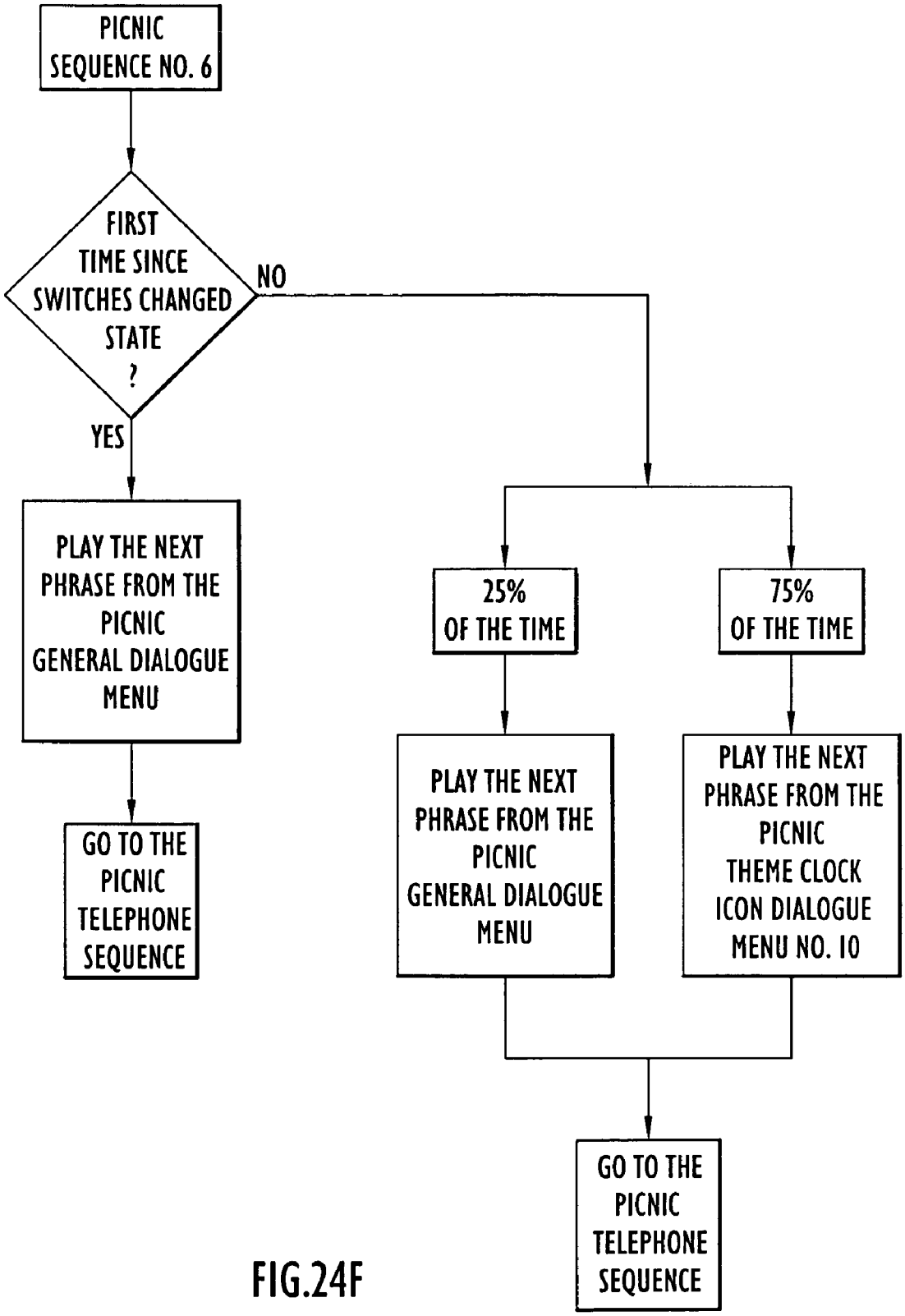
FIG. 24F is a flowchart depicting a picnic play sequence, where the picnic theme card is inserted into the card receiving portion and with the clock hand (selector) directed at the 11 o'clock position in the electronic role play toy kitchen of FIG. 1.
Figure 29A:
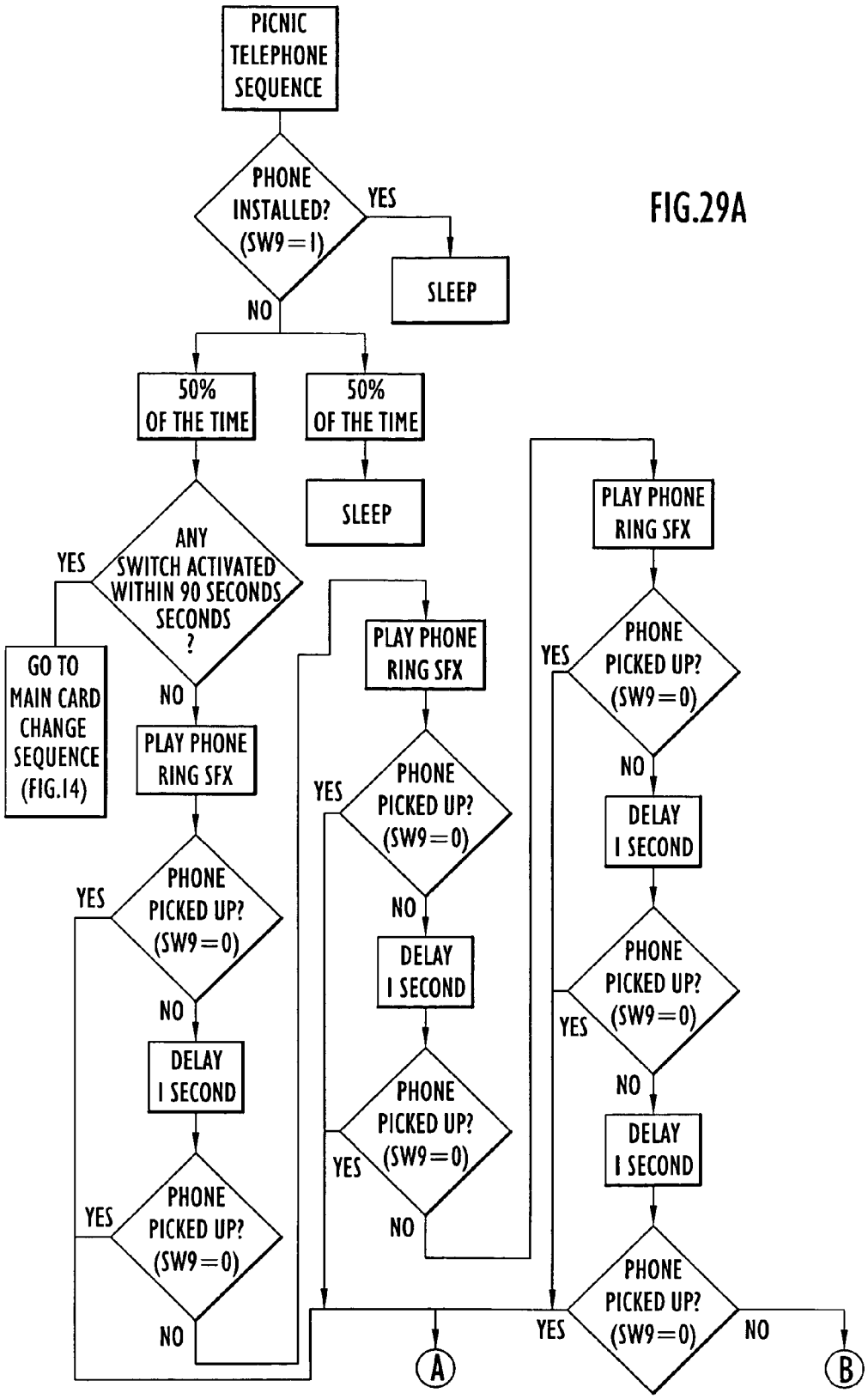
FIGS. 29A and 29B are flowcharts of a picnic telephone play sequence in the electronic role play toy kitchen of FIG. 1.
Figure 29B:
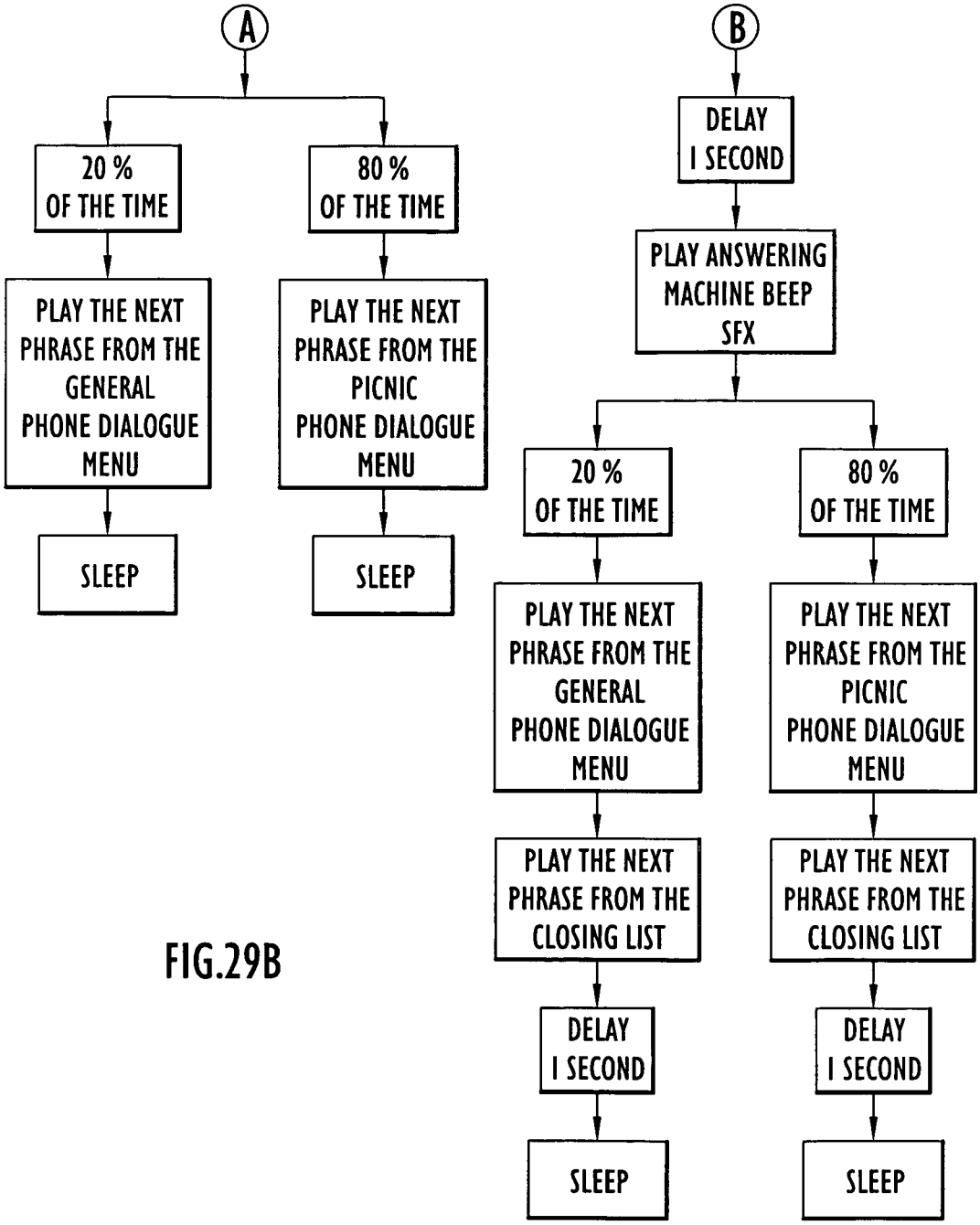

As shown in FIG. 24A, if the picnic theme card 325 is installed in the card receiving portion 327 and the clock hand 324B is in the 1 o'clock position, electronic component 350 moves through "Picnic Sequence No. 1." If this is the first time through, the electronic component 350 outputs a phrase (via speaker 360) from the "Picnic General Dialogue Menu". If this is not the first time through, electronic component 350 introduces some pseudo-randomness in that 25% of the time a phrase from the "Picnic General Dialogue Menu" will be output through the speaker 360, and 75% of the time a phrase from the "Picnic Theme Clock Icon Dialogue Menu No. 12" will be output through the speaker 360. As shown in FIG. 24D, if the picnic theme card 325 is installed in the card receiving portion 327 and the clock hand 324B is in the 3 o'clock position, electronic component 350 moves through "Picnic Sequence No. 2." If the picnic theme card 325 is installed in the card receiving portion 327 and the clock hand 324B is in the 5 o'clock position, electronic component 350 moves through "Picnic Sequence No. 3" (illustrated in FIG. 24B). If the picnic theme card 325 is installed in the card receiving portion 327 and the clock hand 324B is in the 7 o'clock position, electronic component 350 moves through "Picnic Sequence No. 4" (illustrated in FIG. 24E). If the picnic theme card 325 is installed in the card receiving portion 327 and the clock hand 324B is in the 9 o'clock position, electronic component 350 moves through "Picnic Sequence No. 5" (illustrated in FIG. 24C). Finally, if the picnic theme card 325 is installed in the card receiving portion 327 and the clock hand 324B is in the 11 o'clock position, electronic component 350 moves through "Picnic Sequence No. 6" (illustrated in FIG. 24F). After completion of the play sequence, the electronic component 350 begins the self-explanatory "Picnic Telephone Sequence" as illustrated in FIGS. 29A and 29B.

Figure 20:
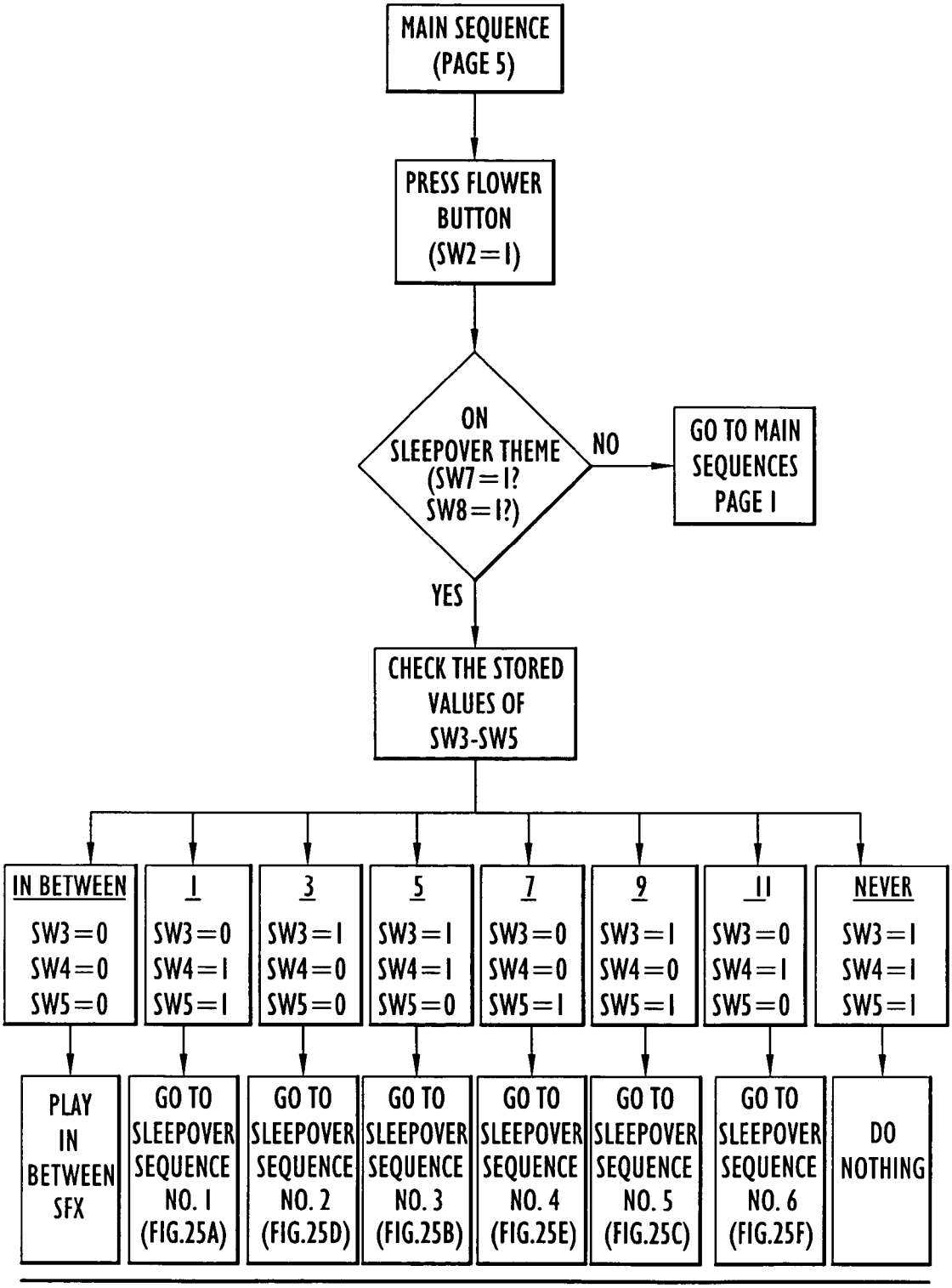
FIG. 20 is a flowchart depicting a play sequence relating to the sleepover theme card in the electronic role play toy kitchen of FIG. 1.

Play Sequence—Main Play Sequence Page 5 (FIG. 20—Sleepover Theme Card Installed)

Main switch 321A (SW2) is actuated to allow electronic component 350 to check the state of switches 352 (SW7) and 351 (SW8). If both switches 352 (SW7) and 351 (SW8) are closed (1), then the sleepover theme card 325 is received in card receiving portion 327, and if not, then the electronic component 350 returns to main sequence page 1 illustrated in FIG. 16. If the sleepover theme card 325 is installed, the electronic component 350 then checks for the stored of value of the switches 730 (SW3), 710 (SW4), and 720 (SW5). Next, the electronic component 350 compares the states of switches 730 (SW3), 710 (SW4), and 720 (SW5) with the clock switch look-up table (FIG. 31) to determine in what position the clock hand 324B is located (1, 3, 5, 7, 9, or 11, or somewhere in between these times). Once the position of the clock hand 324B is identified, the electronic component 350 moves on to the appropriate "sleepover" sequence as shown in FIGS. 25A-25F and as discussed below.

Play Sequences—Sleepover Play Sequences 1-6 (Sleepover Theme Card Installed)

Figure 25A:
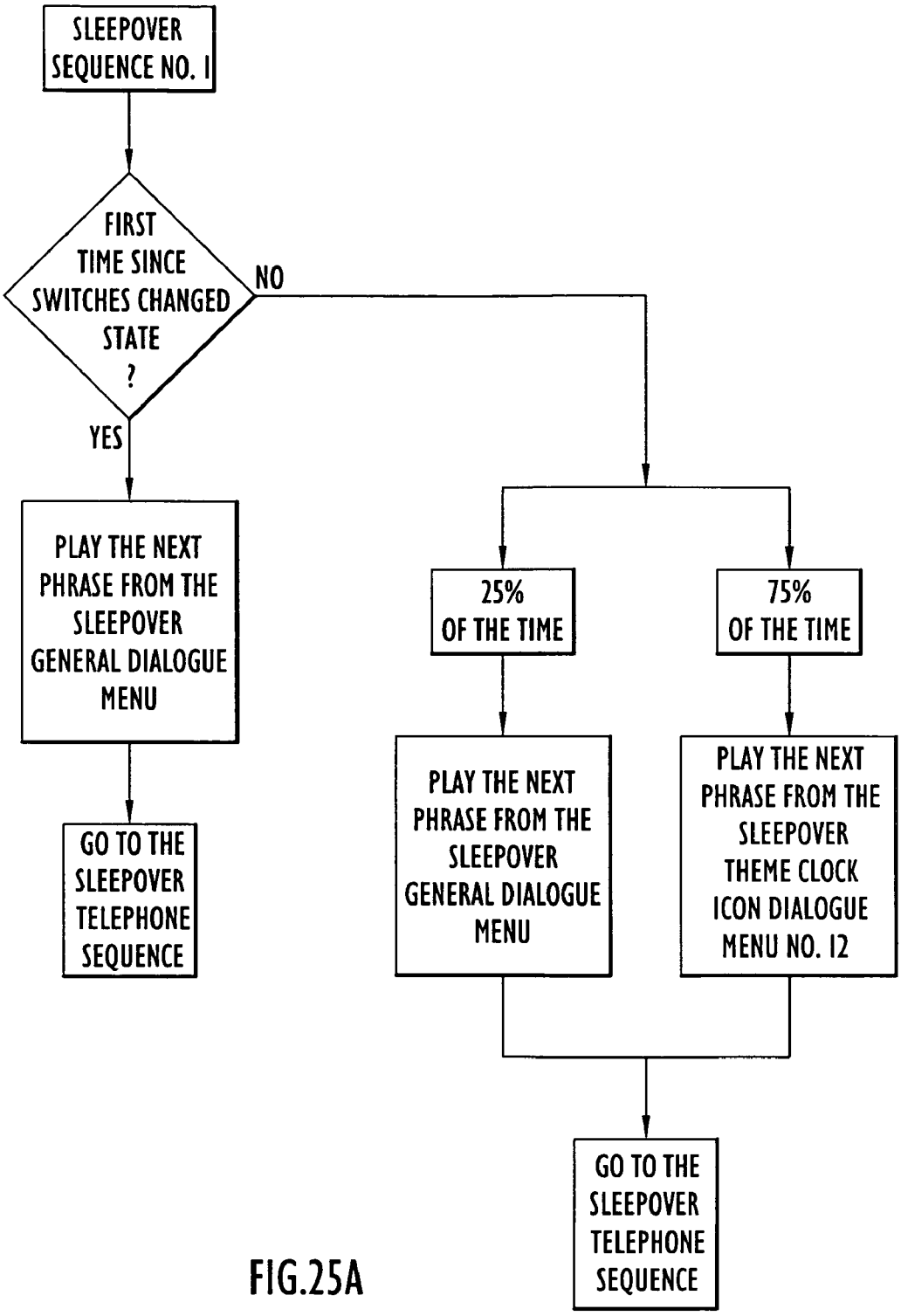
FIG. 25A is a flowchart depicting a sleepover play sequence, where the sleepover theme card is inserted into the card receiving portion and with the clock hand (selector) directed at the 1 o'clock position in the electronic role play toy kitchen of FIG. 1.
Figure 25B:
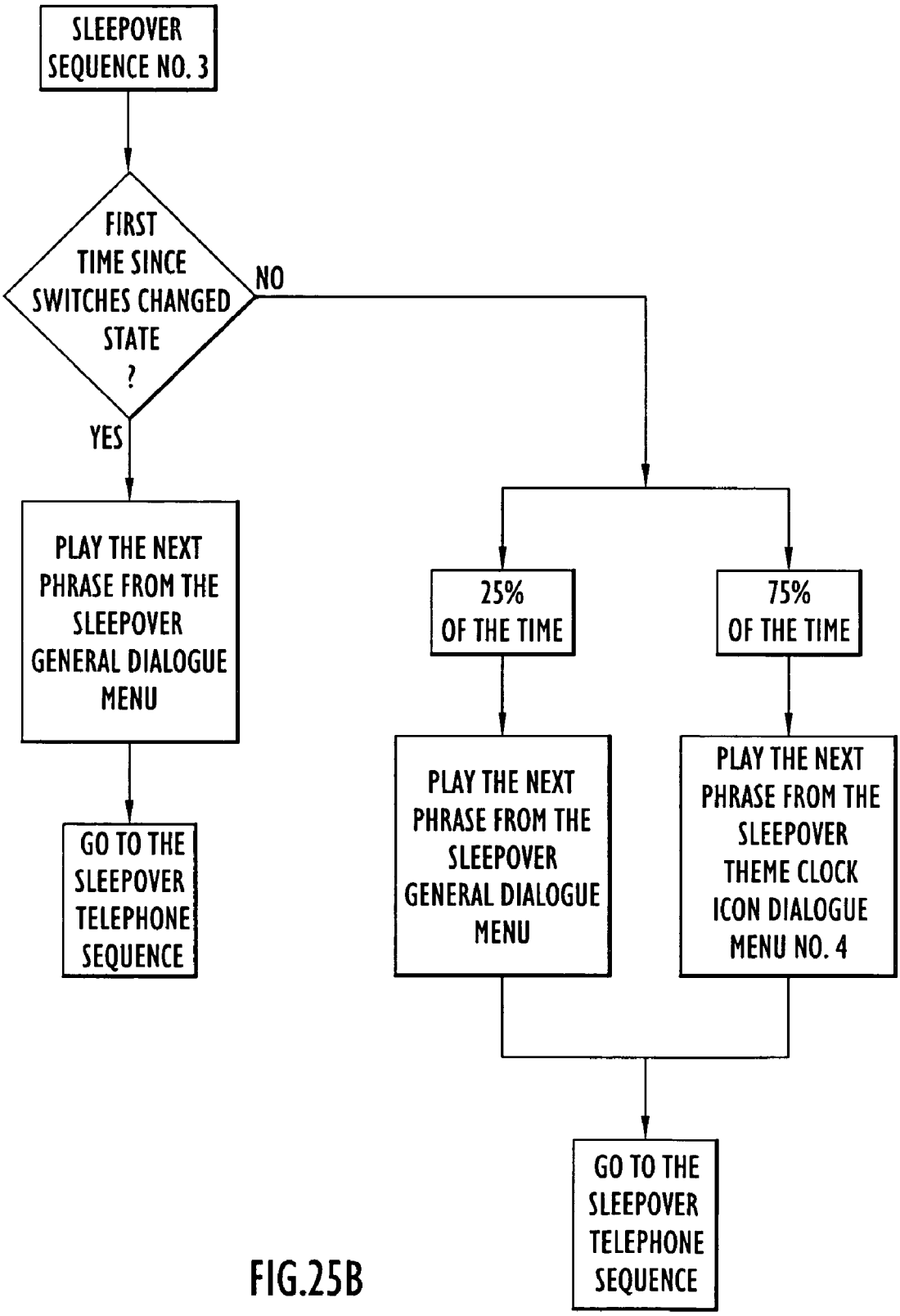
FIG. 25B is a flowchart depicting a sleepover play sequence, where the sleepover theme card is inserted into the card receiving portion and with the clock hand (selector) directed at the 5 o'clock position in the electronic role play toy kitchen of FIG. 1.
Figure 25C:
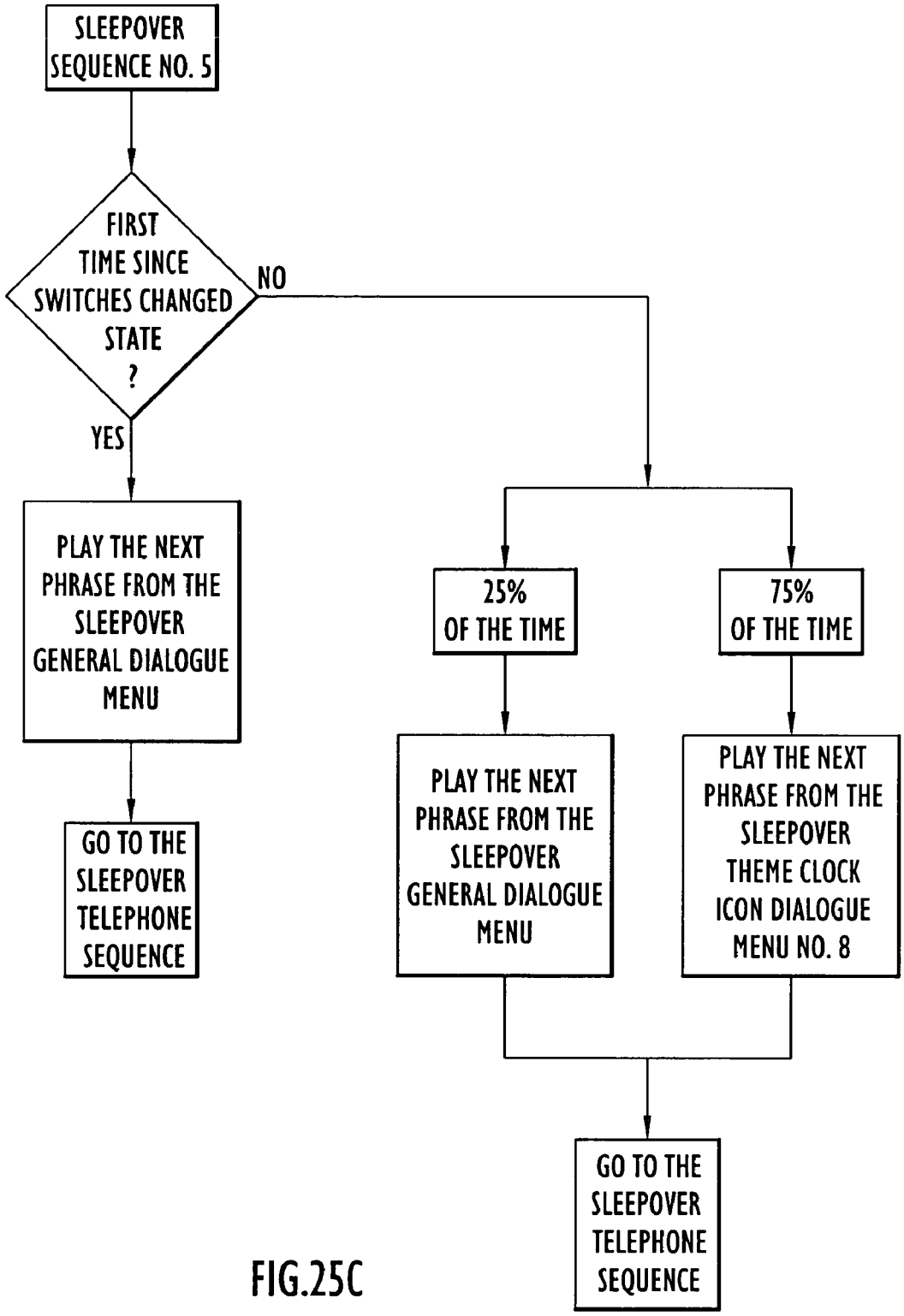
FIG. 25C is a flowchart depicting a sleepover play sequence, where the sleepover theme card is inserted into the card receiving portion and with the clock hand (selector) directed at the 9 o'clock position in the electronic role play toy kitchen of FIG. 1.
Figure 25D:
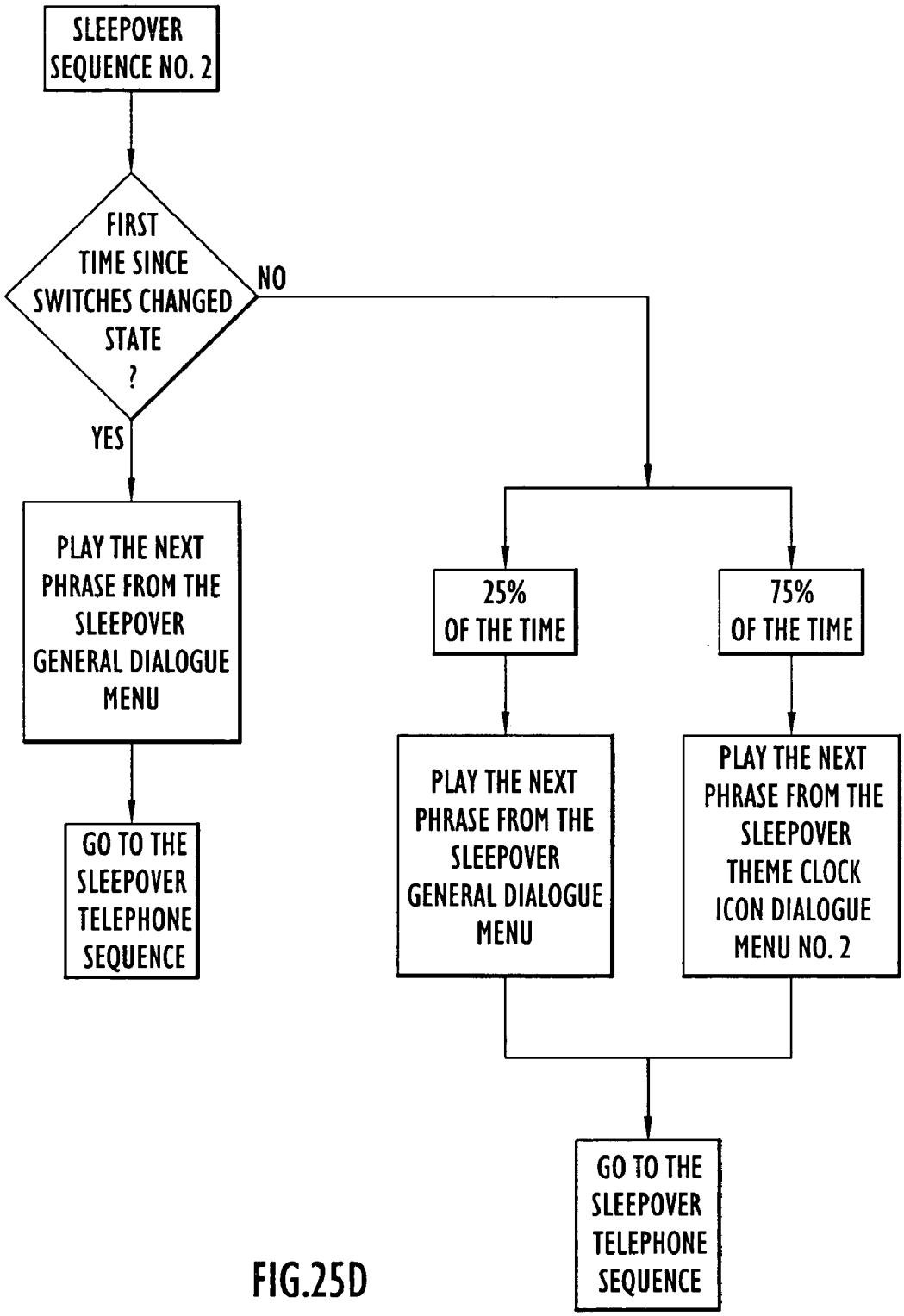
FIG. 25D is a flowchart depicting a sleepover play sequence, where the sleepover theme card is inserted into the card receiving portion and with the clock hand (selector) directed at the 3 o'clock position in the electronic role play toy kitchen of FIG. 1.
Figure 25E:
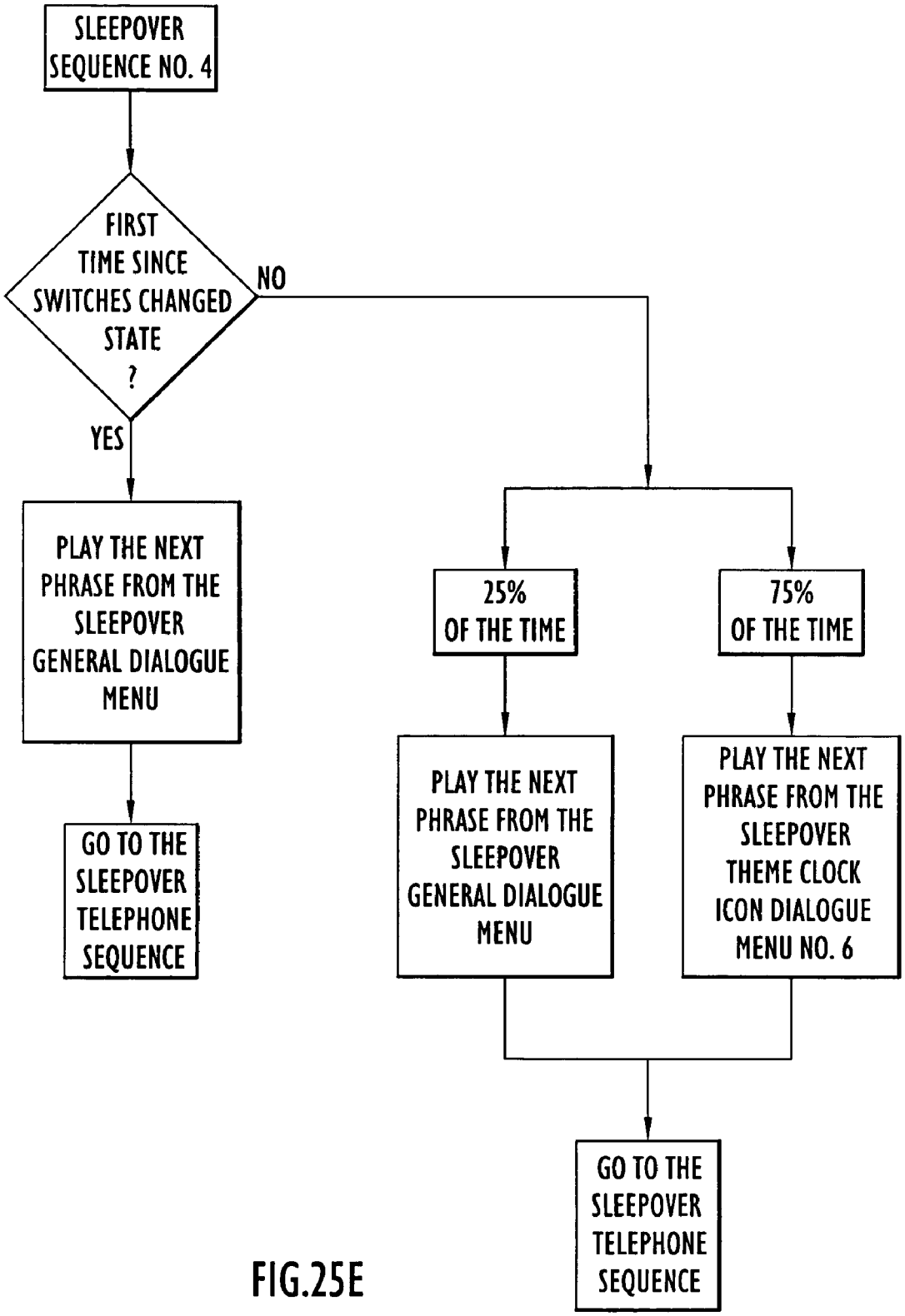
FIG. 25E is a flowchart depicting a sleepover play sequence, where the sleepover theme card is inserted into the card receiving portion and with the clock hand (selector) directed at the 7 o'clock position in the electronic role play toy kitchen of FIG. 1.
Figure 25F:
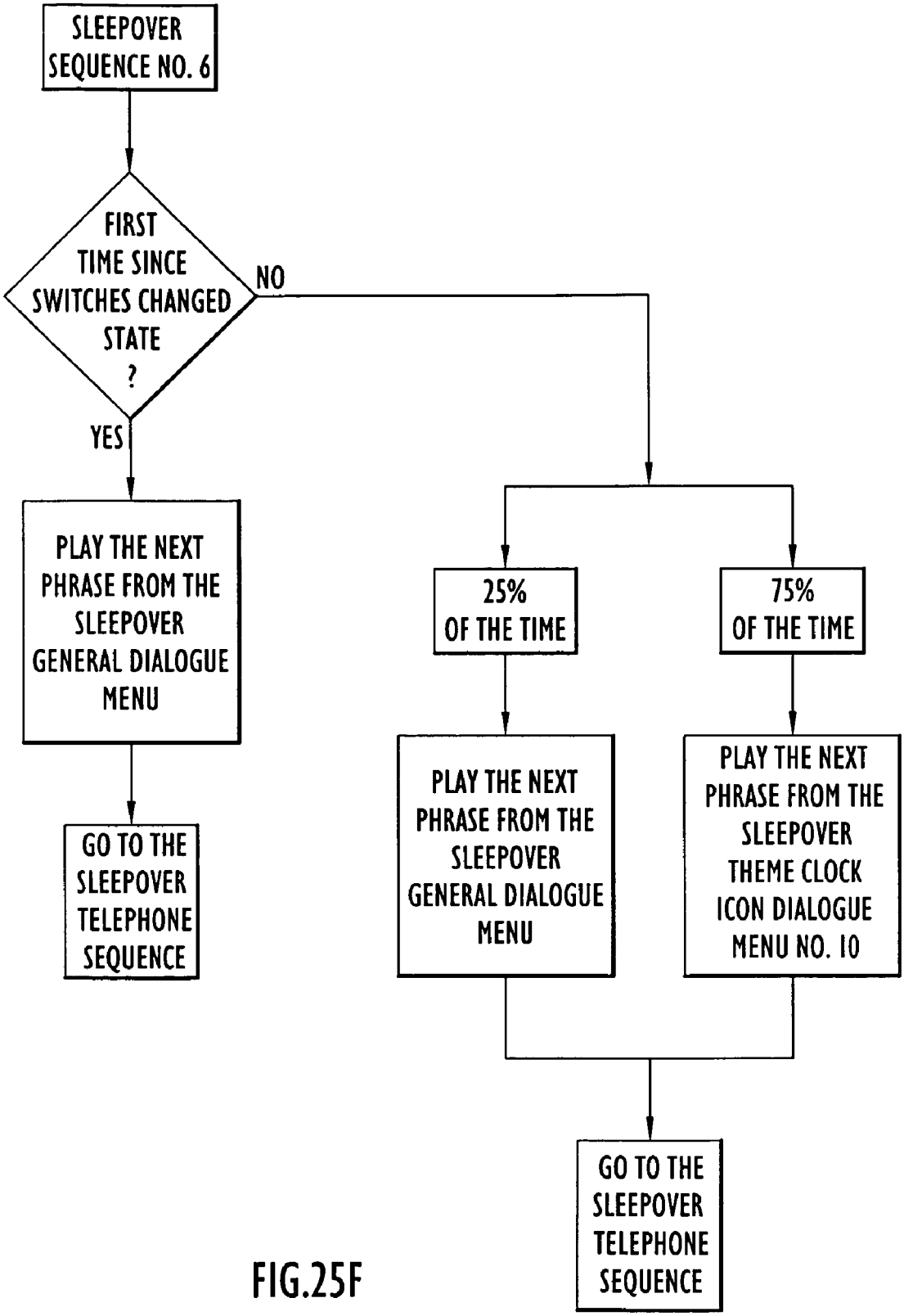
FIG. 25F is a flowchart depicting a sleepover play sequence, where the sleepover theme card is inserted into the card receiving portion and with the clock hand (selector) directed at the 11 o'clock position in the electronic role play toy kitchen of FIG. 1.
Figure 30A:
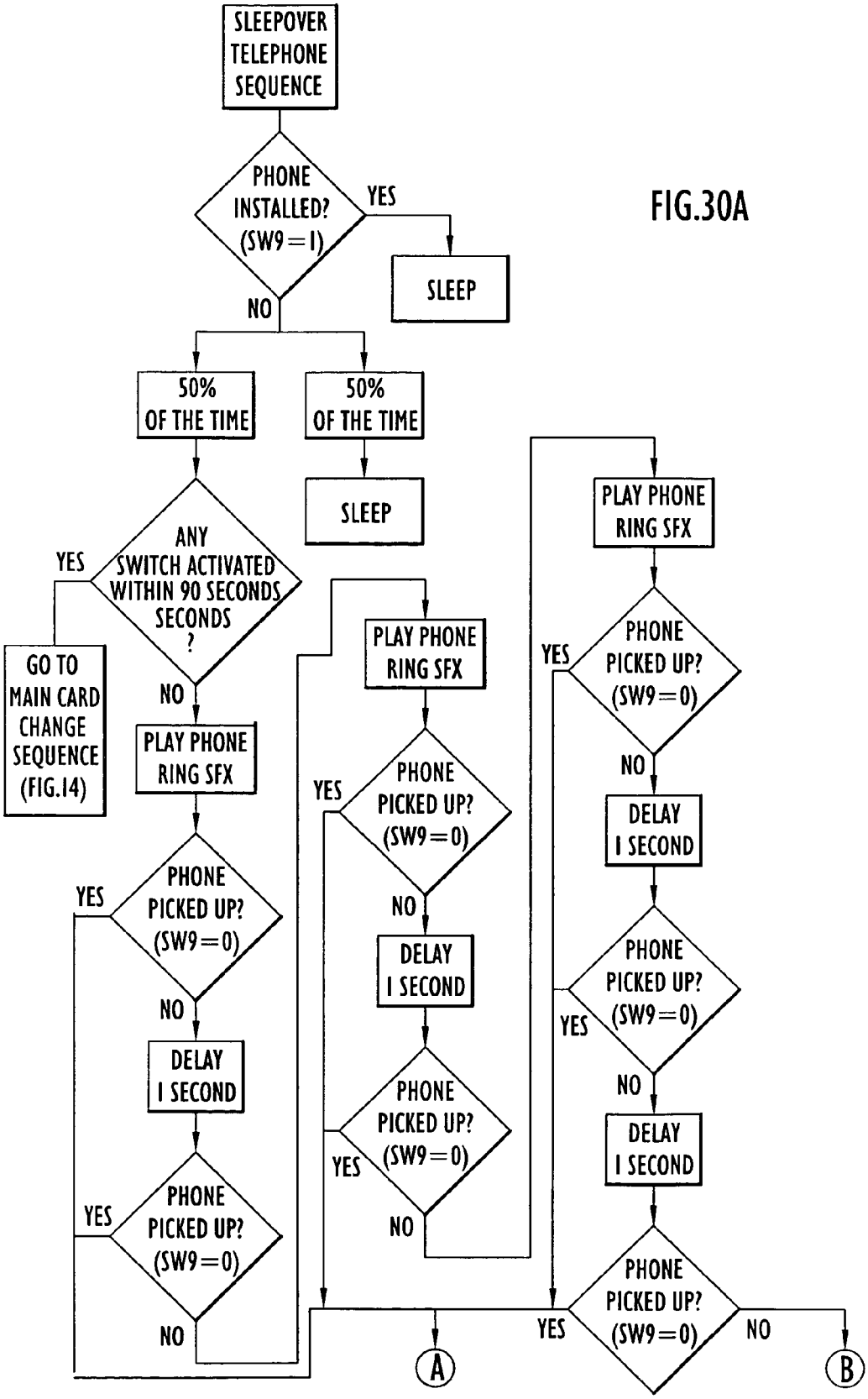
FIGS. 30A and 30B are flowcharts of a sleepover telephone play sequence in the electronic role play toy kitchen of FIG. 1.
Figure 30B:
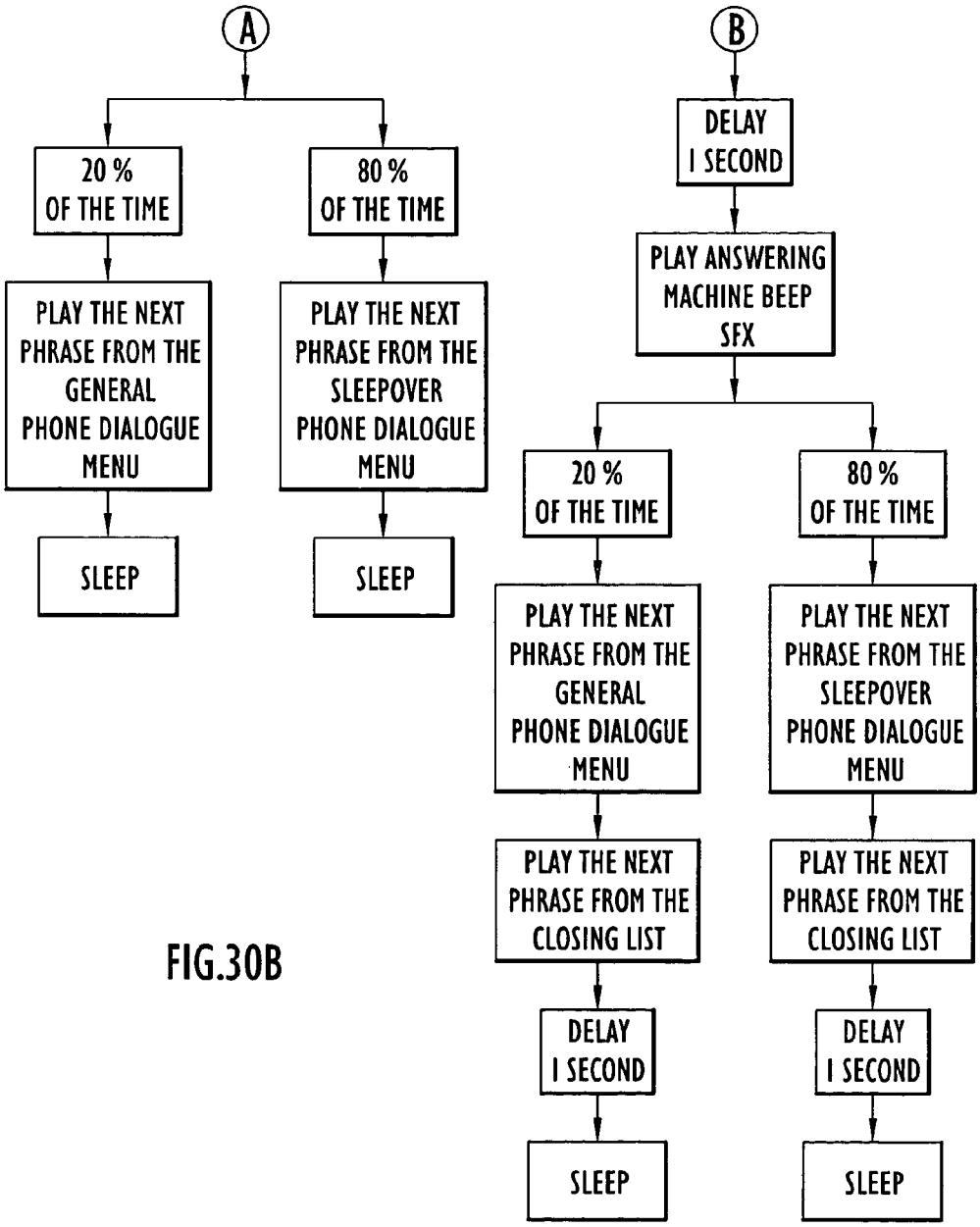

As shown in FIG. 25A, if the sleepover theme card 325 is installed in the card receiving portion 327 and the clock hand 324B is in the 1 o'clock position, electronic component 350 moves through "Sleepover Sequence No. 1." If this is the first time through, the electronic component 350 outputs a phrase (via speaker 360) from the "Sleepover General Dialogue Menu". If this is not the first time through, electronic component 350 introduces some pseudo-randomness in that 25% of the time a phrase from the "Sleepover General Dialogue Menu" will be output through the speaker 360, and 75% of the time a phrase from the "Sleepover Theme Clock Icon Dialogue Menu No. 12" will be output through the speaker 360. As shown in FIG. 25D, if the sleepover theme card 325 is installed in the card receiving portion 327 and the clock hand 324B is in the 3 o'clock position, electronic component 350 moves through "Sleepover Sequence No. 2." If the sleepover theme card 325 is installed in the card receiving portion 327 and the clock hand 324B is in the 5 o'clock position, electronic component 350 moves through "Sleepover Sequence No. 3" (illustrated in FIG. 25B). If the sleepover theme card 325 is installed in the card receiving portion 327 and the clock hand 324B is in the 7 o'clock position, electronic component 350 moves through "Sleepover Sequence No. 4" (illustrated in FIG. 25E). If the sleepover theme card 325 is installed in the card receiving portion 327 and the clock hand 324B is in the 9 o'clock position, electronic component 350 moves through "Sleepover Sequence No. 5" (illustrated in FIG. 25C). Finally, if the sleepover theme card 325 is installed in the card receiving portion 327 and the clock hand 324B is in the 11 o'clock position, electronic component 350 moves through "Sleepover Sequence No. 6" (illustrated in FIG. 25F). After completion of the play sequence, the electronic component 350 begins the self-explanatory "Sleepover Telephone Sequence" as illustrated in FIGS. 30A and 30B.

While the invention has been described in detail and with reference to specific embodiments thereof, it will be apparent to one skilled in the art that various changes and modifications can be made therein without departing from the spirit and scope thereof. For example, some or all of the subject matter may be embodied as software, hardware or a combination thereof. Accordingly, it is intended that the present invention covers the modifications and variations of this invention provided they come within the scope of the appended claims and their equivalents.

We claim:

1. An electronic toy kitchen including a plurality of cards, each card containing at least one indicia, the electronic toy kitchen comprising:

a housing including a toy cooking surface and a card receiving assembly, the card receiving assembly including a selector and a card receiving portion for receiving any of the plurality of cards, the card receiving portion being arranged behind an at least partially transparent face and the selector of the card receiving assembly, wherein any one of the cards received in the card receiving portion is viewable through the face and wherein the selector is operably coupled to the at least partially transparent face; and an electronics unit connected to the housing, the electronics unit adapted to generate sensory output, wherein the sensory output generated by the electronics unit is specific with respect to each of the plurality of cards and its associated at least one indicia in response to any one of the plurality of cards being received in the card receiving portion.

2. The electronic toy kitchen of claim 1, wherein each of the plurality of cards includes a card identifying portion adapted to uniquely identify a particular card.

3. The electronic toy kitchen of claim 2, wherein the card identifying portion of each of the plurality of cards is adapted to activate at least one switch in the card receiving portion to uniquely identify a particular card.

4. The electronic toy kitchen of claim 3, wherein the at least one switch in the card receiving portion is a series of mechanical switches.

5. The electronic toy kitchen of claim 1, wherein the card receiving portion is a slot into the card receiving assembly in which any one of the plurality of cards may be inserted.

6. The electronic toy kitchen of claim 1, wherein each of the plurality of cards includes multiple indicia.

7. The electronic toy kitchen of claim 6, wherein the selector is rotatable for selectively identifying one of the indicia on each of the plurality of cards received in the card receiving portion behind the face.

8. The electronic toy kitchen of claim 7, wherein the electronics unit generates a specific sensory output as a function of both the card that is received in the card receiving portion and the indicia on the card received in the card receiving portion as identified by the rotatable selector.

9. The electronic toy kitchen of claim 1, wherein the card receiving assembly further comprises a card storage portion arranged in parallel with the card receiving portion, wherein the card receiving portion is disposed between the face and the card storage portion.

10. An electronic toy including a plurality of cards, each card containing multiple indicia, the electronic toy comprising:

a housing including a card receiving assembly, the card receiving assembly including a selector and a card receiving portion for receiving any of the plurality of cards, the card receiving portion being arranged behind an at least partially transparent face and the selector of the card receiving assembly, wherein any one of the cards received in the card receiving portion is viewable through the face and wherein the selector is operably coupled to the at least partially transparent face;

an electronics unit connected to the housing, the electronics unit adapted to generate sensory output;

the selector being configured for movement to selectively identify one of the indicia on a card inserted in the card receiving portion, wherein the electronics unit generates a specific sensory output as a function of both the card that is received in the card receiving portion and the indicia on the card received in the card receiving portion as identified by the selector.

11. The electronic toy of claim 10, wherein each of the plurality of cards includes a card identifying portion adapted to uniquely identify a particular card.

12. The electronic toy of claim 11, wherein the card identifying portion of each of the plurality of cards is adapted to activate at least one switch in the card receiving portion to uniquely identify a particular card.

13. The electronic toy of claim 12, wherein the at least one switch in the card receiving portion is a series of mechanical switches.

14. The electronic toy of claim 10, wherein the card receiving portion is a slot in the card receiving assembly into which any one of the plurality of cards may be inserted.

15. The electronic toy of claim 10, wherein the electronic toy is a toy kitchen.

16. A method of operating an electronic toy kitchen, the electronic toy kitchen including a plurality of cards, each card containing at least one indicia, a housing including a toy cooking surface and a card receiving assembly, the card receiving assembly including a selector and a card receiving portion for receiving any of the plurality of cards the card receiving portion being arranged behind an at least partially transparent face and the selector of the card receiving assembly, wherein any one of the cards received in the card receiving portion is viewable through the face and wherein the selector is operably coupled to the at least partially transparent face, and an electronics unit connected to the housing, the electronics unit adapted to generate sensory output, the method comprising the steps of:

inserting a first of the plurality of cards into the card receiving portion, a first sensory output specific with respect to the first of the plurality of cards and its associated at least one indicia being generated by the electronics unit;

removing the first of the plurality of cards from the card receiving portion; and inserting a second of the plurality of cards into the card receiving portion, a second, different, sensory output specific with respect to the second of the plurality of cards and its associated at least one indicia being generated by the electronics unit.

17. The method of operating an electronic toy kitchen of claim 16, wherein each of the plurality of cards includes a card identifying portion adapted to uniquely identify a particular card.

18. The method of operating an electronic toy kitchen of claim 17, wherein the card identifying portion of each of the plurality of cards is adapted to activate at least one switch in the card receiving portion to uniquely identify a particular card.

19. The method of operating an electronic toy kitchen of claim 18, wherein the at least one switch in the card receiving portion is a series of mechanical switches.

20. The method of operating an electronic toy kitchen of claim 16, wherein each of the plurality of cards includes multiple indicia.

21. The method of operating an electronic toy kitchen of claim 20, wherein the selector is rotatable on the face for selectively identifying one of the indicia on a card inserted into the card receiving portion behind the face.

22. The method of operating an electronic toy kitchen of claim 21 further including the steps of:

rotating the selector to select a first of the indicia on the first of the cards in response to the first of the plurality of cards being received in the card receiving portion behind the face, the electronics unit generating a sensory output related to the first selected indicia; and rotating the selector to select a second of the indicia on the first of the cards in response to the first of the plurality of cards being received in the card receiving portion behind the face, the electronics unit generating a different sensory output related to the second selected indicia.

* * * * *

UNITED STATES PATENT AND TRADEMARK OFFICE

CERTIFICATE OF CORRECTION

PATENT NO. : 7,387,560 B2
APPLICATION NO. : 10/910804
DATED : June 17, 2008
INVENTOR(S) : Brumagin et al.

It is certified that error appears in the above-identified patent and that said Letters Patent is hereby corrected as shown below:

Column 10, line 42, change “Chanze” to --Change--

Signed and Sealed this
Twenty-second Day of January, 2013

David J. Kappos

David J. Kappos
*Director of the United States Patent and Trademark Office*